US006582118B1

(12) United States Patent
Nakajima et al.

(10) Patent No.: US 6,582,118 B1
(45) Date of Patent: Jun. 24, 2003

(54) ELECTRONIC TIMEPIECE HAVING TRANSMISSION WHEEL ROTATIONAL POSITION DETECTING APPARATUS

(75) Inventors: Kenichi Nakajima, Chiba (JP); Takayuki Satodate, Chiba (JP); Akihiro Matouge, Chiba (JP); Akihiko Inada, Chiba (JP); Mitsuru Ishii, Chiba (JP); Yoshio Koyama, Chiba (JP); Shigeo Suzuki, Chiba (JP); Masayuki Kawata, Chiba (JP); Yuko Sasaki, Chiba (JP); Eriko Takakuwa, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/583,135

(22) Filed: May 30, 2000

Related U.S. Application Data

(63) Continuation-in-part of application No. 09/065,987, filed on Apr. 24, 1998, now Pat. No. 6,088,302.

(30) Foreign Application Priority Data

Apr. 25, 1997 (JP) ..... 9-109446
Apr. 25, 1997 (JP) ..... 9-109455
Jan. 29, 1998 (JP) ..... 10-016701
Mar. 31, 1998 (JP) ..... 10-086710

(51) Int. Cl.[7] ..... G04B 19/24
(52) U.S. Cl. ..... 368/184; 368/28; 368/37; 368/38
(58) Field of Search ..... 368/28, 31–37, 368/243, 76, 80, 252

(56) References Cited

U.S. PATENT DOCUMENTS 3,596,460 A * 8/1971 Wuthrich ..... 368/252
4,060,977 A * 12/1977 Rochat ..... 368/35
4,199,930 A * 4/1980 Lebet et al. ..... 368/252
4,214,134 A * 7/1980 Ogihara et al. ..... 368/252
4,271,494 A * 6/1981 Miyazaki ..... 368/34
4,282,592 A * 8/1981 Miyasaka ..... 368/37
4,320,476 A * 3/1982 Berney ..... 368/35
4,396,297 A * 8/1983 Akahanne ..... 368/262
4,465,381 A * 8/1984 Cleusix ..... 368/250
4,922,475 A * 5/1990 Scholer ..... 368/252
5,274,614 A 12/1993 Yamazaki ..... 368/28
5,699,321 A * 12/1997 Vaucher ..... 368/37
5,734,626 A * 3/1998 Eckstein ..... 368/21
5,903,519 A * 5/1999 Takahashi et al. ..... 368/35
5,959,940 A * 9/1999 Assunuma ..... 368/9
6,088,301 A * 7/2000 Tsuji ..... 368/28

FOREIGN PATENT DOCUMENTS

JP 60224085 A * 11/1985 ..... 368/252
JP 60224086 A * 11/1985 ..... 368/252

* cited by examiner

*Primary Examiner*—Vit Miska
*Assistant Examiner*—Jeanne-Marguerite Goodwin
(74) *Attorney, Agent, or Firm*—Adams & Wilks

(57) ABSTRACT

An electronic timepiece has a wheel train mounted for undergoing rotation and a transmission wheel for undergoing rotation in accordance with rotation of the wheel train. A contact point spring is connected to the transmission wheel for rotation therewith. The contact point spring extends substantially linearly through a rotational center of the transmission wheel. First and second detection patterns contact the contact point spring during rotation of the transmission wheel to generate a rotational position detecting signal corresponding to a rotational position of the transmission wheel. The first and second detection patterns are disposed at an angle of substantially 180 degree relative to the rotational center of the transmission wheel.

13 Claims, 50 Drawing Sheets

ELECTRONIC TIMEPIECE HAVING TRANSMISSION WHEEL ROTATIONAL POSITION DETECTING APPARATUS

This is a Continuation-in-part of application Ser. No. 09/065,987, filed Apr. 24, 1998, now U.S. Pat. No. 6,088,302.

BACKGROUND OF THE INVENTION

The present invention relates to an electronic timepiece having a transmission wheel rotational position detecting apparatus for detecting a position along a rotational direction of a wheel, such as a transmission wheel, included in a wheel train, such as an obverse train or a calendar train, of the electronic timepiece.

In a conventional electronic timepiece, as shown by FIG. 38, a portion of an obverse wheel train 930, for example, a 24-h contact point 932 for detecting a rotational position of the obverse wheel train 930 is provided on an hour wheel. When the 24-contact point 932 detects a position in correspondence with twelve o'clock at night, a circuit block 934 rotates a date driving motor 936 by a detection signal outputted from the 24-h contact point 932. By rotating the date driving motor 936, a date indicator 912 is rotated via rotation of a reduction wheel train 938. Thereby, display of date can be changed.

According to such a conventional electronic timepiece, a conduction pin is provided at a region proximate to an outer peripheral portion of a gear portion of the hour wheel. Further, there is constructed a constitution in which when the hour wheel is rotated, the conduction pin is moved to thereby bring a contact point spring into contact with a contact point pattern of the circuit block, thereafter, when the hour wheel is further rotated, the conduction pin is detached from the contact point spring and the contact point spring is detached from the contact point pattern of the circuit block. That is, the contact point spring corresponds to the 24-h contact point 932 and is constituted to detect a position in correspondence with twelve o'clock at night when the contact point spring is brought into contact with the contact point pattern of the circuit block.

Further, according to a structure in which by rotating the date driving motor, a date driving wheel is rotated via rotation of an intermediate date driving wheel and a date indicator is rotated by rotating the date driving wheel, teeth shape of gears of the intermediate date driving wheel, the date driving wheel and the date indicator are constituted by a circular arc gear shape including one or more of circular arcs.

Accordingly, when the date indicator is exerted with an external force such as impact, rotation of the date indicator is hampered only by index torque of the date driving motor.

However, according to the conventional electronic timepiece, there pose the following problems.

(1) The contact point spring is formed by a material which is easy to flex and therefore, it is difficult to position a portion of the contact point spring which is brought into contact with the contact point pattern.

(2) A large space is needed to arrange a contact point spring having a sufficient length of the spring.

(3) When the portion of the contact point spring which is brought into contact with the contact point pattern is arranged remote from the contact point pattern more than necessary, even when the hour wheel is rotated, the contact point spring cannot be brought into contact with the contact point pattern of the circuit block by the conduction pin and time display or calendar display cannot be carried out accurately.

(4) When the portion of the contact point spring which is brought into contact with the contact point pattern is arranged proximate to the contact point pattern more than necessary, in the case where the hour wheel is rotated, pressure of the contact point spring applied on the conduction pin is increased, a malfunction may be caused in operating the electronic timepiece, or the electronic timepiece may be stopped.

(5) The structure of the hour wheel becomes complicated and the contact point spring having a sufficient spring length is needed.

(6) According to the conventional electronic timepiece with calendar provided with the 24-h contact point for detecting the rotational position of the obverse wheel train at a portion of the obverse wheel train, a number of wheel trains are arranged between the obverse wheel train and the date indicator and therefore, it has been difficult to accurately set the position of the date indicator owing to backlashes of the respective wheel trains.

(7) It has been difficult to promote an accuracy for detecting the position of the hour wheel along the rotational direction.

(8) There has been a concern of rotating the indication wheel or the date indicator when the electronic timepiece is exerted with external force by impact or the like. In order to hamper such a positional shift of the date indicator, index torque (stationary state maintaining force: a torque resisting against being rotated in a stationary state) needs to increase. However, when the index torque of the motor is increased, power necessary for driving the motor is also increased and battery life of the electronic timepiece is reduced.

SUMMARY OF THE INVENTION

Hence, in order to resolve such conventional problems, it is an object of the invention to provide an electronic timepiece having an apparatus of detecting a rotational position of a transmission wheel for accurately detecting a position of the transmission wheel along a rotational direction thereof.

Further, it is another object of the invention to provide a small-sized electronic timepiece having an apparatus of detecting a rotational position of a transmission wheel.

Further, it is another object of the invention to provide a small-sized thin-type electronic timepiece with calendar.

Further, it is another object of the invention to provide an electronic timepiece having an apparatus of detecting a rotational position of a transmission wheel having high durability function of a contact point.

Further, it is another object of the invention to provide an electronic timepiece having a date driving mechanism and an indication wheel detecting mechanism which are small-sized and simplified.

Further, it is another object of the invention to provide an electronic timepiece with no concern of rotating an indication wheel or a date indicator even when the electronic timepiece is exerted with external force such as impact.

According to the invention, there is provided an electronic timepiece characterized by comprising a transmission wheel rotated based on rotation of a wheel train included in an electronic timepiece and a contact point spring fixed to the transmission wheel and rotated integrally with the transmission wheel and having a conductivity, wherein the contact point spring is constituted to extend substantially linearly by passing through a rotational center of the transmission wheel, further comprising a first detection pattern and a second detection pattern constituted to be capable of being brought into contact with the contact point spring when the contact point spring is rotated, wherein the first detection pattern and the second detection pattern are arranged to constitute an angle of substantially 180 degree relative to the rotational center of the transmission wheel.

The electronic timepiece according to the invention is constituted such that when the transmission wheel is rotated and the contact point spring is brought into contact with the first detection pattern and brought into contact with the second detection pattern, a rotational position detecting signal is generated.

By this construction, the rotational position of the transmission wheel can be detected by using small-sized and simplified parts.

Further, according to the invention, there is provided an electronic timepiece characterized by comprising a transmission wheel rotated based on rotation of a wheel train and a contact point spring fixed to the transmission wheel and rotated integrally with the transmission wheel and having a conductivity, wherein the contact point spring is constituted to extend substantially linearly by passing through a rotational center of the transmission wheel, further comprising a first detection pattern and a second detection pattern constituted to be capable of being brought into contact with the contact point spring when the contact point spring is rotated.

The electronic timepiece is constituted such that the first detection pattern is arranged to constitute an angle of substantially 30 degree relative to the rotational center of the transmission wheel, the second detection pattern is arranged to constitute an angle of substantially 320 degree relative to the rotational center of the transmission wheel, and when the transmission wheel is rotated and the contact point spring is brought into contact with the first detection pattern and brought into contact with the second detection pattern, a rotational position detecting signal is generated.

Further, according to the invention, there is provided an electronic timepiece comprising a transmission wheel rotated based on ration of a wheel train included in the electronic timepiece and a contact point spring fixed to the transmission wheel and rotated integrally with the transmission wheel and having a conductivity. The contact point spring extends substantially linearly by passing through a rotational center of the transmission wheel. A first detection pattern and a second detection pattern are brought into contact with the contact point spring when the contact point spring is rotated. A first dummy pattern and a second dummy pattern are brought into contact with the contact point spring when the contact point spring is rotated. The first detection pattern and the second detection pattern are arranged to constitute an angle of substantially 180 degree relative to the rotational center of the transmission wheel.

The electronic timepiece according to the invention is constituted such that when the transmission wheel is rotated and the contact point spring is brought into contact with the first detection pattern and brought into contact with the second detection pattern, a rotational position detecting signal is generated and the rotational position detecting signal is not generated when the transmission wheel is rotated and the contact point spring is brought into contact with the first dummy pattern and is brought into contact with the second dummy pattern.

By the foregoing construction, the rotational position of the transmission wheel can accurately be detected.

Further, according to the invention, there is provided an electronic timepiece characterized by comprising a transmission wheel rotated based on rotation of a wheel train included in the electronic timepiece and a contact point spring fixed to the transmission wheel and rotated integrally with the transmission wheel and having a conductivity, wherein the contact point spring includes a first contact point spring terminal and a second contact point spring terminal and a third contact point spring terminal extended outwardly from a rotational center of the transmission wheel.

Preferably, the electronic timepiece is constituted such that the first contact point spring terminal and the second contact point spring terminal are provided to constitute an angle of substantially 75 degree, the first contact point spring terminal and the third contact point spring terminal are provided to constitute an angle of substantially 142.5 degree, the second contact point spring terminal and the third contact point spring terminal are provided to constitute an angle of substantially 142.5 degree.

The electronic timepiece according to the invention is provided with a first detection pattern and a second detection pattern and a VDD pattern constituted to be capable of being brought into contact with the contact point spring when the contact point spring is rotated.

Further, preferably, the first detection pattern is provided within an angle of substantially 30 degree relative to the rotational center of the transmission wheel and the second detection pattern is provided within an angle of substantially 30 degree relative to the rotational center of the transmission wheel.

Further, according to the electronic timepiece of the invention, the VDD pattern includes a first pattern portion and a second pattern portion. Preferably, the first pattern portion of the VDD pattern is provided within an open angle of substantially 60 degree relative to the rotational center of the transmission wheel. Further, preferably, the second pattern portion of the VDD pattern is provided within an open angle of substantially 240 degree relative to the rotational center of the transmission wheel.

Further, one end portion in a circumferential direction of the first pattern portion of the VDD pattern is contiguous to the first detection pattern with a clearance therebetween and other end portion in the circumferential direction thereof is contiguous to the second detection pattern with a clearance therebetween, one end portion in the circumferential direction of the second pattern portion of the VDD pattern is contiguous to the first detection pattern with a clearance therebetween and other end portion in the peripheral direction thereof is contiguous to the second detection pattern with a clearance therebetween.

Thereby, according to the electronic timepiece of the invention, the first detection pattern, the first pattern portion of the VDD pattern, the second detection pattern and the second pattern portion of the VDD pattern are provided in this order in the circumferential direction centering on the rotational center of the transmission wheel.

Further, the electronic timepiece according to the invention is constituted such that a rotational position detecting signal is generated by conducting the first detection pattern and the second detection pattern and the VDD pattern by the contact point spring by rotating the transmission wheel.

Further, according to the electronic timepiece of the invention, there is provided a control circuit for determining to discriminate regular rotation or reverse rotation of the transmission wheel by whether the first detection pattern and the VDD pattern are conducted before conducting the first detection pattern and the second detection pattern and the VDD pattern or whether the second detection pattern and the VDD pattern are conducted before conducting the first detection pattern and the second detection pattern and the VDD pattern.

By the foregoing construction, the rotational direction of the transmission wheel can accurately be determined.

Further, according to the invention, the electronic timepiece is constituted to include the transmission wheel for transmitting rotation to an indication wheel and the contact point spring constituted to rotate integrally with the transmission wheel.

According to a preferable embodiment of the invention, the indication wheel is a date indicator and the transmission wheel is a date driving wheel arranged to rotate the date indicator.

According to the electronic timepiece, the contact point spring includes a first contact point portion extended in a first direction and a second contact point portion extended in a second direction.

Further, the electronic timepiece is provided with a contact point pattern constituted to include a reference potential pattern and a contact switch pattern.

The electronic timepiece is characterized by being constituted such that by rotating the transmission wheel, a rotational signal is not outputted in a state in which both of the first contact point portion and the second contact point portion are brought into contact with the reference potential pattern, the rotational signal is outputted in a state in which the first contact point portion is brought into contact with the reference potential pattern and the second contact point portion is brought into contact with the contact point switch pattern and the rotational signal is outputted in a state in which the first contact point portion is brought into contact with the contact point switch pattern and the second contact point portion is brought into contact with the reference potential pattern and the rotational signal is not outputted in a state in which neither of the first contact point portion and the second contact point portion is not brought into contact with the contact point switch pattern.

By the foregoing construction, the rotational position of the transmission wheel included in a calendar wheel train such as a date driving wheel can accurately be determined.

DETAILED DESCRIPTION OF THE PREFERRED EMBODIMENTS

An explanation will be given of embodiments of the invention with reference to the drawings as follows.

(1) First embodiment

Figure 1:
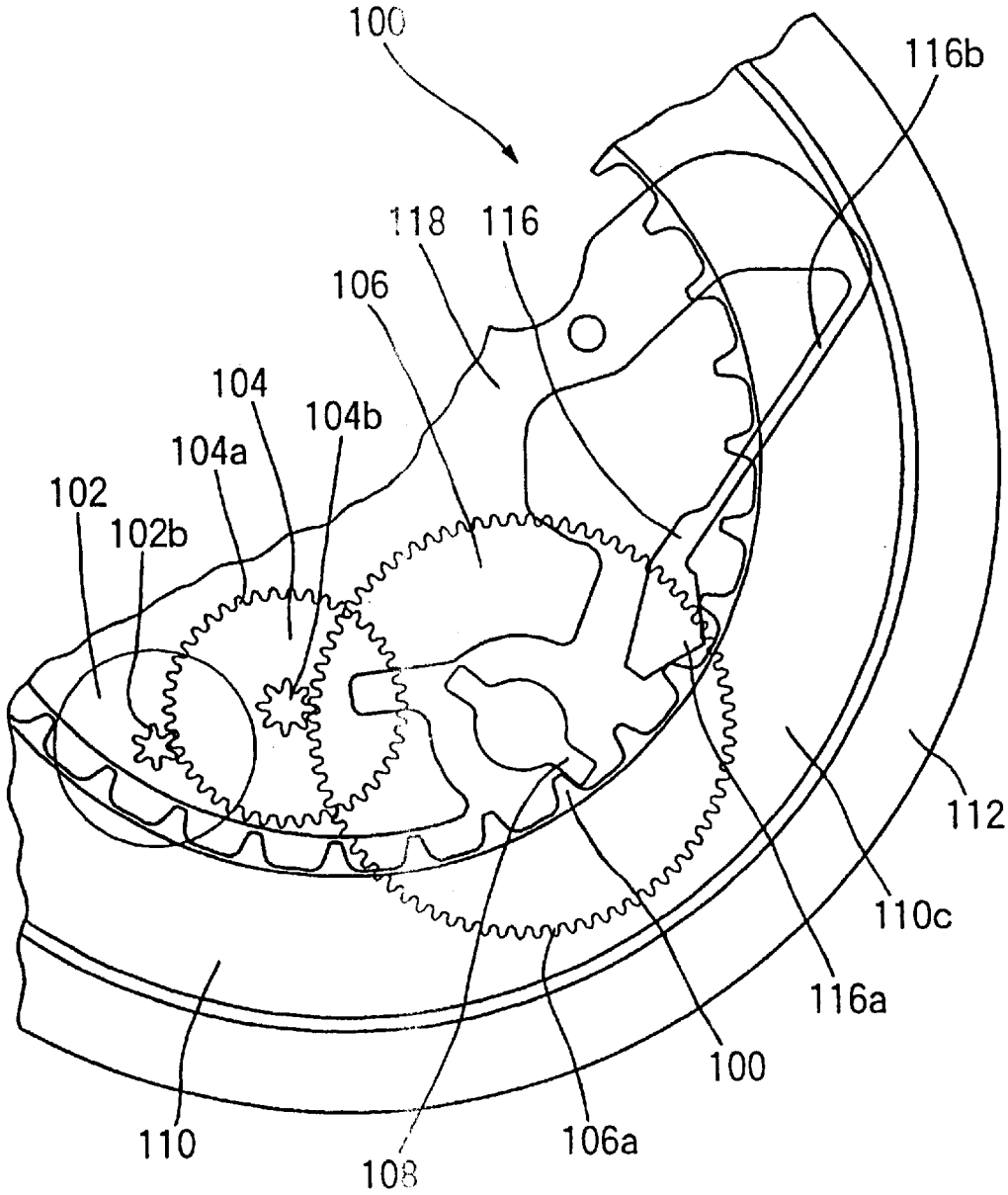
FIG. 1 is an outline plane view (perspective view) showing a calendar mechanism portion of an electronic timepiece according to a first embodiment of the invention.
Figure 2:
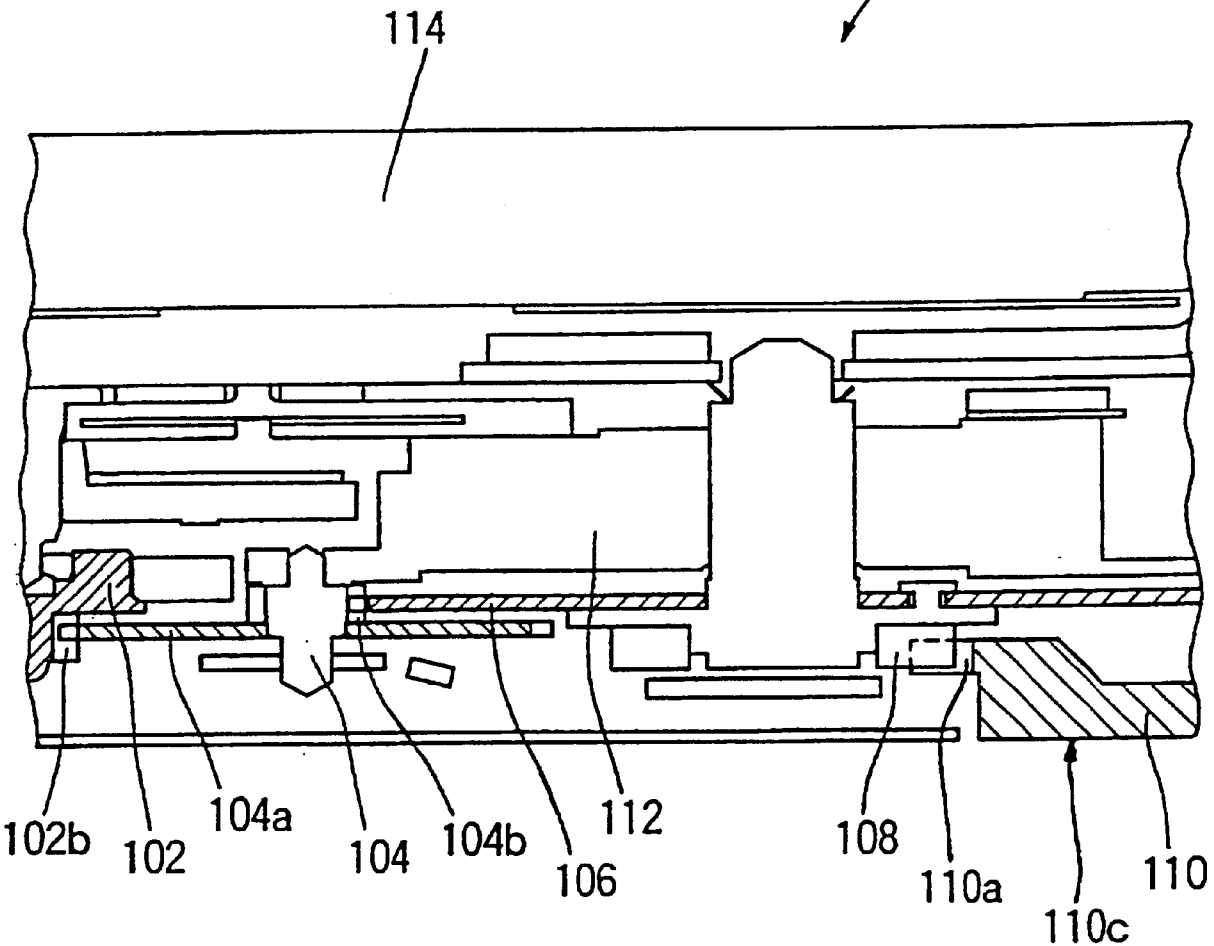
FIG. 2 is an outline sectional view showing the calendar mechanism portion of the electronic timepiece according to the first embodiment of the invention.

In FIG. 1 and FIG. 2, according to the first embodiment of the invention, an ultrasonic motor of an electronic timepiece with calendar 100 includes an ultrasonic rotor 102. An ultrasonic rotor pinion 102*b* is in mesh with an intermediate date driving gear wheel 104*a* of an intermediate date driving wheel. An intermediate date driving pinion 104*b* of the intermediate date driving wheel 104 is in mesh with a date driving gear wheel 106*a* of a date driving wheel 106.

A date finger 108 is provided on the date driving wheel 106 and is rotated simultaneously with rotation of the date driving wheel 106. As shown by FIG. 1, two of the date fingers 108 may be provided, or one or three or more of the date fingers 108 may be provided.

A date indicator 110 having 31 of date teeth 110*a* is rotatably integrated to a main plate 112. Numerals (not illustrated) from "1" to "31" are provided on an indication surface 110*c* of the date indicator 110. A battery 114 is integrated to a side opposed to a side of the main plate 112 attached with the date indicator 110.

A date jumper 116 is formed integrally with a date indicator holder 118. A regulating portion 116*a* of the date jumper 116 regulates the date teeth 110*a*. The date jumper 116 is provided with a date jumper spring 116*b*.

Figure 3:
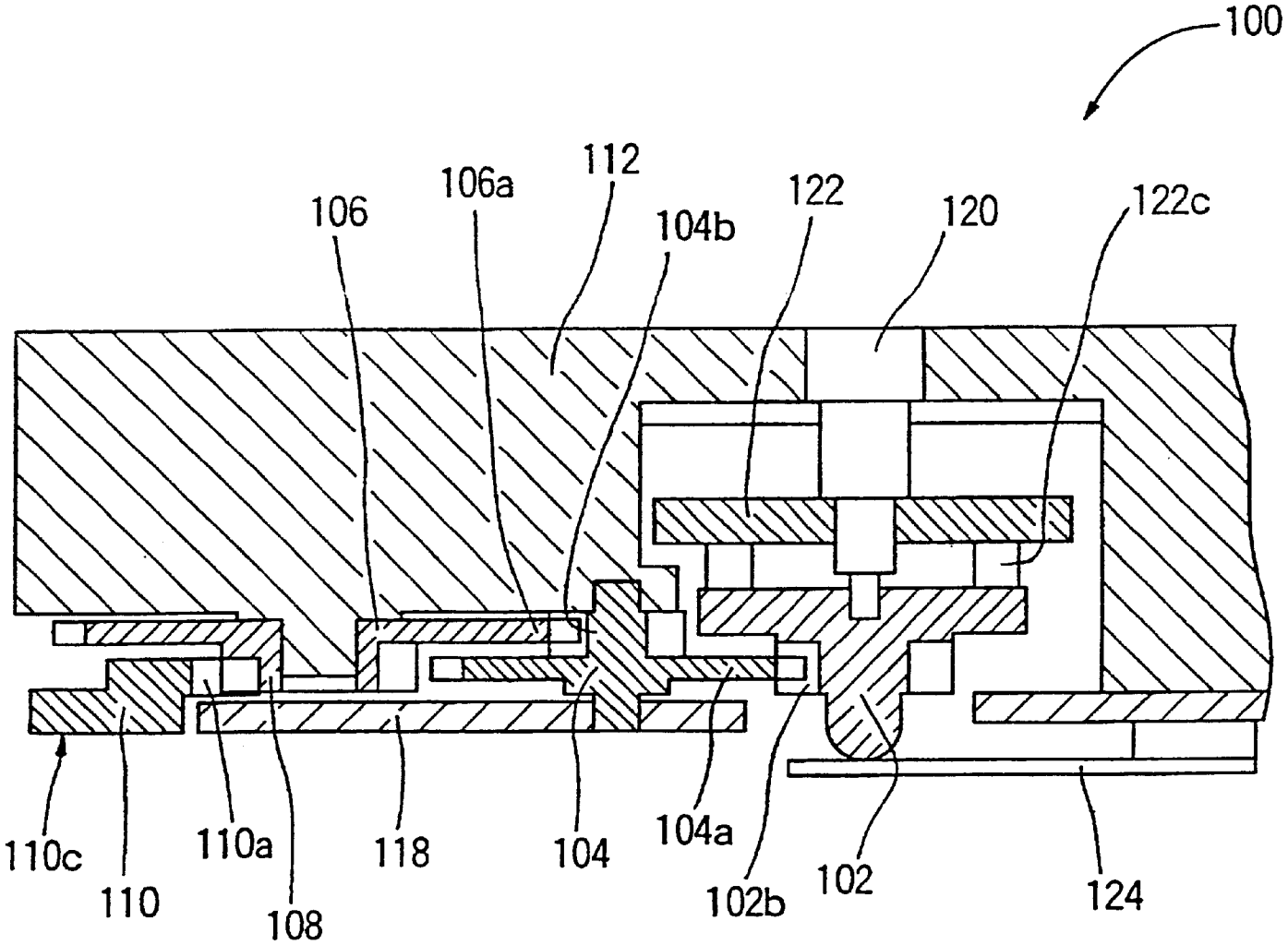
FIG. 3 is an outline sectional view showing a calendar mechanism portion having other structure of the electronic timepiece according to the first embodiment of the invention.

In another structure shown by FIG. 3, an ultrasonic rotor axle 120 is fixed to the main plate 112. An ultrasonic stator 122 is fixed to the ultrasonic rotor axle 120. A piezoelectric element (not illustrated) is fixedly attached to the ultrasonic stator 122. An ultrasonic rotor 102 is rotatably integrated to the ultrasonic rotor axle 120 and is brought into contact with displacement enlarging comb teeth 122*c* of the ultrasonic stator 122. An ultrasonic pressurizing spring 124 presses the ultrasonic rotor 102 to thereby exert elastic force to the displacement enlarging combe teeth 122*c*.

The intermediate date driving wheel 104 is rotatably integrated between the main plate 112 and the date indicator holder 118. The ultrasonic rotor pinion 102*b* of the ultrasonic rotor 102 is in mesh with the intermediate date driving gear wheel 104*a* of the intermediate date driving wheel 104. The date driving wheel 106 is rotatably integrated to the main plate 112. The intermediate date driving pinion 104*b* of the intermediate date driving wheel 104 is in mesh with the date driving gear wheel 106*a* of the date driving wheel 106.

The date finger 108 is provided on the date driving wheel 106 and is rotated simultaneously with rotation of the date driving wheel 106. The date indicator 110 having 31 of the date indicator teeth 110*a* is rotatably integrated to the main plate 112. Numerals (not illustrated) from "1" to "31" are provided on the indication surface 110*c* of the date indicator 110.

Next, an explanation will be given of the operation of the electronic timepiece with calendar 100 according to the invention.

Figure 4:
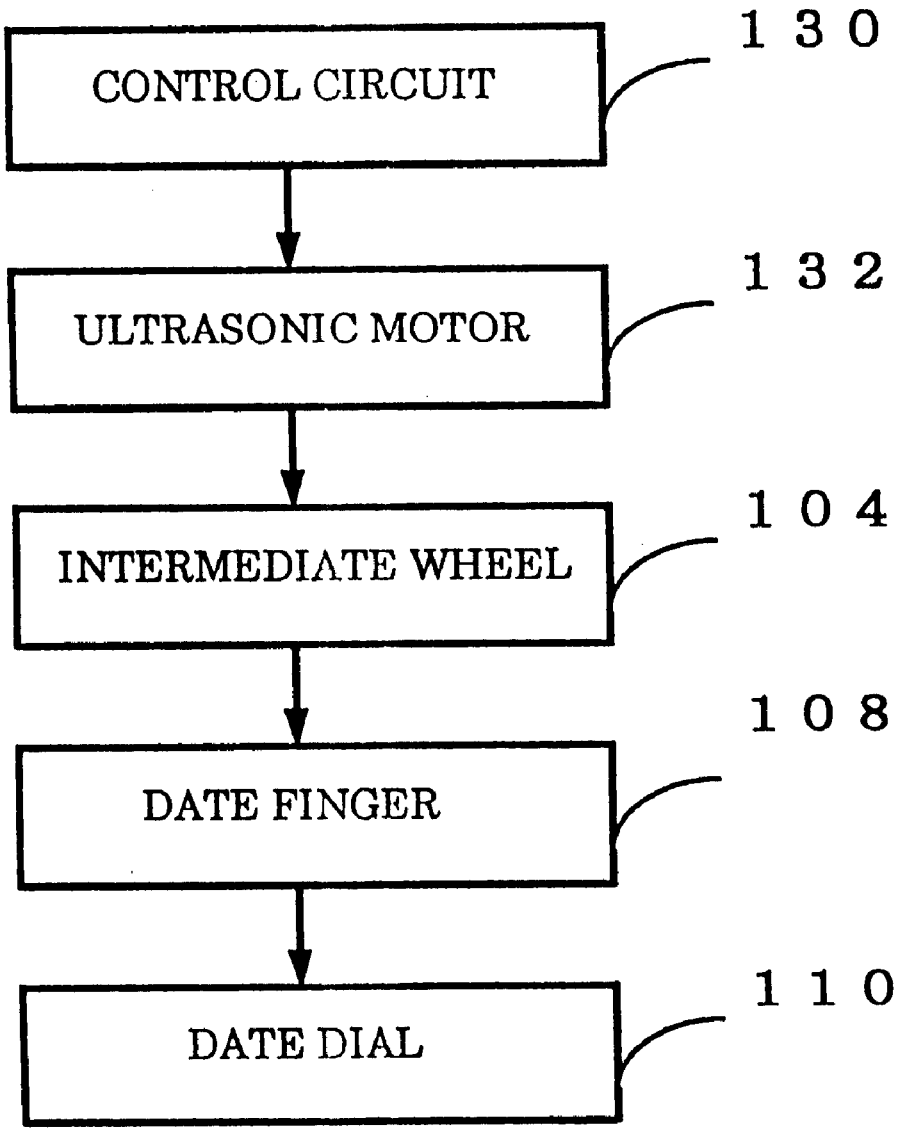
FIG. 4 is an outline block diagram showing the calendar mechanism portion of the electronic timepiece according to the first embodiment of the invention.

In reference to FIG. 4, a control circuit 130 is provided with a time signal generating circuit for generating a date signal by counting data with regard to time and date and further provided with an ultrasonic motor driving circuit for outputting an ultrasonic driving signal for rotating the ultrasonic motor based on the date signal outputted from the time signal generating circuit.

Figure 35:
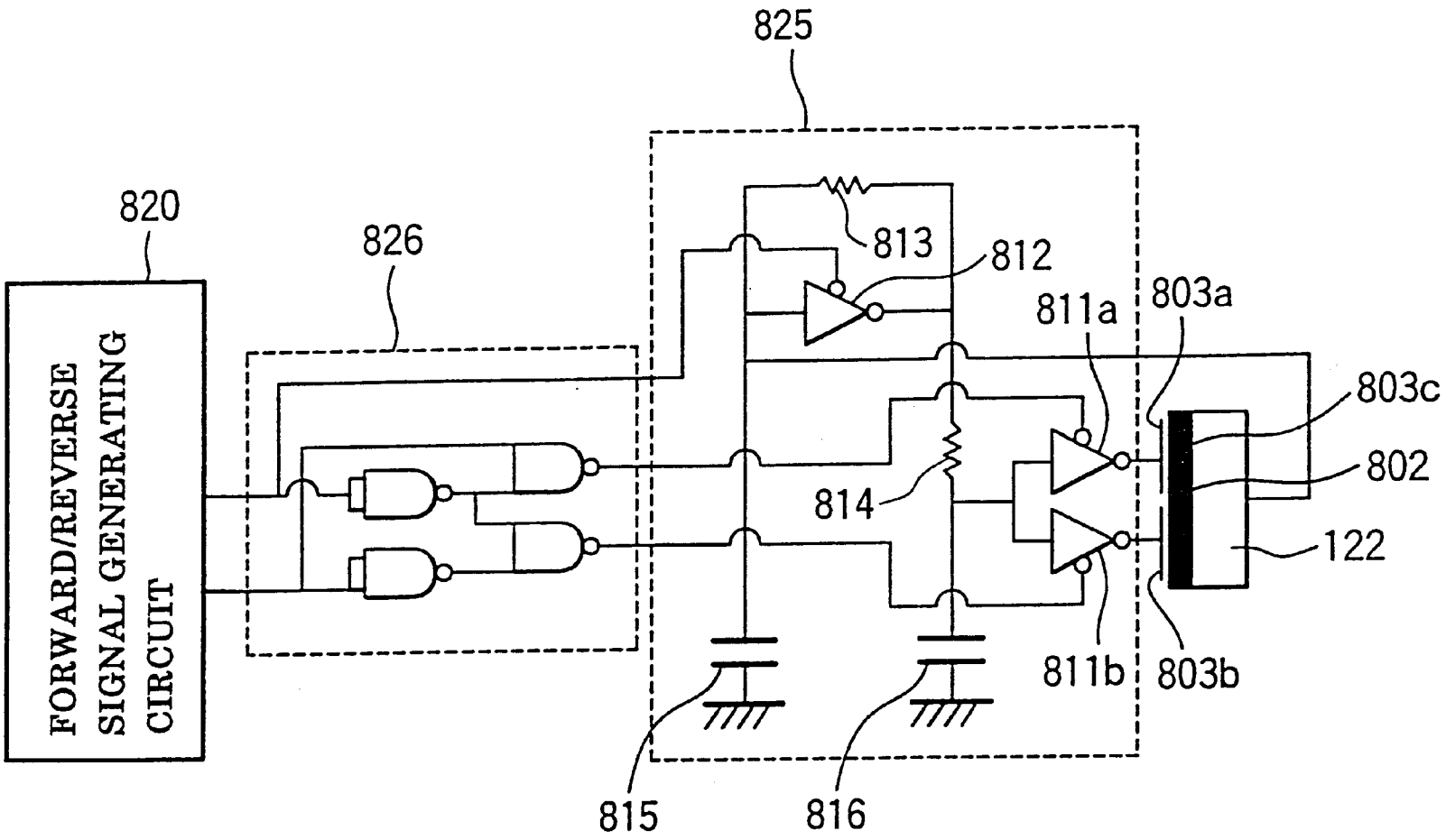
FIG. 35 is a block diagram showing a constitution of a driving circuit of an ultrasonic motor of the electronic timepiece according to the fifth embodiment of the invention.

In reference to FIG. 35, a piezoelectric element 802 formed with two sets of electrode groups 803*a* and 803*b* each comprising a plurality of electrodes, is bonded to one face of the ultrasonic stator 122 constituting a vibrating member of the ultrasonic motor. An oscillation driving circuit 825 is connected to the electrode groups 803*a* and 803*b* of the piezoelectric element 802. An inverter 812 serves as an inverting power amplifier for inversely amplifying an electric signal which is excitation data from one face of the piezoelectric element 802 formed with the electrode groups 803*a* and 803*b* and an electrode 803*c* or the ultrasonic stator 122 formed on the other face. A resistor 813 is connected in parallel with the inverter 812 for stabilizing an operating point of the inverter 812.

An output terminal of the inverter 812 is connected to input terminals of two sets of buffers 811*a* and 811*b* via a resistor 814. Respective output terminals of the two buffers 811*a* and 811*b* are connected to the electrode groups 803*a* and 803*b* of the piezoelectric element 802, respectively. One end of a capacitor 815 is connected to an input terminal of the inverter 812 and one end of a capacitor 816 is connected to the output terminal of the inverter 812 via the resistor 814. Respective other ends of the capacitors 815 and 816 are grounded for adjusting a phase in the oscillation driving circuit 825.

The inverter 812 and the buffers 811*a* and 811*b* each is provided with a control terminal as well as the input terminal and the output terminal and accordingly, is an inverter or a buffer having a tri-state structure capable of bringing the output terminal into a high impedance state in accordance with a signal inputted to the control terminal.

Regular/reverse signal generating means 820 outputs a regular/reverse signal for setting the rotational direction of the ultrasonic motor to a switching circuit 826. Output terminals of the switching circuit 826 are respectively connected to the control terminals of the tri-state buffers 811*a* and 811*b* and the tri-state inverter 812 of the oscillation driving circuit 825 and makes one of the tri-state buffers 811*a* and 811*b* function as an ordinary buffer and disables the output terminal of other buffer by bringing the output terminal in a high impedance state based on output signals outputted from the regular/reverse signal generating means 820.

The ultrasonic stator 122 is driven by the tri-state buffer which is selected by the output signal from the switching circuit 826 and functions as an ordinary buffer. The ultrasonic stator 122 is driven only by the tri-state buffer permitted to function as an ordinary buffer by the switching circuit 826 and when the tri-state buffer permitted to function as an ordinary buffer by the switching circuit 826 is exchanged by the other one, the rotational direction of the ultrasonic motor is reversed.

The output terminal of the tri-state inverter can be brought into the high impedance state by the output signal from the switching circuit 826 which is outputted based on the output from the regular/reverse signal generating means 820 and when the tri-state inverter is brought into a disabled state, both of the tri-state buffers 811*a* and 811*b* are brought into the disabled state by which the ultrasonic motor can be stopped.

Figure 36:
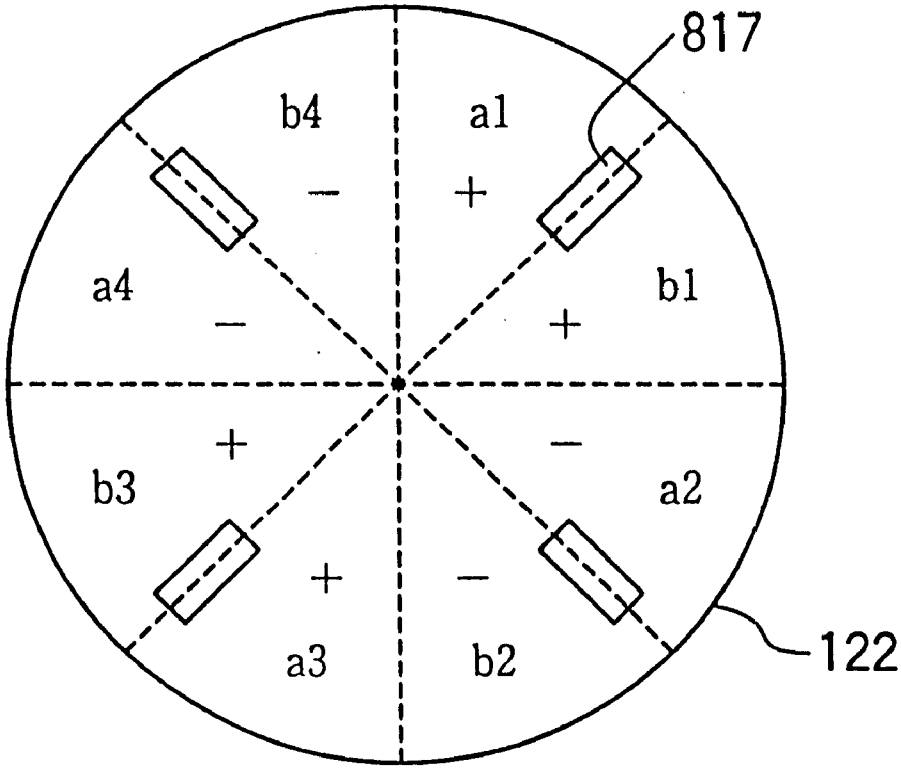
FIG. 36 is a plane view of an ultrasonic stator of the ultrasonic motor of the electronic timepiece according to the fifth embodiment of the invention.
Figure 37:
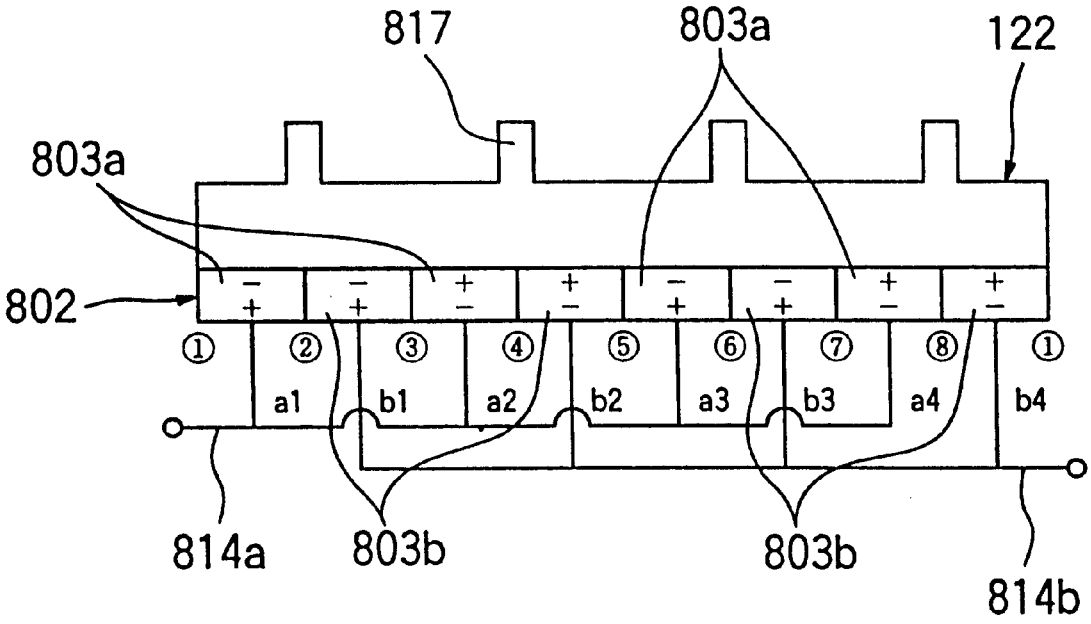
FIG. 37 is a sectional view of the ultrasonic stator of the ultrasonic motor of the electronic timepiece according to the fifth embodiment of the invention.
Figure 38:
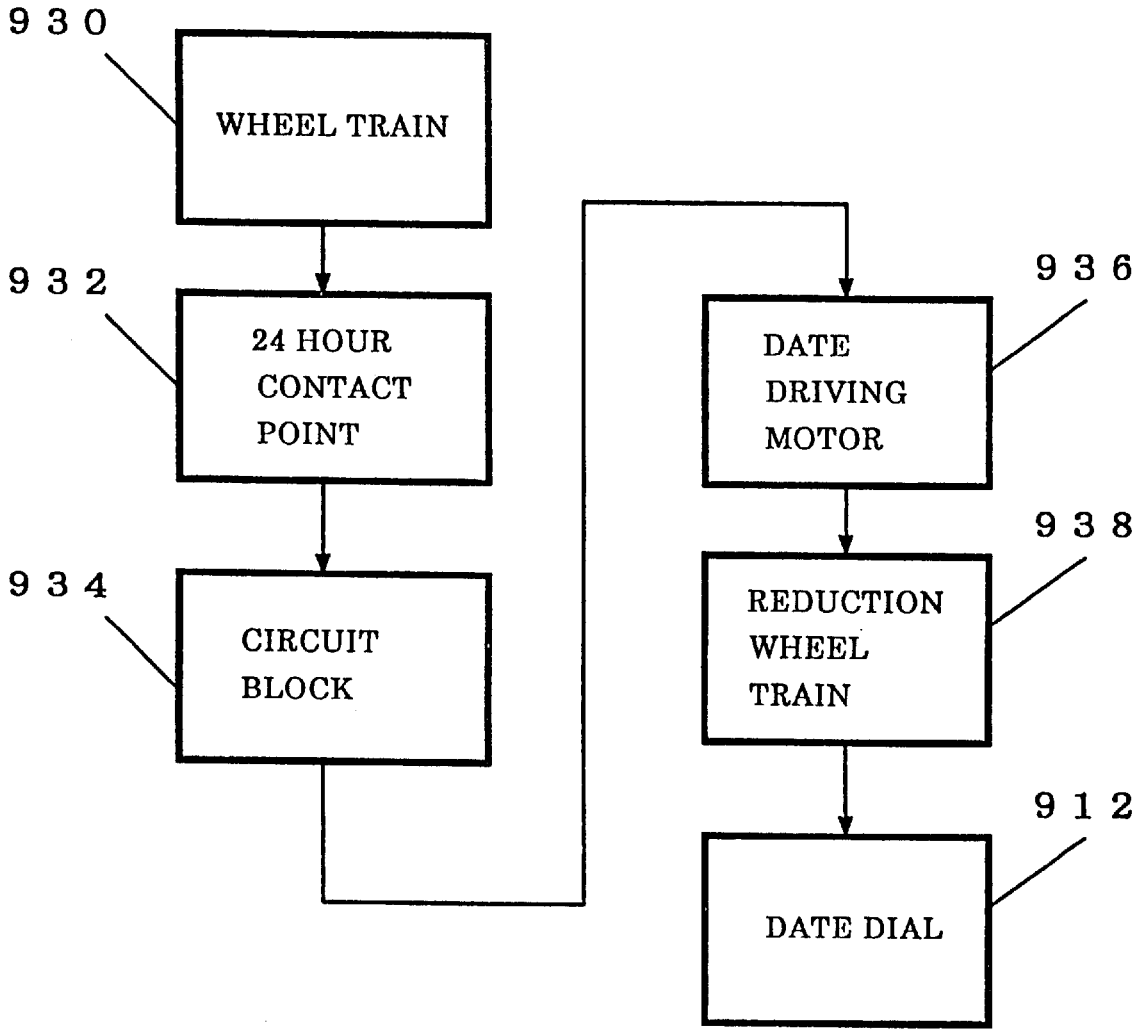
FIG. 38 is an outline block diagram showing a constitution of a conventional electronic timepiece.

In reference to FIG. 36 and FIG. 37, the piezoelectric element 802 in a shape of circular plate is bonded to a plane of the ultrasonic stator 122 in a shape of a circular plate by adhesion, a thin film forming process or the like. Ultrasonic wave excites two wavelengths of standing waves in the circumferential direction of the ultrasonic stator 122 to thereby drive to rotate the ultrasonic rotor. As shown by FIG. 36 and FIG. 37, the one plane of the piezoelectric element 802 is formed with a first electrode group 803*a* and a second electrode group 803*b* by alternately arranging eight-segmented electrodes whose number is four times as large as a number of the ultrasonic wave in the circumferential direction and the electrodes are subjected to a polarization treatment of (+) and (−) which are reverted by every other electrode.

The first electrode group 803*a* is constituted by electrodes a1, a2, a3 and a4 and the respective electrodes are shortcircuited by first connecting means 814*a*. The electrode group 803*b* is constituted by electrodes b1, b2, b3 and b4 and the respective electrodes are shortcircuited by second connecting means 814*b*.

Symbols (+) and (−) in the drawings designate directions of the polarization treatment and the polarization treatment is carried out by respectively applying positive electric fields and negative electric fields to a face of the piezoelectric element 802 bonded with the ultrasonic stator 122.

Projections (comb teeth) 817 for enlarging displacement of the ultrasonic stator and transmitting drive force from the ultrasonic stator to the ultrasonic rotor are provided on the surface of the ultrasonic stator 122, at the vicinities of boundaries among the respective electrodes by every other electrode.

A high frequency voltage generated by the oscillation driving circuit 825 is applied to either one of the electrode groups 803*a* and 803*b* to thereby drive the ultrasonic stator 122. The rotational direction of the ultrasonic motor is switched in accordance with by which electrode group the ultrasonic stator 122 is driven.

Although the ultrasonic motor used in the electronic timepiece with calendar according to the invention is preferably driven by the above-described constitution of the drive circuit, the piezoelectric element and the ultrasonic stator, the ultrasonic motor can also be driven by other constitution.

The control circuit 130 outputs an ultrasonic motor drive signal to an ultrasonic motor (USM) 132 when its counted result outputs twelve o'clock at night. That is, the control circuit 130 is constituted to output the ultrasonic motor drive signal for rotating the date indicator 110 once per day, by 360°/31, that is, by a 1/31 rotation.

The control circuit 130 counts "year", "month", "day" and time. Further, when the control circuit 130 outputs twelve o'clock at night of an ordinary day, the ultrasonic motor drive signal in correspondence with the ordinary day is outputted to the ultrasonic motor (USM) 132. That is, the control circuit 130 is constituted to output the ultrasonic motor drive signal for rotating the date indicator 110 once per day, by 360°/31, that is, by a 1/31 rotation.

Further, when the control circuit 130 outputs as a counted result the first day of March of a year which is not a leap year, for example, outputs twelve o'clock at night of the first day of March of, 1997, the control circuit 130 outputs an ultrasonic motor drive signal in correspondence with the first day of March to the ultrasonic motor (USM) 132. That is, the control circuit 130 is constituted to output the ultrasonic motor drive signal for rotating the date indicator 110 by (360°/31) ¥ 4, that is, a 4/31 rotation. Accordingly, data in respect of "day" indicated by the date indicator 110 is changed from indication of "28" in correspondence with February 28 to indication of "1" in correspondence with March 1 without displaying "29", "30" and "31".

Further, when the control circuit 130 outputs twelve o'clock at night of the first day of March of a leap year, for example, the first day of March, 2000 as its counted result, the control circuit 130 outputs an ultrasonic motor drive signal in correspondence with the first day of March of the leap year to the ultrasonic motor (USM) 132. That is, the control circuit 130 is constituted to output the ultrasonic motor drive signal for rotating the date indicator 110 by (360°/31) ¥ 3, that is, by a 3/31 rotation. Therefore, data in respect of "day" indicated by the date indicator 110 is changed into indication of "1" in correspondence with the first day of March without indicating "30" and "31".

Similarly, when the control circuit 130 outputs as its counted result twelve o'clock at night of a day successive to a last day of "month of 30 or less days", that is, "30-th day", for example, the first day of May, the control circuit 130 outputs an ultrasonic motor drive signal in correspondence with the first day of May to the ultrasonic motor (USM) 132. That is, the control circuit 130 is constituted to output the ultrasonic motor drive signal for rotating the date indicator 110 by (360°/31) ¥ 2, that is, by a 2/31 rotation. Therefore, data in respect of "day" indicated by the date indicator 110 is changed from indication of "30" in correspondence with April 30 to indication of "1" in correspondence with May 1 without indicating "31".

Such a constitution is applicable similarly to other embodiments of the invention.

By this construction, the electronic timepiece with calendar according to the invention constitutes a so-to-speak "Auto-Calendar Timepiece" or "Perpetual Calendar Timepiece".

The ultrasonic motor (USM) 132 is provided with the ultrasonic stator bonded with the piezoelectric element and provided with the ultrasonic rotor frictionally driven by oscillatory waves generated at the ultrasonic stator by elongation and contraction of the piezoelectric element by inputting the ultrasonic motor drive signal.

There are formed at least two sets of electrode groups each comprising a plurality of electrodes on the surface of the piezoelectric element. The control circuit 130 includes at least two of power amplifiers and output terminals of the power amplifiers are respectively connected to the two sets of electrode groups of the piezoelectric element to thereby drive to excite the respective electrodes independently from each other.

The ultrasonic rotor of the ultrasonic motor (USM) 132 is rotated when the ultrasonic motor drive signal is inputted to the electrode groups of the piezoelectric element. By rotating the ultrasonic rotor, the intermediate wheel, that is, the intermediate date driving wheel 104 is rotated. By rotating the intermediate date driving wheel 104, the date finger 108 is rotated and the date wheel 110 is rotated by the date finger 108.

Further, the electronic timepiece with calendar according to the invention can be provided with a calendar indicating wheel for indicating other data in respect of a calendar, that is, "year", "month", "day of the week", "six weekdays" or the like.

For example, in a constitution having a day indicator for indicating "days of the week", a day indicator "not illustrated" having 28 of day of the week teeth (not illustrated) is rotatably integrated to the main plate 112.

There are provided on an indication surface of the day indicator, 14 kinds of characters of "Monday in Japanese", "MON", "Tuesday in Japanese", "TUE", "Wednesday in Japanese", "WED", "Thursday in Japanese", "THU", "Friday in Japanese", "FRI", "Saturday in Japanese", "SAT", "Sunday in Japanese" and "SUN".

The control circuit 130 is provided with a time signal generating circuit for generating a day of the week signal by counting data in respect of time and day of the week and is further provided with an ultrasonic motor driving circuit for outputting an ultrasonic motor drive signal for rotating the ultrasonic motor based on the day of the week signal outputted from the time signal generating circuit.

When the control circuit 130 outputs twelve o'clock at night as its counted result, the control circuit 130 outputs the ultrasonic motor drive signal to the ultrasonic motor (USM) 132. That is, the control circuit 130 is constituted to output the ultrasonic motor drive signal for rotating the day indicator once per day, by 360°/14, that is, by 1/14 rotation.

Accordingly, by initially setting day of the week in Japanese or day of the week in English, day of the week can be indicated in Japanese or in English as necessary by the day indicator.

Further, for example, in a constitution having a month indicator for indicating "month", a month indicator (not illustrated) having 36 of month indicator teeth (not illustrated) is rotatably integrated to the main plate 112. 3 sets of 12 kinds of numerals of from "1" to "12" are sequentially provided on an indication surface of the month indicator. That is, a total of 36 of numerals of 1 through 12, 1 through 12 and 1 through 12 are provided on the indicating face of the month indicator.

The control circuit 130 is provided with a time signal generating circuit for generating a month signal by counting data in respect of time and month and is further provided with an ultrasonic motor driving circuit for outputting an ultrasonic motor drive signal for rotating the ultrasonic motor based on the month signal outputted from the time signal generating circuit.

When the control circuit 130 outputs the first day of respective month as its counted result, the control circuit 130 outputs the ultrasonic motor drive signal to the ultrasonic motor (USM) 132. That is, the control circuit 130 is constituted to output the ultrasonic motor drive signal for rotating the month indicator by 360°/36, that is, by a 1/36 rotation on the first day of respective month.

Therefore, month can be indicated by the month indicator.

Indication of "year", "six days of the week" or the like is made feasible by a similar constitution.

(2) Second embodiment

Figure 5:
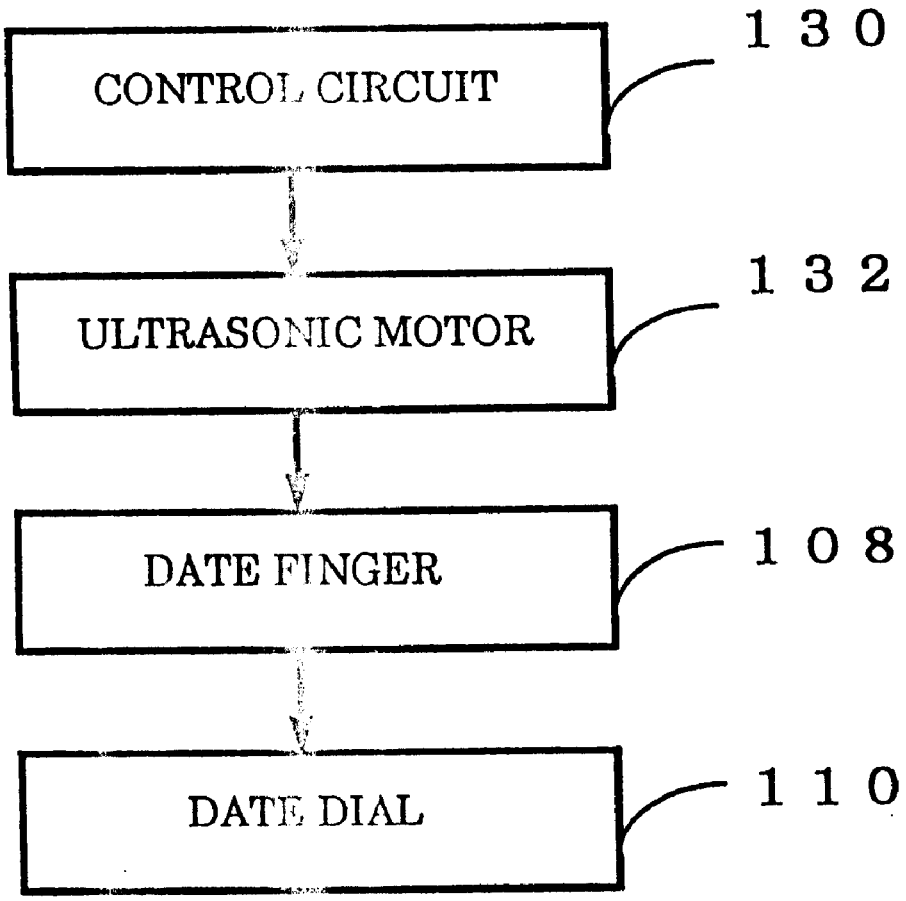
FIG. 5 is an outline block diagram showing a calendar mechanism portion of an electronic timepiece according to a second embodiment of the invention.
Figure 6:
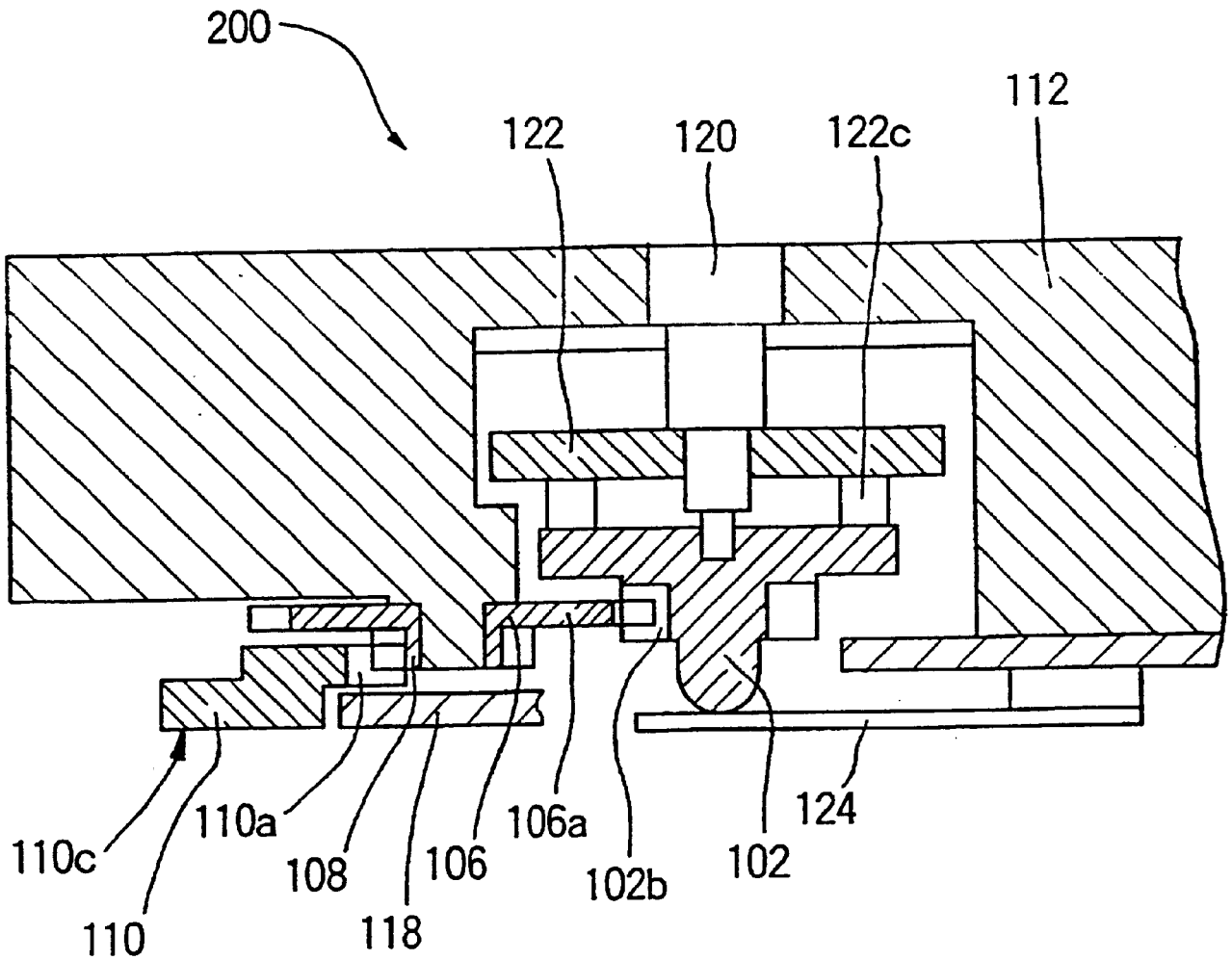
FIG. 6 is an outline sectional view showing the calendar mechanism portion of the electronic timepiece according to the second embodiment of the invention.

In reference to FIG. 5 and FIG. 6, according to a second embodiment of the invention, a structure of an ultrasonic motor of an electronic timepiece with calendar 200 is similar to the structure of the ultrasonic motor of the electronic timepiece with calendar 100 according to the first embodiment of the invention shown by FIG. 3.

The date driving wheel 106 is rotatably integrated to the main plate 112. The ultrasonic rotor pinion 102*b* of the ultrasonic rotor 102 is in mesh with the date driving gear wheel 106*a* of the date driving wheel 106.

The date finger 108 is provided on the date driving wheel 106 and is rotated simultaneously with rotation of the date driving wheel 106. The date indicator 110 having 31 of the date indicator teeth 110*a* is rotatably integrated to the main plate 112. Numerals (not illustrated) of "1" to "31" are provided on the indication surface 110*c* of the date indicator 110.

The timepiece with calendar 200 is provided with a date jumper (not illustrated). A regulating portion of the date jumper regulates the date indicator teeth 110*a*.

Next, an explanation will be given of operation of the electronic timepiece with calendar 200 according to the invention.

In reference to FIG. 5, the control circuit 130 is provided with a time signal generating circuit for generating a date signal by counting data in respect of time and date and is further provided with an ultrasonic motor driving circuit for outputting an ultrasonic motor drive signal for rotating the ultrasonic motor (USM) 132 based on the date signal outputted from the time signal generating circuit.

When the control circuit 130 outputs twelve o'clock at night as its counted results, the control circuit 130 outputs the ultrasonic motor drive signal to the ultrasonic motor (USM) 132. That is, the control circuit 130 is constituted to output the ultrasonic motor drive signal for rotating the date indicator 110 once per day, by 360°/31, that is, by a 1/31 rotation.

The ultrasonic rotor of the ultrasonic motor (USM) 132 is rotated when the ultrasonic motor drive signal is inputted to the electrode groups of the piezoelectric element. By rotating the ultrasonic rotor, the date finger 108 is rotated and the date indicator 110 is rotated by the date finger 108.

(3) Third embodiment

Figure 7:
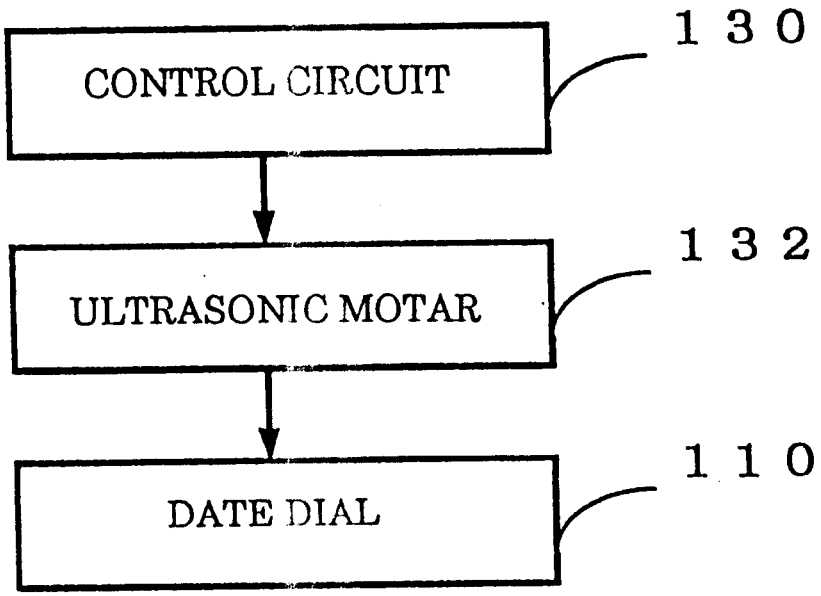
FIG. 7 is an outline block diagram showing a calendar mechanism portion of the electronic timepiece according to a third embodiment of the invention.
Figure 8:
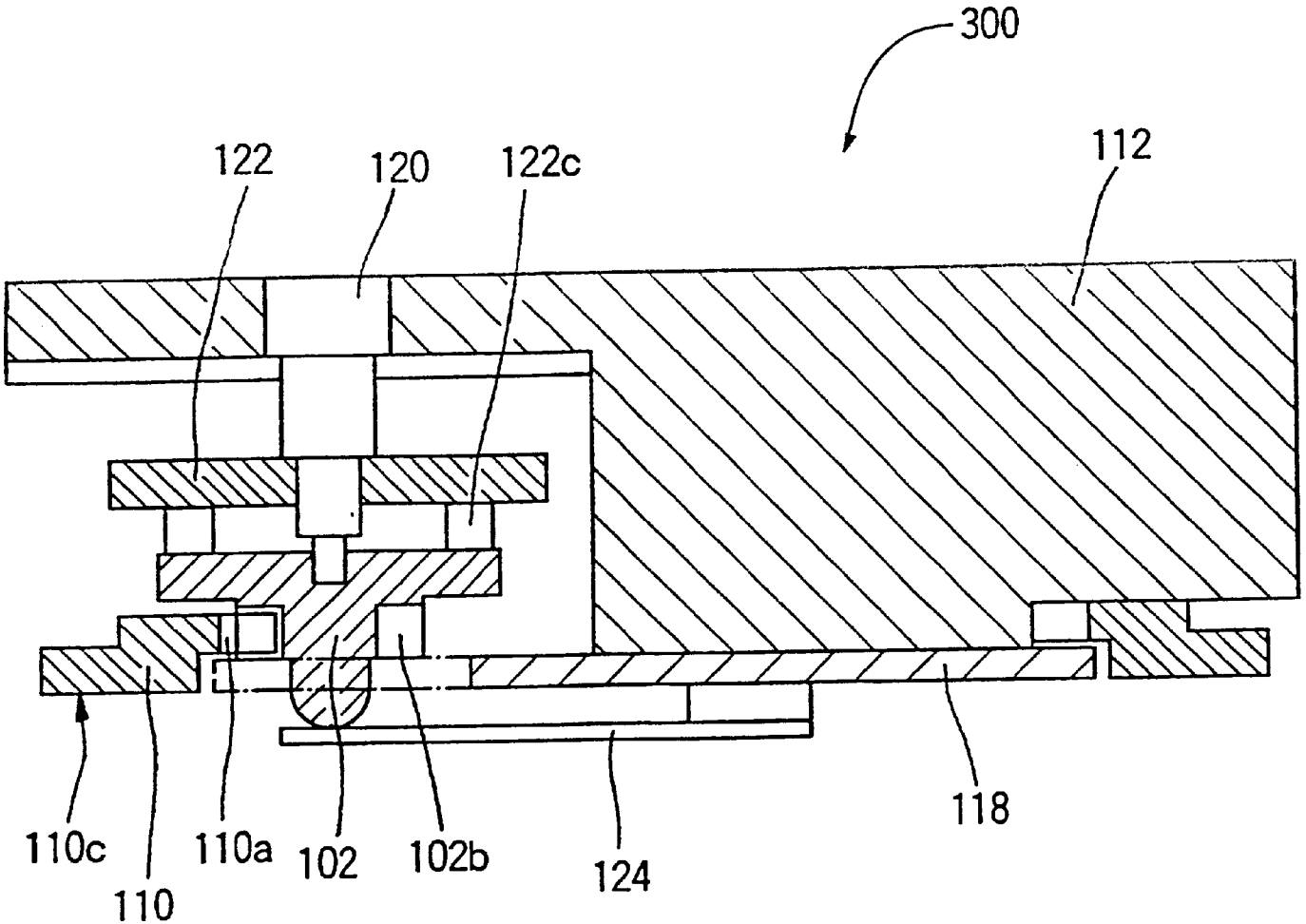
FIG. 8 is an outline sectional view showing the calendar mechanism portion of the electronic timepiece according to the third embodiment of the invention.

In reference to FIG. 7 and FIG. 8, according to a third embodiment of the invention, a structure of an ultrasonic motor of an electronic timepiece with calendar 300 is similar to the structure of the ultrasonic motor (USM) 132 of the electronic timepiece with calendar 100 according to the first embodiment of the invention shown by FIG. 3.

The date indicator 110 is rotatably integrated to the main plate 112. The ultrasonic rotor pinion 102*b* of the ultrasonic rotor 102 is in mesh with the date indicator teeth 110*a*. Numerals (not illustrates) of from "1" to "31" are provided on the indication surface 110*c* of the date indicator 110.

The electronic timepiece with calendar 300 is provided with a date jumper (not illustrated). A regulating portion of the date jumper regulates the date indicator teeth 110*a*.

Next, an explanation will be given of the operation of the electronic timepiece with calendar 300 according to the invention.

In reference to FIG. 7, the control circuit 130 is provided with a time signal generating circuit for generating a date signal by counting data in respect of time and date and is further provided with an ultrasonic motor driving circuit for outputting an ultrasonic motor drive signal for rotating the ultrasonic motor (USM) 132 based on the date signal outputted from the date signal generating circuit.

When the control circuit 130 outputs twelve o'clock at night as its counted result, the control circuit 130 outputs the ultrasonic motor drive signal to the ultrasonic motor (USM) 132. That is, the control circuit 130 is constituted to output the ultrasonic motor drive signal for rotating the date indicator 110 once per day, by 360°/31, that is, by a 1/31 rotation.

The ultrasonic rotor of the ultrasonic motor (USM) 132 is rotated when the ultrasonic motor drive signal is inputted to the electrode groups of the piezoelectric element. By rotating the ultrasonic rotor, the date indicator 110 is rotated.

(4) Fourth embodiment

Figure 9:
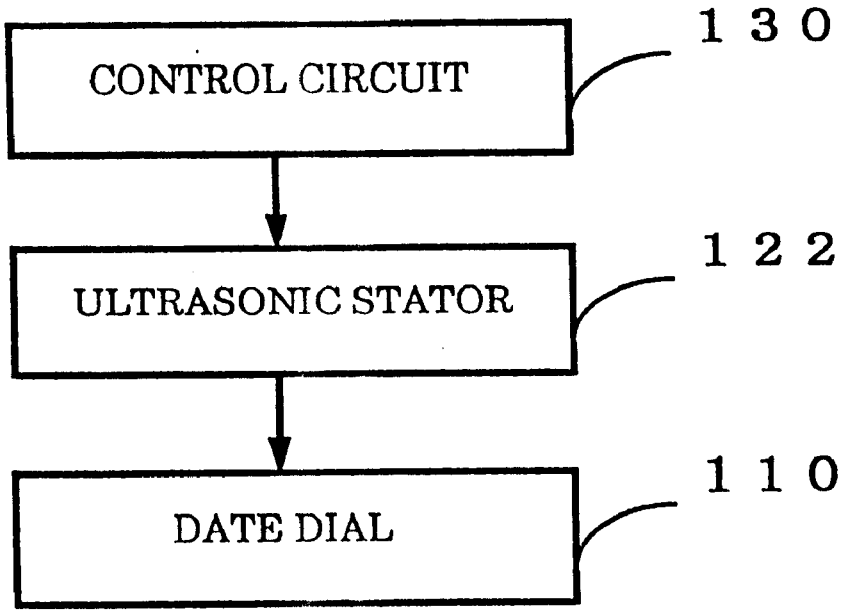
FIG. 9 is an outline block diagram showing a calendar mechanism portion of the electronic timepiece according to a fourth embodiment of the invention.
Figure 10:
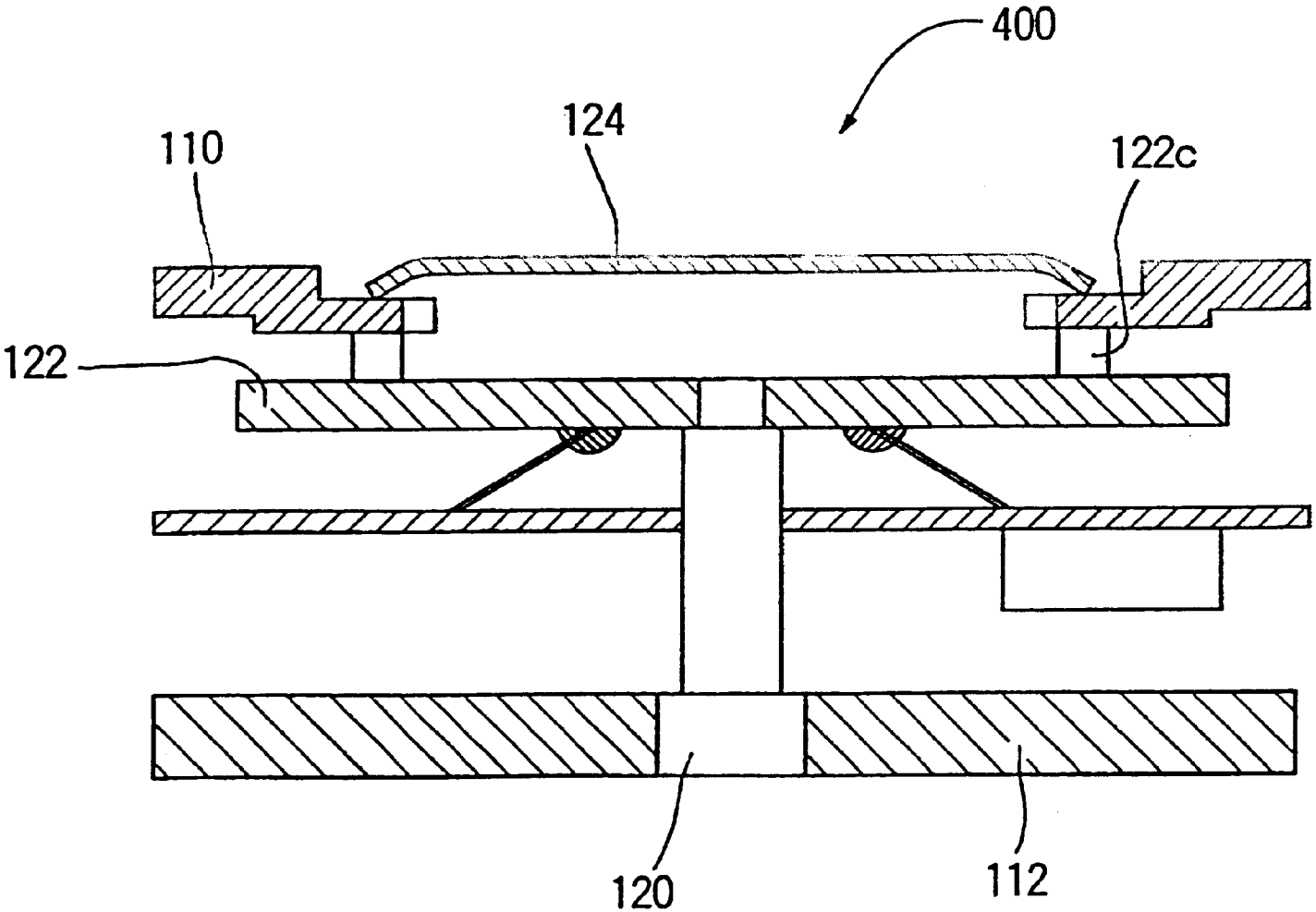
FIG. 10 is an outline sectional view showing the calendar mechanism portion of the electronic timepiece according to the fourth embodiment of the invention.

In reference to. FIG. 9 and FIG. 10, according to a fourth embodiment of the invention, the ultrasonic rotor axle 120 of an electronic timepiece with calendar 400 is fixed to the main plate 112. The ultrasonic stator (USM stator) 122 is fixed to the ultrasonic rotor axle 120. A piezoelectric element (not illustrated) is fixed to the ultrasonic stator 122. The date indicator 110 is brought in to contact with the displacement enlarging comb teeth 122*c* of the ultrasonic stator 122. That is, the date indicator 110 constitutes the ultrasonic rotor 102.

The ultrasonic pressurizing spring 124 presses the date indicator 110 to thereby apply an elastic force to the displacement enlarging comb teeth 122*c*.

The electronic timepiece with calendar 400 is provided with a date jumper (not illustrated). A regulating portion of the date jumper regulates the date indicator teeth 110*a*.

Next, an explanation will be given of operation of the electronic timepiece with calendar 400 according to the invention.

With reference to FIG. 9, the control circuit 130 is provided with a time signal generating circuit for generating a date signal by counting data with respect of time and date and is further provided with an ultrasonic motor driving circuit for outputting an ultrasonic motor drive signal for rotating the ultrasonic motor based on the date signal outputted from the time signal generating circuit.

When the control circuit 130 outputs twelve o'clock at night as its counted result, the control circuit 130 outputs the ultrasonic motor drive signal to the ultrasonic motor (USM) 132. That is, the control circuit 130 is constituted to output the ultrasonic motor drive signal for rotating the date indicator 110 once per day by 360°/31, that is, by a 1/31 rotation.

The ultrasonic motor (USM) is provided with the ultrasonic stator 122 bonded with the piezoelectric element. The date indicator 110 is frictionally driven by oscillatory waves generated by the ultrasonic stator by elongation and contraction of the piezoelectric element when the piezoelectric element inputs the ultrasonic motor drive signal.

(5) Fifth embodiment

Figure 11:
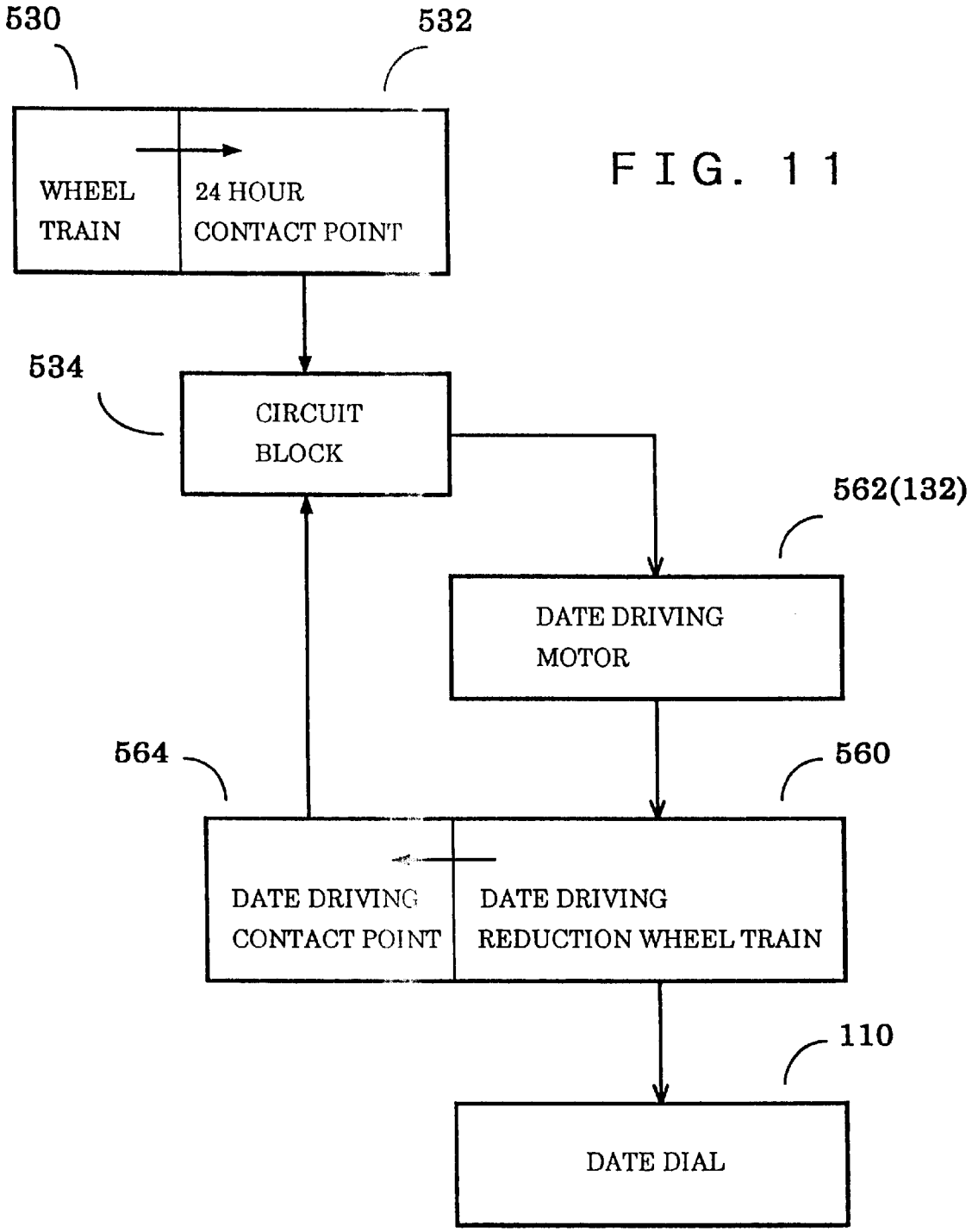
FIG. 11 is an outline block diagram showing a calendar mechanism portion of the electronic timepiece according to a fifth embodiment of the invention.
Figure 12:
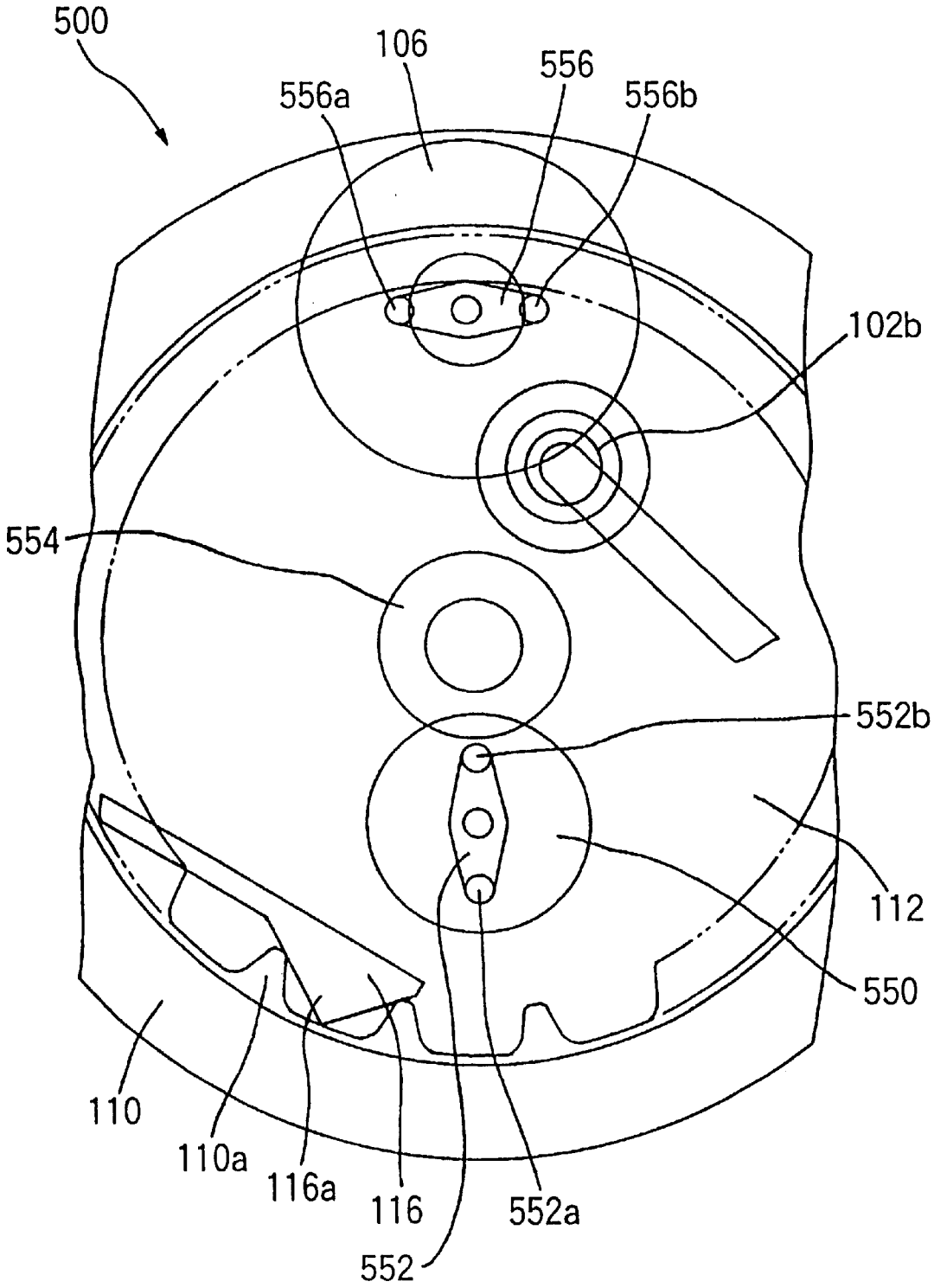
FIG. 12 is an outline plane view (perspective view) showing the calendar mechanism portion of the electronic timepiece according to the fifth embodiment of the invention.
Figure 13:
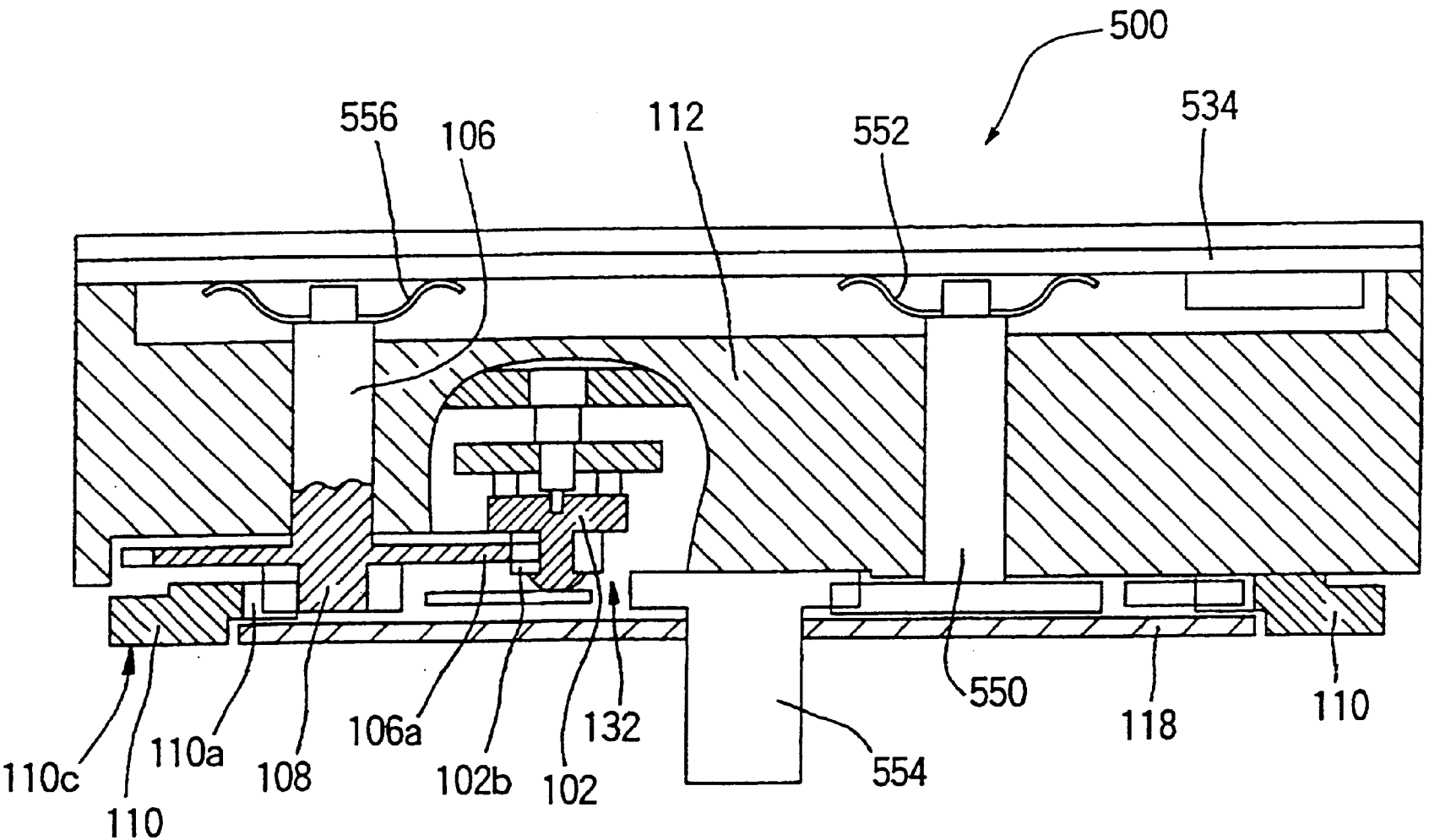
FIG. 13 is an outline sectional view showing the calendar mechanism portion of the electronic timepiece according to the fifth embodiment of the invention.

In reference to FIG. 11 through FIG. 13, according to a fifth embodiment of the invention, an electronic timepiece with calendar 500 is provided with a 24-hour contact point 532 at a portion of an observe wheel train 530 for detecting the rotational position of the observe wheel train 530. A 24-hour wheel 550 is provided with a 24-hour contact point spring 552. The 24-hour contact point spring 552 is provided with two 24-hour contact point spring terminals 552*a* and 552*b*.

A circuit block 543 is provided with patterns (not illustrated) for the 24-hour contact point spring terminals in correspondence with a portion of a circumferential portion along a locus on which front end portions of the 24-hour contact point spring terminals 552*a* and 552*b* are rotated. The 24-hour contact point spring 552 is arranged to be able to be brought into contact with the patterns (not illustrated) of the circuit block 543 for the 24-hour contact point spring terminals.

The 24-hour wheel 550 is in mesh with an hour wheel 554 and is rotated once per day. The hour wheel 554 is rotated once per 12 hours and indicates "hour" by a hour hand (not illustrated) attached to the hour wheel 554.

The date driving wheel 106 is rotatably integrated to the main plate 112. The date driving wheel 106 constitutes a date driving reduction wheel train 560. The ultrasonic rotor pinion 102*b* of the ultrasonic rotor 102 of the ultrasonic motor 132 is in mesh with the date driving gear wheel 106*a* of the date driving wheel 106. The ultrasonic motor 132 including the ultrasonic rotor 102 constitutes a date driving motor 562.

The date finger 108 is provided at the date driving wheel 106 and is rotated simultaneously with rotation of the date driving wheel 106. The date indicator 110 having 31 of the date indicator teeth 110*a* is rotatably integrated to the main plate 112. Numerals (not illustrated) of from "1" to "31" are provided on the indication surface 110*c* of the date indicator 110. The date indicator holder 118 rotatably supports the date indicator 110.

The electronic timepiece with calendar 500 is provided with a date jumper 116. A regulating portion 116*a* of the date jumper 116 regulates the date indicator teeth 110*a*.

The date driving wheel 106 is provided with a date driving wheel contact point spring 556. The date driving wheel contact point spring 556 is provided with two date driving wheel contact point spring terminals 556*a* and 556*b*.

The circuit block 534 is provided with patterns (not illustrated) for the date driving wheel contact point spring terminals in correspondence with a portion of a circumferential portion along a locus on which front end portions of the date driving wheel contact point spring terminals 556*a* and 556*b* are rotated. The date driving wheel contact point spring 556 is arranged to be able to be brought into contact with the patterns (not illustrated) for the date driving wheel contact point spring terminals of the circuit block 534. The date driving wheel contact point spring 556 constitutes a date driving contact point 564.

Next, an explanation will be given of operation of the electronic timepiece with calendar 500 according to the invention.

When the control circuit outputs twelve o'clock at night as its counted result, the 24-hour contact point spring 552 is brought into contact with a first pattern (not illustrated) of the circuit block 534. At this occasion, the circuit block 534 rotates the ultrasonic rotor 102 of the ultrasonic motor 132 by a detection signal outputted from the 24-hour contact point spring 552. By rotating the ultrasonic rotor 102, the date driving wheel 106 is rotated and the date indicator 110 is rotated by the date finger 108. Thereby, indication of date can be changed.

When the date indicator 110 is rotated by 360°/31, that is by a 1/31 rotation, the date driving wheel contact point spring 556 is brought into contact with a second pattern (not illustrated) of the circuit block 534. At this occasion, the circuit block 534 interrupts rotation of the ultrasonic rotor 102 of the ultrasonic motor 132 by a detection signal outputted from the date driving wheel contact point spring 556.

Next, the 24-hour contact point spring 552 is detached from the first pattern of the circuit block 534 and the date driving wheel contact point spring 556 is detached from the second pattern of the circuit block 534. This state is maintained until a state in which the control circuit outputs again twelve o'clock at night as its counted result, is brought about.

Further, time of starting or finishing date driving is not necessarily to be accurately twelve o'clock at night but may be time before twelve o'clock at night or may be time after twelve o'clock at night.

By such a constitution , date driving can be started accurately at same time every day, further, the position of the date indicator can accurately be maintained. As a result, there is almost no concern of shifting the position of date character of the date indicator in the electronic timepiece with calendar according to the invention.

(6) Description of a detailed structure of a contact point portion and its operation Next, an explanation will be given of a detailed structure of a contact point portion of a transmission wheel rotational position detecting apparatus for detecting a position along the rotational direction of a transmission wheel included in a wheel train of an observe wheel train, a calendar wheel train or the like of an electronic timepiece according to the invention.

(6-1) First structure of contact point portion

Figure 21:
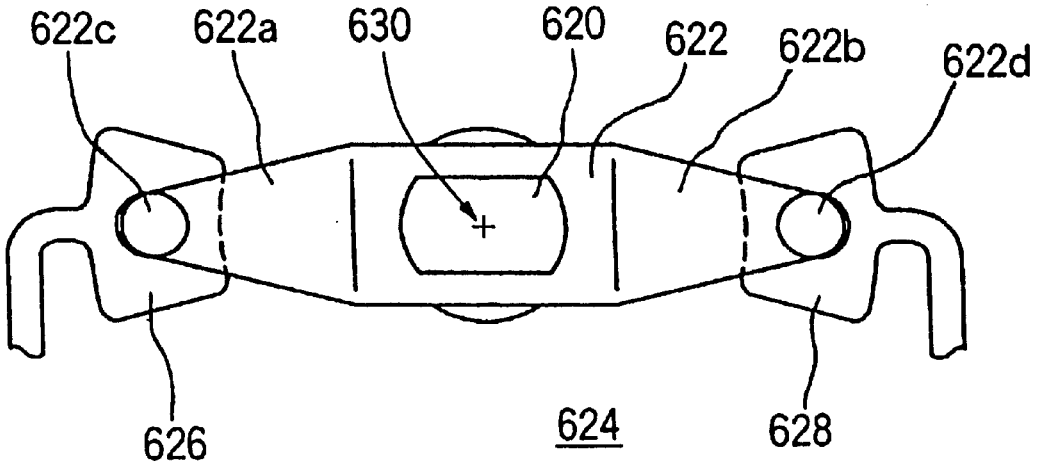
FIG. 21 is a partial plane view showing a first structure of a contact point portion of the electronic timepiece according to the fifth embodiment of the invention.
Figure 22:
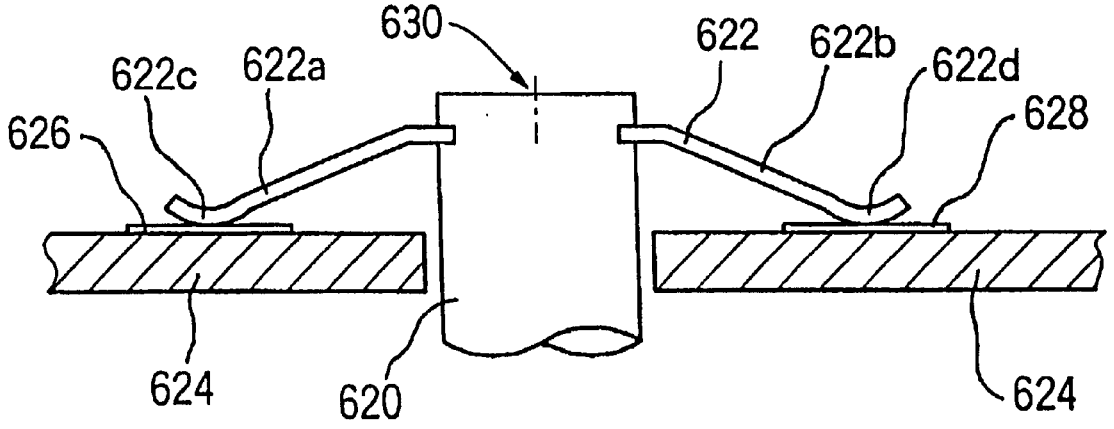
FIG. 22 is a partial sectional view showing the first structure of the contact point portion of the electronic timepiece according to the fifth embodiment of the invention.

In reference to FIG. 21 and FIG. 22, a transmission wheel 620 is rotatably integrated to an electronic timepiece. The transmission wheel 620 is a part included in an obverse wheel train, a calendar wheel train or the like of the electronic timepiece. The transmission wheel 620 is, for example, an hour wheel, 24-hour wheel, date driving wheel, intermediate date driving wheel or the like.

A contact point spring 622 is fixed to the transmission wheel 620. The, contact point spring 622 is constituted to be provided with a conductivity. For example, the contact point spring 622 may be constituted by a metal such as stainless steel or a surface of the contact point spring 622 may be adhered with gold by plating.

Two of contact point spring terminals 622*a* and 622*b* are provided in the contact point spring 622. A terminal contact point portion 622*c* is provided at a front end of the contact point spring terminal 622*a* and a terminal contact point portion 622*d* is provided at a front end of the contact point spring terminal 622*a*.

A printed circuit board 624 is integrated to the electronic timepiece and a pattern A 626 and a pattern B 628 are provided on the surface of the circuit board 624. The pattern A 626 and the pattern B 628 are connected to a control circuit (not illustrated). When the pattern A 626 and the pattern B 628 are conducted, a rotational position detecting signal is inputted to the control circuit (not illustrated).

The contact point spring 622 is extended substantially linearly by passing through a rotational center 630 of the transmission wheel 620. The pattern A 626 and the pattern B 628 are arranged to constitute an angle of substantially 180 degree relative to the rotational center 630 of the transmission wheel 620. Accordingly, when the transmission wheel 620 is rotated, there is brought about a state in which the terminal contact point portion 622*c* is brought into contact with the pattern A 626 and the terminal contact point portion 622*d* is brought into contact with the pattern B 628. At this occasion, the rotational position detecting signal is inputted to the control circuit (not illustrated). When the transmission wheel 620 is further rotated, the terminal contact point portion 622*c* is detached from the pattern A 626 and the terminal contact point portion 622*d* is detached from the pattern B 628. At this occasion, the rotational position detecting signal is not generated.

When the transmission wheel 620 is further rotated, there is brought about a state in which the terminal contact point portion 622*c* is brought into contact with the pattern B 628 and the terminal contact point portion 622*d* is brought into contact with the pattern A 626. At this occasion, the rotational position detecting signal is again inputted to the control circuit (not illustrated). When the transmission wheel 620 is further rotated, the terminal contact point portion 622*c* is detached from the pattern B 628 and the terminal contact point portion 622*d* is detached from the pattern A 626. At this occasion, the rotational position detecting signal is not generated.

Even when the transmission wheel 620 is rotated in the clockwise direction or rotated in the counterclockwise direction, the operation of the contact point portion remains the same.

According to the constitution, when the transmission wheel 620 is rotated by one rotation, the rotational position detecting signal is inputted twice to the control circuit (not illustrated). Therefore, when the transmission wheel 620 is constituted to rotate by one rotation per 24 hours, the rotational position detecting signal is inputted to the control circuit (not illustrated) every 12 hours. When it is needed to count 24 hours as in the case of changing a date indication, the control circuit is constituted to be provided with a counting circuit for counting a number of times of generating rotational position detecting signals to thereby output a signal for changing the date indication when the rotational position detecting signals are inputted twice.

Figure 23:
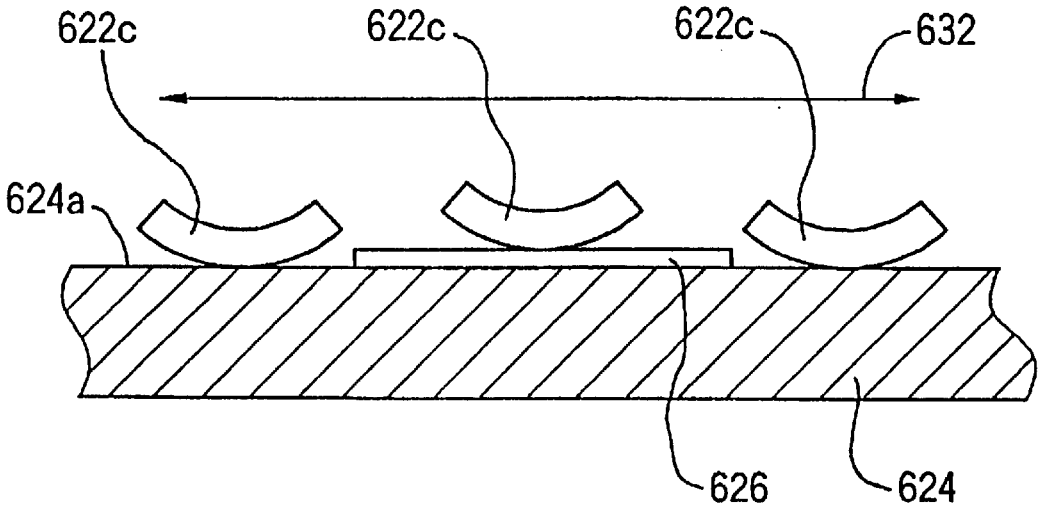
FIG. 23 is a partial sectional view showing operation of the contact point spring in the first structure of the contact point portion of the electronic timepiece according to the fifth embodiment of the invention.

As shown by FIG. 23, the terminal contact point portion 622*c* is rotated in a direction of an arrow mark 632 centering on the rotational center 630 of the transmission wheel 620 relative to the pattern A 626. Accordingly, the terminal contact point portion 622*c* is rotated while being brought into contact with a surface 624*a* of the printed circuit board 624 when it is not brought into contact with the patterns. The constitution and operation remains the same also in respect of the terminal contact point portion 622*d*.

By this structure, the rotational position of the transmission wheel can be detected by a simple pattern arrangement.

(6-2) Second structure of contact point portion

Figure 24:
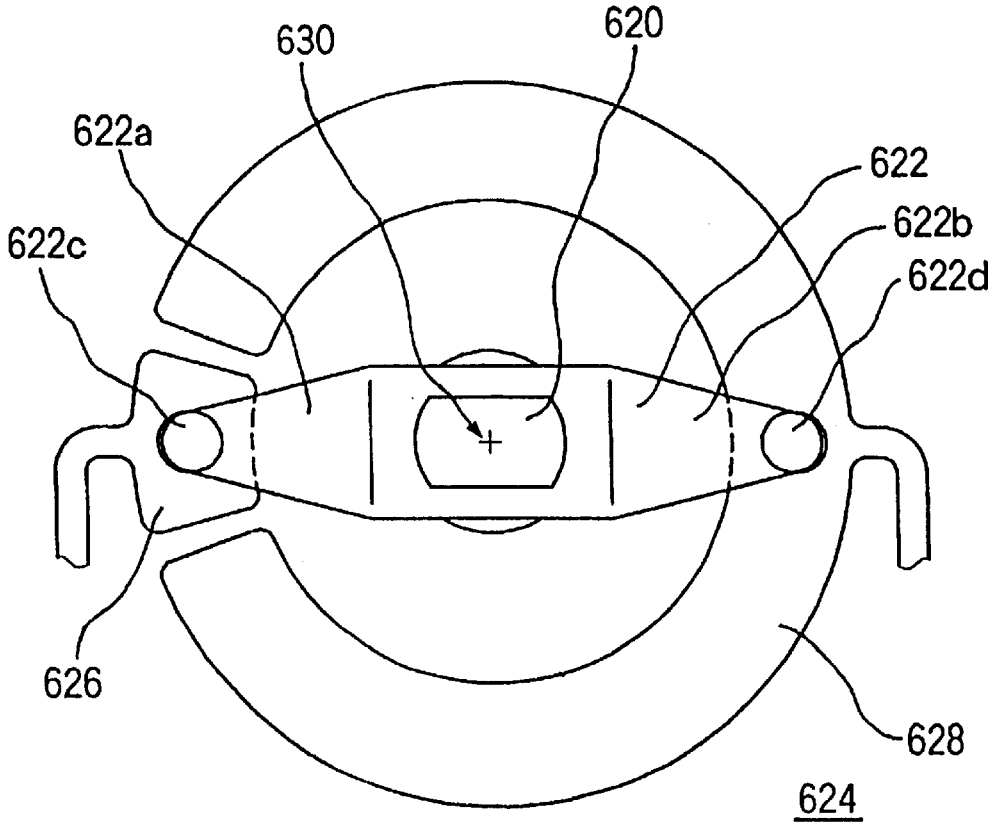
FIG. 24 is a partial plane view showing a second structure of the contact point portion of the electronic timepiece according to the fifth embodiment of the invention.

In reference to FIG. 24, similar to the first structure of the contact point portion, mentioned above, the transmission wheel 620 is rotatably integrated to the electronic timepiece and the contact point spring 622 is fixed to the transmission wheel 620. The constitution of the contact point spring 622 is similar to that in the first structure of the contact point portion.

The printed circuit board 624 is integrated to the electronic timepiece and the pattern A 626 and the pattern B 628 are provided on the surface of the printed circuit board 624. The pattern A 626 and the patten B 628 are connected to a control circuit (not illustrated). When the pattern A 626 and the pattern B 628 are conducted, the rotational position detecting signal is inputted to the control circuit (not illustrated).

The pattern A 626 is formed by a comparatively small open angle of, for example, substantially 30 degree relative to the rotational center 630 of the transmission wheel 620. The pattern B 628 is formed by a comparatively large open angle of, for example, substantially 320°. Accordingly, when the transmission wheel 620 is rotated, there is brought about a state in which the terminal contact point portion 622*c* is brought into contact with the pattern A 626 and the terminal contact point portion 622*d* is brought into contact with the pattern B 628. At this occasion, the rotational position detecting signal is inputted to the control circuit (not illustrated). When the transmission wheel 620 is further rotated, the terminal contact point portion 622*c* is detached from the pattern A 626 and is brought into contact with the pattern B 628, further, the terminal contact point portion 622*d* is also brought into contact with the pattern B 628. At this occasion, the rotational position detecting signal is not generated.

When the transmission wheel is further rotated, there is brought about a state in which the terminal contact point portion 622*c* is brought into contact with the pattern B 628, further, the terminal contact point portion 622*d* is brought into contact with the pattern A 626. At this occasion, the rotational position detecting signal is again inputted to the control circuit (not illustrated). When the transmission wheel 620 is further rotated, the terminal contact point portion 622*c* is brought into contact with the pattern B 628, further, the terminal contact point portion 622*d* is detached from the pattern A 626 and is brought into contact with the pattern B 628. At this occasion, the rotational position detecting signal is not generated.

According to the constitution, when the transmission wheel 620 is rotated by one rotation, the rotational position detecting signal is inputted to the control circuit (not illustrated) once. Accordingly, when the transmission wheel 620 is constituted to rotate once per 24 hours, the rotational position detecting signal is inputted to the control circuit (not illustrated) every 24 hours. When it is needed to count 24 hours as in the case of changing a date indication, the control circuit is constituted to be provided with a detecting circuit for detecting generation of the rotational position detecting signal and output a signal for changing the date indication when the rotational position detecting signal is inputted.

Even when the transmission wheel 620 is rotated in the clockwise direction or rotated in the counterclockwise direction, the operation of the contact point portion remains the same.

Figure 25:
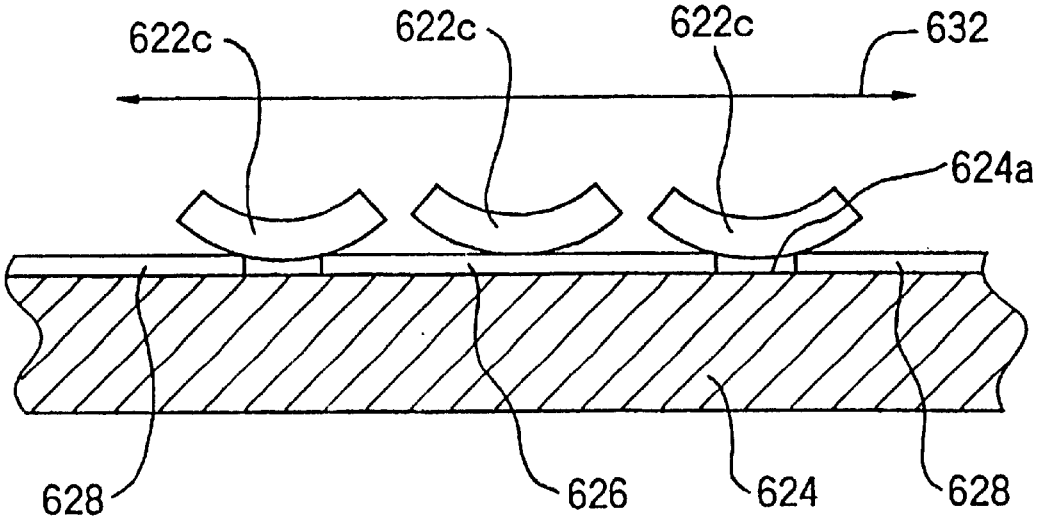
FIG. 25 is a partial sectional view showing operation of the contact point spring in the second structure of the contact point portion of the electronic timepiece according to the fifth embodiment of the invention.

As shown by FIG. 25, the terminal contact point portion 622*c* is rotated in the direction of the arrow mark 632 centering on the rotational center 630 of the transmission wheel 620 relative to the pattern A 626. Therefore, when a clearance in the circumferential direction between the pattern A 626 and the pattern B 628 is smaller than a size of the terminal contact point portion 622*c*, the terminal contact point portion 622*c* is brought into any of states of being brought into contact with only the pattern A 626, being brought into contact with only the pattern B 628 and being brought into contact simultaneously with the pattern A 626 and the pattern B 628 and the terminal contact point portion 622*c* is not brought into contact with the surface 624*a* of the printed circuit board 624. The constitution and operation remains the same also in respect of the terminal contact point portion 622*d*.

By the structure, there is no concern of shaving off the surface 624*a* of the printed circuit board 624 and there is less concern of shaving or peeling off edge portions of the pattern A 626 and the pattern B 628.

Figure 26:
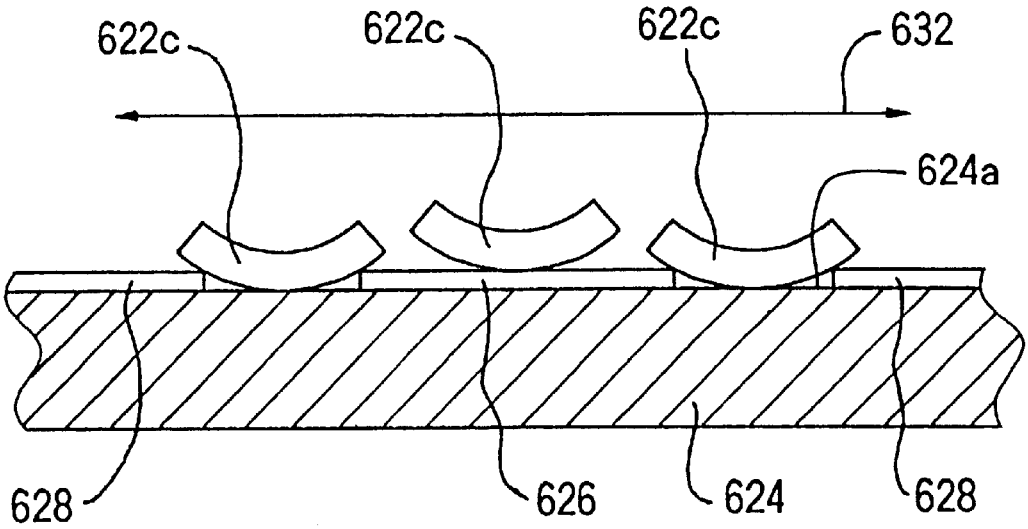
FIG. 26 is a partial sectional view showing operation of the contact point spring in a modified example of the second structure of the contact point portion according to the fifth embodiment of the invention.

Further, as shown by FIG. 26, when the clearance in the circumferential direction between the pattern A 626 and the pattern B 628 is nearly equal to the size of the terminal contact point portion 622*c*, there causes a possibility of bringing the terminal contact point portion 622*c* into contact with the surface 624*a* of the printed circuit board 624. Therefore it is preferable to form the clearance in the circumferential direction between the pattern A 626 and the pattern B 628 to be small.

(6-3) Third structure of contact point portion

Figure 27:
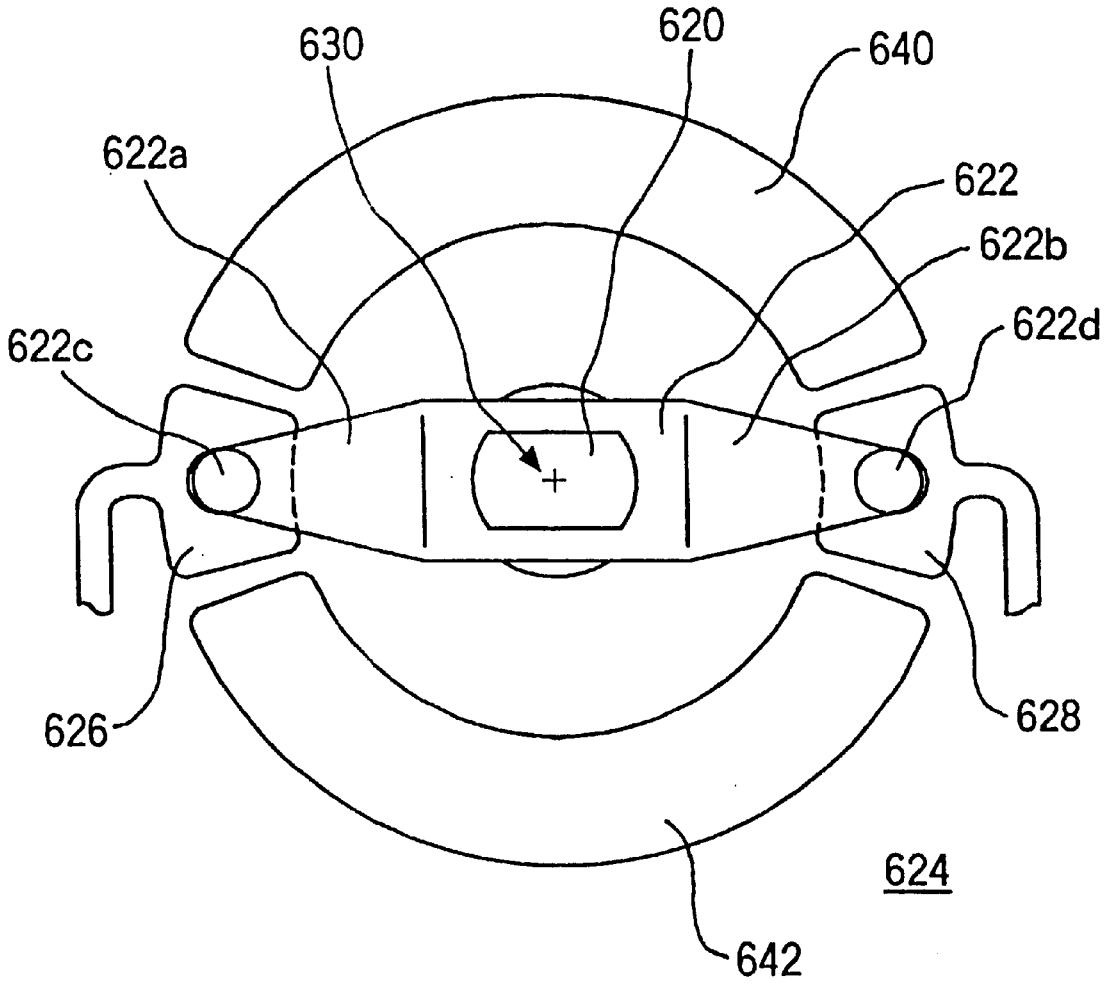
FIG. 27 is a partial plane view showing a third structure of the contact point portion of the electronic timepiece according to the fifth embodiment of the invention.

In reference to FIG. 27, pattern A 626, pattern B 628, pattern C 640 and pattern D 642 are provided on a surface of the printed circuit board 624. Pattern A 626 and pattern B 628 are connected to a control circuit (not illustrated). Pattern C 640 and pattern D 642 are so-to-speak "dummy patterns" which are not connected to the control circuit and provided with no special function. When pattern A 626 and pattern B 628 are conducted, the rotational position detecting signal is inputted to the control circuit (not illustrated).

The contact point spring 622 is extended substantially linearly by passing through the rotational center 630 of the transmission wheel 620. Pattern A 626 and pattern B 628 are arranged to constitute an angle of substantially 180 degree relative to the rotational center 630 of the transmission wheel 620. Therefore, when the transmission wheel 620 is rotated, there is brought about a state in which a terminal contact point portion 622*c* is brought into contact with pattern A 626, further, a terminal contact point portion 622*d* is brought into contact with pattern B 628. At this occasion, the rotational position detecting signal is inputted to the control circuit (not illustrated). When the transmission wheel 620 is further rotated in the clockwise direction, the terminal contact point portion 622*c* is detached from pattern A 626 and is brought into contact with pattern C 640, further, the terminal contact point portion 622*d* is detached from pattern B 628 and is brought into contact with pattern D 642. At this occasion, the rotational position detecting signal is not generated.

When the transmission wheel 620 is further rotated in the clockwise direction, there is brought about a state in which the terminal contact point potion 622*c* is brought into contact with pattern B 628, further, the terminal contact point portion 622*d* is brought into contact with pattern A 626. At this occasion, the rotational position detecting signal is again inputted to the control circuit (not illustrated). When the transmission wheel 620 is further rotated in the clockwise direction, the terminal contact point portion 622*c* is detached from pattern B 628 and is brought into contact with pattern D 642, further, the terminal contact point portion 622*d* is detached from pattern A 626 and is brought into contact with pattern C 640. At this occasion, the rotational position detecting signal is not generated.

According to the constitution, when the transmission wheel 620 is rotated by one rotation, the rotational position detecting signal is twice inputted to the control circuit (not illustrated). Accordingly, when the transmission wheel 620 is constituted to be rotated by one rotation per 24 hours, the rotational position detecting signal is inputted to the control circuit (not illustrated) every 12 hours. When it is needed to count 24 hours as in the case of changing a date indication, the control circuit is constituted to be provided with a counting circuit for counting a number of times of generating the rotational position detecting signal and output a signal for changing the date indication when the rotational position detecting signal is inputted twice.

Even when the transmission wheel 620 is rotated in the clockwise direction or rotated in the counterclockwise direction, operation of the contact point portion remains the same.

By this structure, the rotational position of the transmission wheel can be detected by a simple pattern arrangement.

(6-4) Fourth structure of contact point portion

Figure 28:
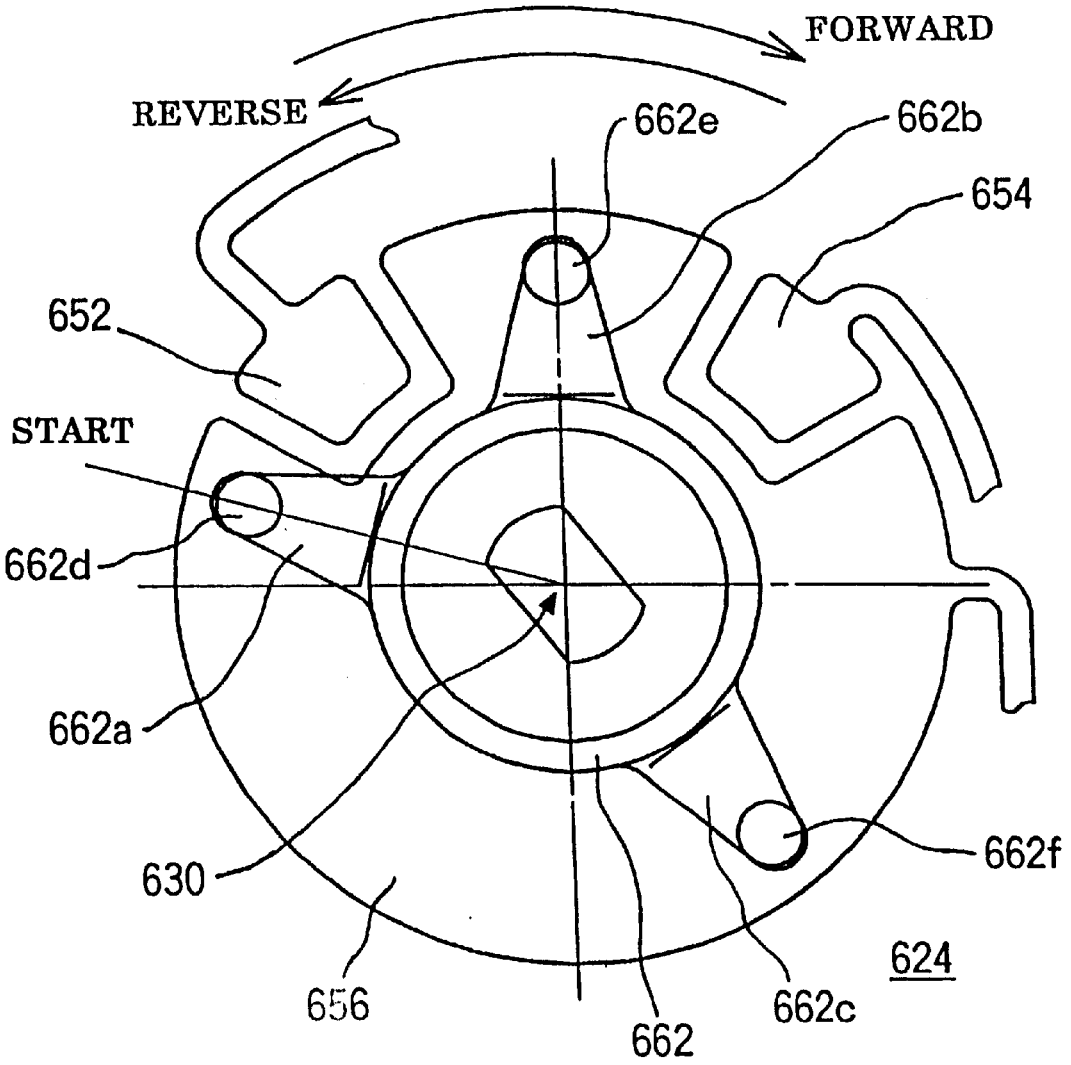
FIG. 28 is a partial plane view showing a fourth structure of the contact point portion of the electronic timepiece according to the fifth embodiment of the invention.

In reference to FIG. 28, pattern A 652, pattern B 654 and a VDD pattern 656 is provided on the surface of the circuit board 624. Pattern A 652 and pattern B 654 are connected to a control circuit (not illustrated). The VDD pattern 656 may directly be connected to a plus terminal (VDD) of a power source or may be connected to the control circuit (not illustrated) and connected to a plus terminal (VDD) of a power source in the control circuit.

When pattern A 652 is conducted to the plus terminal (VDD) of the power source, an A pattern detection signal which is a first detection signal is inputted to the control circuit (not illustrated). That is, in this case, the A pattern input terminal of the control circuit is provided with a "1" level, that is, becomes "HIGH".

When the pattern B 654 is conducted to the plus terminal (VDD) of the power source, a B pattern detection signal which is a second detection signal is inputted to the control circuit (not illustrated). That is, in this case, a B pattern input terminal of the control circuit is provide with "1" level, that is, becomes "HIGH".

Figure 30:
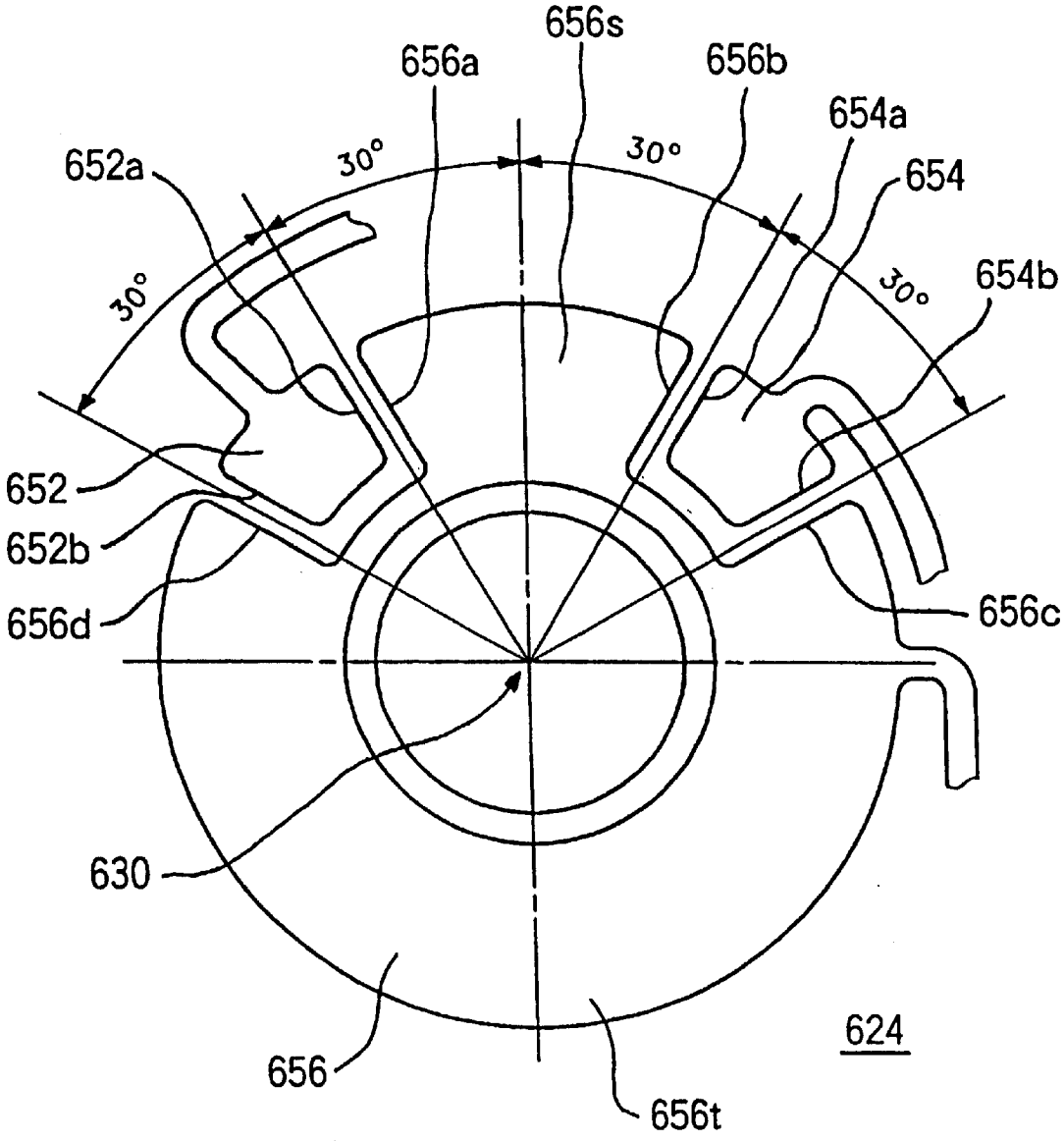
FIG. 30 is a partial plane view showing shapes of circuit patterns used in the fourth structure of the contact point portion of the electronic timepiece according to the fifth embodiment of the invention.

An explanation will be given of the respective patterns sequentially in the clockwise direction in reference to FIG. 30.

Pattern A 652 is provided in an open angle of substantially 30 degree relative to the rotational center 630 of the transmission wheel. Pattern A 652 is provided with a first end portion 652*a* and a second end portion 652*b* in the circumferential direction.

The VDD pattern 656 is provided with a first pattern portion 656*s* and a second pattern portion 656*t*. The first pattern portion 656*s* of the VDD pattern 656 is provided with a first end portion 656*a* and a second end portion 656*b* in the circumferential direction. The first end portion 656*a* of the VDD pattern 656 is contiguous to a first end portion 652*a* of the pattern A 652 with a clearance therebetween. The first pattern portion 656*s* of the VDD pattern 656 is provide within an open angle of substantially 60 degree relative to the rotational center 630 of the transmission wheel.

Pattern B 654 is provided with a first end portion 654*a* and a second end portion 654*b* in the circumferential direction. The first end portion 654*a* of pattern B 654 is contiguous to a second end portion 656*b* of the first pattern portion 656*s* of the VDD pattern 656. Pattern B 654 is provided within an open angle of substantially 30 degree relative to the rotational center 630 of the transmission wheel.

The second end portion 654*b* of pattern B 654 is contiguous to a first end portion 656*c* of the second pattern portion 565*t* and the VDD pattern 656 with a clearance therebetween. The second pattern portion of the VDD pattern is provided within an open angle of substantially 240 degree relative to the rotational center 630 of the transmission wheel. Further, a second end portion 656*d* of the second pattern portion 565*t* of the VDD pattern 656 is contiguous to the second end portion 652*b* of pattern A 652 with a clearance therebetween.

As described above, the surface of the printed circuit board 624 is provided with pattern A 652, the first pattern portion 656*s* of the VDD pattern 656, pattern B 654 and the second pattern portion 656*t* of the VDD pattern 656 sequentially in the clockwise direction of the circumferential direction centering on the rotational center 630 of the transmission wheel.

Figure 29:
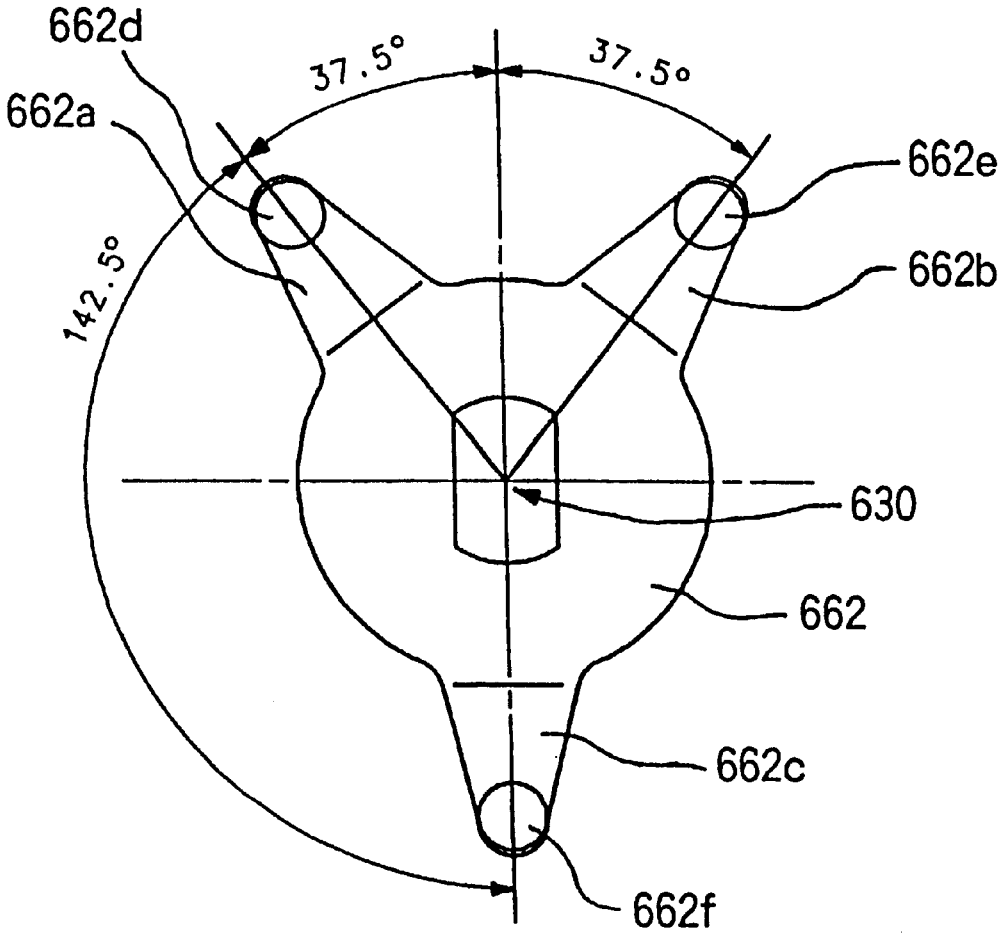
FIG. 29 is a partial plane view showing a shape of a contact point spring used in the fourth structure of the contact point portion of the electronic timepiece according to the fifth embodiment of the invention.

In reference to FIG. 29, a contact point spring 662 is provided with three contact point spring terminals 662*a* and 662*b* and 662*c* extended outwardly from the rotational center 630 of the transmission wheel 620. The contact point spring terminals 662*a* and 662*b* are provided to constitute an angle of substantially 75 degree therebetween. The contact point spring terminals 662*a* and 662*c* are provided to constitute an angle of substantially 142.5 degree therebetween. The contact point spring terminals 662*b* and 662*c* are provided to constitute an angle of substantially 142.5 degree therebetween.

A terminal contact point portion 662*d* is provided at a front end portion of the contact point spring terminal 662*a*, a terminal contact point portion 662*e* is provided at a front end portion of the contact point spring terminal 662*b* and a terminal contact point portion 662*f* is provided at a front end portion of the contact point spring terminal 662*c*.

When the transmission wheel 620 is rotated, the terminal contact point portions 662*a*, 662*b* and 662*c* are respectively constituted to be brought into contact with pattern A 652, the first pattern portion 656*s* of the VDD pattern 656, pattern B 654 and the second pattern portion 656*t* of the VDD pattern 656.

Next, an explanation will be given of operation of detecting the rotational direction and detecting a rotation starting state when the transmission wheel is rotated in the clockwise direction, that is, rotated regularly.

Figure 31:
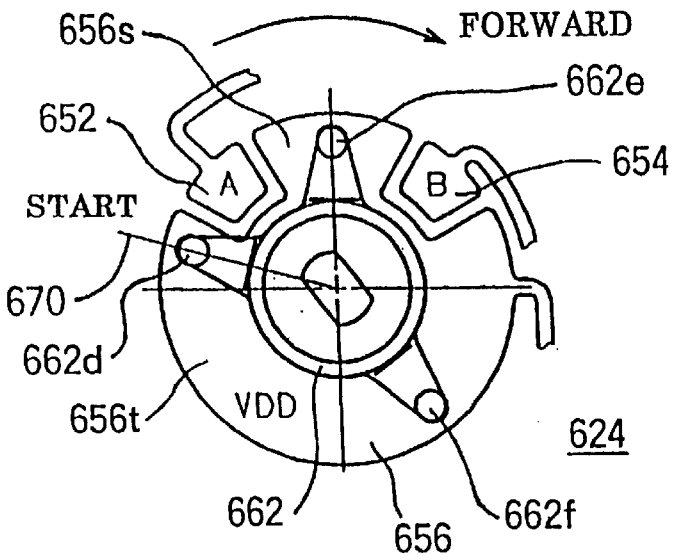
FIG. 31 is a partial plane view showing operation of the fourth structure in a regular rotational direction of the contact point portion of the electronic timepiece according to the fifth embodiment of the invention.

(f1) Operational state 1:

FIG. 31 shows an initial state of the transmission wheel, that is, an operational state 1 in which the terminal contact point portion 662*d* of the contact point spring 662 is disposed at a start position 670. The state 1 is set to "0 degree" in timing charts of FIG. 32.

According to the operational state 1 shown by FIG. 31, the terminal contact point portion 662*d* is brought into contact with the second pattern portion 656*t* of the VDD pattern 656, the terminal contact point portion 662*e* is brought into contact with the first pattern portion 656*s* of the VDD pattern 656 and the terminal contact point portion 662F is brought into contact with the second pattern portion 656*t* of the VDD pattern 656.

In the operational state 1, neither of the A pattern detection signal and the B pattern detection signal is inputted to the control circuit (not illustrated). That is, in the operational state 1, both of the A pattern input terminal and the B pattern input terminal of the control circuit are provided with a "0" level, that is, becomes "LOW".

(f2) Operational state 2:

Next, in an operational state 2 in which the terminal contact point portion 662*d* is rotated in the clockwise direction from the start position 670 to a position of about 15 degree therefrom, the terminal contact point portion 662*d* is brought into contact with pattern A 652, the terminal contact point portion 662*e* is brought into contact with the first pattern portion 656*s* of the VDD pattern 656 and the terminal contact point portion 662*f* is brought into contact with the second pattern portion 656*t* of the VDD pattern 656.

In the operational state 2, only the A pattern detection signal is inputted to the control circuit (not illustrated). That is, in the operational state 2, the A pattern input terminal of the control circuit is provided with the "1" level, that is, becomes "HIGH" and the B pattern input terminal is provided with the "0" level, that is, stays to be "LOW".

(f3) Operational state 3:

Next, in an operational state 3 in which the terminal contact point portion 662*d* of the contact point spring 662 is rotated in the clockwise direction from the start position 670 to a position of about 30 degree therefrom, the terminal contact point portion 662*d* is brought into contact with pattern A 652, the terminal contact point portion 662*e* is brought into contact with pattern B 654 and the terminal contact point portion 662*f* is brought into contact with the second pattern portion 656*t* of the VDD pattern 656.

In the operational state 3, the A pattern detection signal and the B pattern detection signal are inputted to the control circuit (not illustrated). That is, in the operational state 3, the A pattern input terminal of the control circuit is provided with the "1" level, that is, becomes "HIGH" and also the B pattern input terminal is provided with the "1" level, that is, becomes "HIGH".

(f4) Operational state 4:

Next, in an operational state 4 in which the terminal contact point portion 662*d* of the contact point spring 662 is rotated in the clockwise direction from the start position 670 to a position of about 45 degree therefrom, the terminal contact point portion 662*d* is brought into contact with the first pattern portion 656*s* of the VDD pattern 656, the terminal contact point portion 662*e* is brought into contact with pattern B 654 and the terminal contact point portion 662*f* is brought into contact with the second pattern portion 656*t* of the VDD pattern 656.

In the operational state 4, only the B pattern detection signal is inputted to the control circuit (not illustrated). That is, in the operational state 4, the A pattern input terminal of the control circuit is provided with the "0" level, that is, becomes "LOW" and the B pattern input terminal is provided with the "1" level, that is, stays to be "HIGH".

Figure 32:
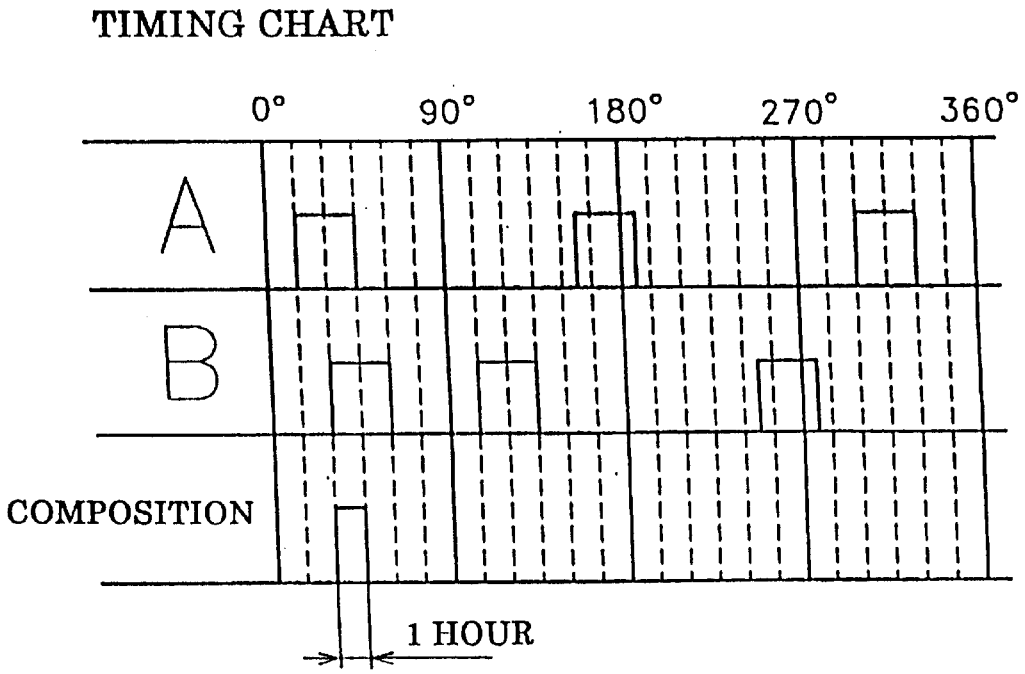
FIG. 32 illustrates timing charts in operating the fourth structure in the regular rotational direction of the contact point portion of the electronic timepiece according to the fifth embodiment of the invention.

Therefore, as shown by FIG. 32, the state in which both of the A pattern input terminal and the B pattern input terminal of the control circuit are provided with the "1" level, continues about 1 hour. Because when the transmission wheel is constituted to rotate by one rotation in 24 hours, about one hour is needed for the transmission wheel to rotate by 15 degree.

(f5) Operational state 5:

Next, in an operational state 5 in which the terminal contact point portion 662*d* of the contact point spring 662 is rotated in the clockwise direction from the start position 670 to a position of about 60 degree therefrom, the terminal contact point portion 662*d* is brought into contact with the first pattern portion 656*s* of the VDD pattern 656, the terminal contact point portion 662*e* is brought into contact with the second pattern portion 656*t* of the VDD pattern 656 and the terminal contact point portion 662*f* is brought into contact with the second pattern portion 656*t* of the VDD pattern 656.

In the operational state 5, neither of the A pattern detection signal and the B pattern detection signal is inputted to the control circuit (not illustrated). That is, in the operational state 5, both of the A pattern input terminal and the B pattern input terminal of the control circuit are provided with the "0" level, that is, become "LOW".

(f6) Operational state 6:

Next, in an operational state 6 in which the terminal contact point portion 662*d* of the contact point spring 662 is rotated in the clockwise direction from the start position 670 to a position of about 105 degree therefrom, the terminal contact point portion 662*d* is brought into contact with pattern B 654, the terminal contact point portion 662*e* is brought into contact with the second pattern portion 656*t* of the VDD pattern 656 and the terminal contact point portion 662*f* is brought into contact with the second pattern portion 656*t* of the VDD pattern 656.

In the operational state 6, only the B pattern detection signal is inputted to the control circuit (not illustrated). That is, in the operational state 6, the A pattern input terminal of the control circuit stays to be provided with the "0" level and the B pattern input terminal is provided with the "1" level, that is, becomes "HIGH".

(f7) Operational state 7:

Next, in an operational state 7 in which the terminal contact point portion 552*d* of the contact point spring 662 is rotated in the clockwise direction from the start position 670 to a position of about 135 therefrom, the terminal contact point portion 662*d* is brought into contact with the second pattern portion 656*t* of the VDD pattern 656, the terminal contact point portion 662*e* is brought into contact with the second pattern portion 656*t* of the VDD pattern 656 and the terminal contact point portion 662*f* is brought into contact with the second pattern portion 656*t* of the VDD pattern 656.

In the operational state 7, neither of the A pattern detection signal and the B pattern detection signal is inputted to the control circuit (not illustrated). That is, in the operational state 7, both of the A pattern input terminal and the B pattern input terminal are provided with the "0" level, that is, become "LOW".

(f8) Operational state 8:

Next, in an operational state 8 in which the terminal contact point portion 662*d* of the contact point spring 662 is rotated in the clockwise direction from the start position 670 to a position of about 157.5 degree therefrom, the terminal contact point portion 662*d* is brought into contact with the second pattern portion 656*t* of the VDD pattern 656, the terminal contact point portion 662*e* is brought into contact with the second pattern portion 565*t* of the VDD pattern 656 and the terminal contact point portion 662*f* is brought into contact with pattern A 652.

In the operational state 8, only the A pattern detection signal is inputted to the control circuit (not illustrated). That is, in the operational state 8, the A pattern input terminal of the control circuit stays to be provided with the "1" level, that is, becomes "HIGH" and the B pattern input terminal is provided with the "0" level, that is, stays to be "LOW".

(f9) Operational state 9:

Next, in an operational state 9 in which the terminal contact point portion 662*d* of the contact point spring 662 is rotated in the clockwise direction from the start position 670 to a position of about 187.5 degree, the terminal contact point portion 662*d* is brought into contact with the second pattern portion 656*t* of the VDD pattern 656, the terminal contact point portion 662*e* is brought into contact with the second pattern portion 656*t* of the VDD pattern 656 and the terminal contact point portion 662*f* is brought into contact with the first pattern portion 656*s* of the VDD pattern 656.

In the operational state 9, neither of the A pattern detection signal and the B pattern detection signal is inputted to the control circuit (not illustrated). That is, in the operational state 9, both of the A pattern input terminal and the B pattern input terminal of the control circuit are provided with the "0" level, that is, become "LOW".

(f10) Operational state 10:

Next, in an operational state 10 in which the terminal contact point portion 662*d* of the contact point spring 662 is rotated in the clockwise direction from the start position 670 to a position of about 247.5 degree therefrom, the terminal contact point portion 662*d* is brought into contact with the second pattern portion 656*t* of the VDD pattern 656, the terminal contact point portion 662*e* is brought into contact with the second pattern portion 656*t* of the VDD pattern 656 and the terminal contact point portion 662*f* is brought into contact with pattern B 654.

In the operational state 10, only the B pattern detection signal is inputted to the control circuit (not illustrated). That is, in the operational state 10, the A pattern input terminal of the control circuit stays to be provided with the "0" level and the B pattern input terminal is provided with the "1" level, that is, becomes "HIGH".

(f11) Operational state 11:

Next, in an operational state 11 in which the terminal contact point portion 662*d* of the contact point spring 662 is rotated in the clockwise direction from the start position 670 to a position of about 277.5 degree therefrom, the terminal contact point portion 662*d* is brought into contact with the second pattern portion 656*t* of the VDD pattern 656, the terminal contact point portion 662*e* is brought into contact with the second pattern portion 656*t* of the VDD pattern 656 and the terminal contact point portion 662*f* is brought into contact with the second pattern portion 656*t* of the VDD pattern 656.

In the operational state 11, neither of the A pattern detection signal and the B pattern detection signal is inputted to the control circuit (not illustrated). That is, in the operational state 11, both of the A pattern input terminal and the B pattern input terminal of the control circuit are provided with the "0" level, that is, become "LOW".

(f12) Operational state 12:

Next, in an operational state 12 in which the terminal contact point portion 662*d* of the contact point spring 662 is rotated in the clockwise direction from the start position 670 to a position of about 300 degree therefrom, the terminal contact point portion 662*d* is brought into contact with the second pattern portion 656*t* of the VDD pattern 656, the terminal contact point portion 662*e* is brought into contact with pattern A 652 and the terminal contact point portion 662*f* is brought into contact with pattern A 652.

In the operational state 12, only the A pattern detection signal is inputted to the control circuit (not illustrated). That is, in the operational state 12, the A pattern input terminal of the control circuit is provided with the "1" level, that is, becomes "HIGH" and the B pattern input terminal is provided with the "0" level, that is, stays to be "LOW".

(f13) Operational state 13:

Next, in an operational state 13 in which the terminal contact point portion 662*d* of the contact point spring 662 is rotated in the clockwise direction from the start position 670 to a position of about 300 degree therefrom, the terminal contact point portion 662*d* is brought into contact with the second pattern portion 656*t* of the VDD pattern 656, the terminal contact point portion 662*e* is brought into contact with the first pattern portion 656*s* of the VDD pattern 656 and the terminal contact point portion 662*f* is brought into contact with the second pattern portion 656*t* of the VDD pattern 656.

In the operational state 13, neither of the A pattern detection signal and the B pattern detection signal is inputted to the control circuit (not illustrated). That is, in the operational state 13, both of the A pattern input terminal and the B pattern input terminal of the control circuit are provided with the "0" level, that is, become "LOW".

(f14) Operation of returning to start state

Further, when the terminal contact point portion 662*d* of the contact point spring 662 is rotated in the clockwise direction from the start position 670 to a position of 360 degree therefrom, the contact point spring 662 returns to the start state shown by FIG. 31.

According to this constitution, when the transmission wheel 620 is rotated by one rotation, both of the A pattern input terminal and the B pattern input terminal of the control circuit are provided with the "1" level only once during a time period of one hour. Further, before both of the A pattern input terminal and the B pattern input terminal are provided with the "1" level, the A pattern input terminal is provided with the "1" level by which "regular rotation" can be determined.

Therefore, when the transmission wheel 620 is constituted to rotate by one rotation in 24 hours, the rotational position detecting signal for detecting the "regular rotation" is inputted to the control circuit (not illustrated). At the same time, both of the A pattern input terminal and the B pattern input terminal are provided with the "1" level by which the position of the transmission wheel 620 in the circumferential direction can be detected.

Next, an explanation will be given of operation of detecting the rotational direction and detecting a rotation starting state when the transmission wheel is rotated in the counterclockwise direction, that is, rotated reversely.

Figure 33:
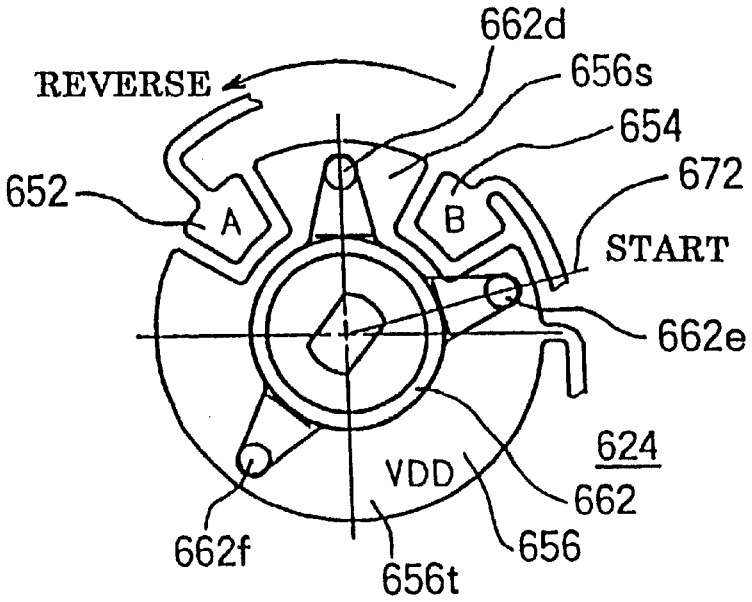
FIG. 33 is a partial plane view showing operation of the fourth structure in a reverse rotational direction of the contact point portion of the electronic timepiece according to the fifth embodiment of the invention.

(g1) Operational state 1:

FIG. 33 shows an initial state of the transmission wheel, that is, the terminal contact point portion 662*e* of the contact point spring 662 is disposed at a start position 672. The state 1 is set to "0°" in timing charts of FIG. 34.

In the operational state 1 shown by FIG. 33, the terminal contact point portion 662*d* is brought into contact with the first pattern portion 656*s* of the VDD pattern 656, the terminal contact point portion 662*e* is brought into contact with the second pattern portion 656*t* of the VDD pattern 656 and the terminal contact point portion 662*f* is brought into contact with the second pattern portion 656*t* of the VDD pattern 656.

In the operational state 1, neither of the A pattern detection signal and the B pattern detection signal is inputted to the control circuit (not illustrated). That is, in the operational state 1, both of the A pattern input terminal and the B pattern input terminal of the control circuit are provided with the "0" level, that is, becomes "LOW".

(g2) Operational state 2:

Next, in an operational state 2 in which the terminal contact point portion 662*e* of the contact point spring 662 is rotated in the counterclockwise direction from the start position 670 to a position of about 15 degree therefrom, the terminal contact point portion 662*d* is brought into contact with the first pattern portion 656*s* of the VDD pattern 656, the terminal contact point portion 662*e* is brought into contact with pattern B 654 and the terminal contact point portion 662*f* is bought into contact with the second pattern portion 656*t* of the VDD pattern 656.

In the operational state 2, only the B pattern detection signal is inputted to the control circuit (not illustrated). That is, in the operational state 2, the A pattern input terminal of the control circuit is provided with the "0" level, that is, stays to be "LOW" and the B pattern input terminal is provided with the "1" level, that is, becomes "HIGH".

(g3) Operational state 3:

Next, in an operational state 3 in which the terminal contact point portion 662*e* of the contact point spring 662 is rotated in the counterclockwise direction from the start position 672 to a position of about 30 degree therefrom, the terminal contact point portion 662*d* is brought into contact with pattern A 652, the, terminal contact point portion 662*e* is brought into contact with pattern B 654 and the terminal contact point portion 662*f* is brought into contact with the second pattern portion 656*t* of the VDD pattern 656.

In the operational state 3, the A pattern detection signal and the B pattern detection signal are inputted to the control circuit (not illustrated). That is, in the operational state 3, the A pattern input terminal of the control circuit is provided with the "1" level, that is, becomes "HIGH" and also the B pattern input terminal is provided with the "1" level, that is, becomes "HIGH".

(g4) Operational state 4:

Next, in an operational state 4 in which the terminal contact point portion 662*e* of the contact point spring 662 is rotated in the counterclockwise direction from the start position 670 to a position of about 45 degree therefrom, the terminal contact point portion 662*d* is brought into contact with pattern A 652, the terminal contact point portion 662*e* is brought into contact with the first pattern portion 656*s* of the VDD pattern 656 and the terminal contact point portion 662*f* is brought into contact with the second pattern portion 656*t* of the VDD pattern 656.

In the operational state 4, only the A pattern detection signal is inputted to the control circuit (not illustrated). That is, in the operational state 4, the A pattern input terminal of the control circuit stays to be provided with the "1" level, that is, becomes "HIGH" and the B pattern input terminal is provided with the "0" level, that is, becomes "LOW".

Therefore, as shown by FIG. 32, a state in which both of the A pattern input terminal and the B pattern input terminal of the control circuit are provided with the "1" level, continues for about 1 hour. Because when the transmission wheel is constituted to rotate once per 24 hours, about 1 hour is needed for the transmission wheel to rotate by 15 degree.

(g5) Operational state 5:

Next, in an operational state 5 in which the terminal contact point portion 662*e* of the contact point spring 662 is rotated in the counterclockwise direction from the start position 670 to a position of about 60 degree therefrom, the terminal contact point portion 662*e* is brought into contact with the second pattern portion 656*t* of the VDD pattern 656, the terminal contact point portion 662*e* is brought into contact with the first pattern portion 656*s* of the VDD pattern 656 and the terminal contact point portion 662*f* is brought into contact with the second pattern portion 656*t* of the VDD pattern 656.

In the operational state 5, neither of the A pattern detection signal and the B pattern detection signal is inputted to the control circuit (not illustrated). That is, in the operational state 5, both of the A pattern input terminal and the B pattern input terminal of the control circuit are provided with the "0" level, that is, become "LOW".

Figure 34:
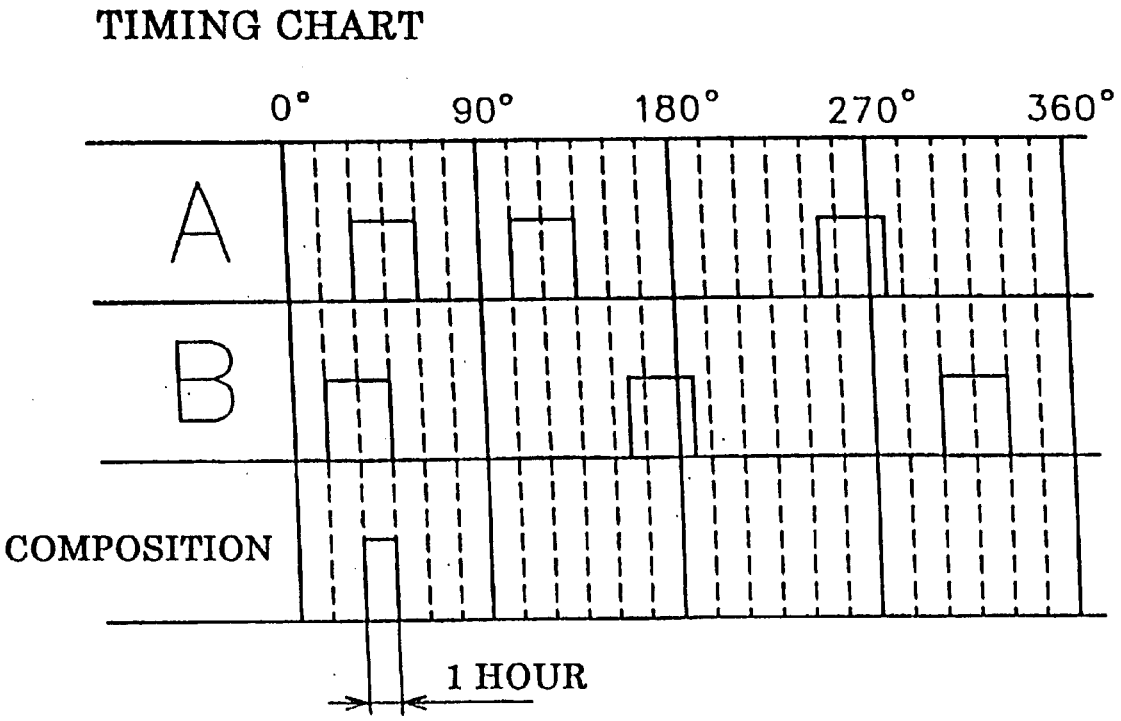
FIG. 34 illustrates timing charts in operating the fourth structure in the reverse rotational direction of the contact point portion of the electronic timepiece according to the fifth embodiment of the invention.

(g6) Operational state thereafter:

As shown by FIG. 34, in an operational state in which the terminal contact point portion 662*e* is rotated in the counterclockwise direction from the start position 670 to a position of 105 degree therefrom, the A pattern input terminal of the control circuit is provided with the "1" level, that is, becomes "HIGH".

In an operational state in which the terminal contact point portion 662*e* is rotated in the counterclockwise direction from the start position 670 to a position of 135 degree therefrom, both of the A pattern input terminal and the B pattern input terminal of the control circuit are provided with the "0" level, that is, become "LOW".

In an operational state in which the terminal contact point portion 662*e* is rotated in the counterclockwise direction from the start position 670 to a position of 157.5 degree therefrom, the B pattern input terminal of the control circuit is provided with the "1" level, that is, becomes "HIGH".

In an operational state in which the terminal contact point portion 662*e* is rotated in the counterclockwise direction from the start position 670 to a position of 135 degree therefrom, both of the A pattern input terminal and the B pattern input terminal of the control circuit are provided with the "0" level, that is, become "LOW".

In an operational state in which the terminal contact point portion 662*e* is rotated in the counterclockwise direction from the start position 670 to a position of 247.5 degree, the A pattern input terminal of the control circuit is provided with the "1" level, that is, becomes "HIGH".

In an operational state in which the terminal contact point portion 662*e* is rotated in the counterclockwise direction from the start position 670 to a position of 277.5 degree therefrom, both of the A pattern input terminal and the B pattern input terminal of the control circuit are provided with "0" level, that is, become "LOW".

In an operational state in which the terminal contact point portion 662*e* is rotated in the counterclockwise direction from the start position 670 to a position of 300 degree therefrom, the B pattern input terminal of the control circuit is provided with the "1" level, that is, becomes "HIGH".

In an operational state in which the terminal contact point portion 662*e* is rotated in the counterclockwise direction from the start position 670 to a position of 330 degree therefrom, both of the A pattern input terminal and the B pattern input terminal of the control circuit are provided with the "0" level, that is, become "LOW".

Accordingly, in an operational state in which the terminal contact point portion 662*e* is rotated in the counterclockwise direction from the start position 670 up to the position of 360 degree therefrom by exceeding the position of 60 degree therefrom, there is no state in which both of the A pattern input terminal and the B pattern input terminal are provided with the "1" level. Further, when the terminal contact point portion 662*e* of the contact point spring 662 is rotated in the counterclockwise direction from the start position 670 to the position of 360 degree, the contact point spring 662 returns again to the initial state shown by FIG. 33.

According to the constitution, when the transmission 620 is rotated by one rotation, both of the A pattern input terminal and the B pattern input terminal of the control circuit are provided with the "1" level only once for an hour. Further, before both of the A pattern input terminal and the B pattern input terminal are provided with the "1" level, the B pattern input terminal is provided with the "1" level by which "reverse rotation" can be determined.

Accordingly, when the transmission wheel 620 is constituted to rotate once per 24 hours, the rotational position detecting signal for detecting the "reverse rotation" is inputted to the control circuit (not illustrated) every 24 hours. At the same time, both of the A pattern input terminal and the B pattern input terminal are provided with the "1" level by which the position of the transmission wheel 620 in the circumferential direction can be detected.

Figure 14:
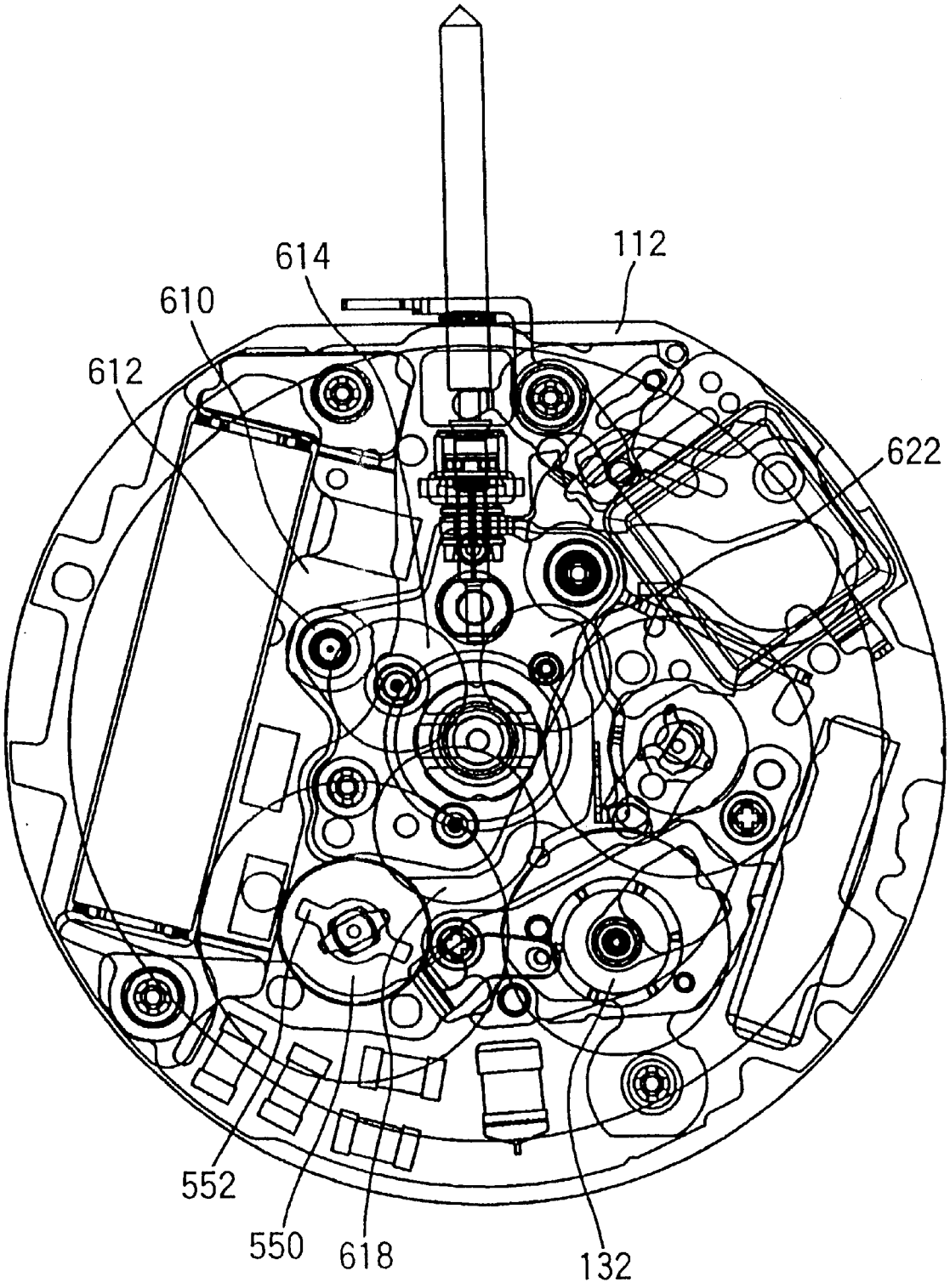
FIG. 14 is an outline plane view (perspective view) showing an obverse side portion of an electronic timepiece according to a sixth embodiment of the invention.

(7) Entire constitution of electronic timepiece according to sixth embodiment of the invention FIG. 14 shows an obverse side portion of a movement (machine body) of the electronic timepiece according to a sixth embodiment of the invention. Here, the "obverse side portion" designates a portion thereof on a side of the main plate opposed to a side thereof provided with a dial 570.

Figure 15:
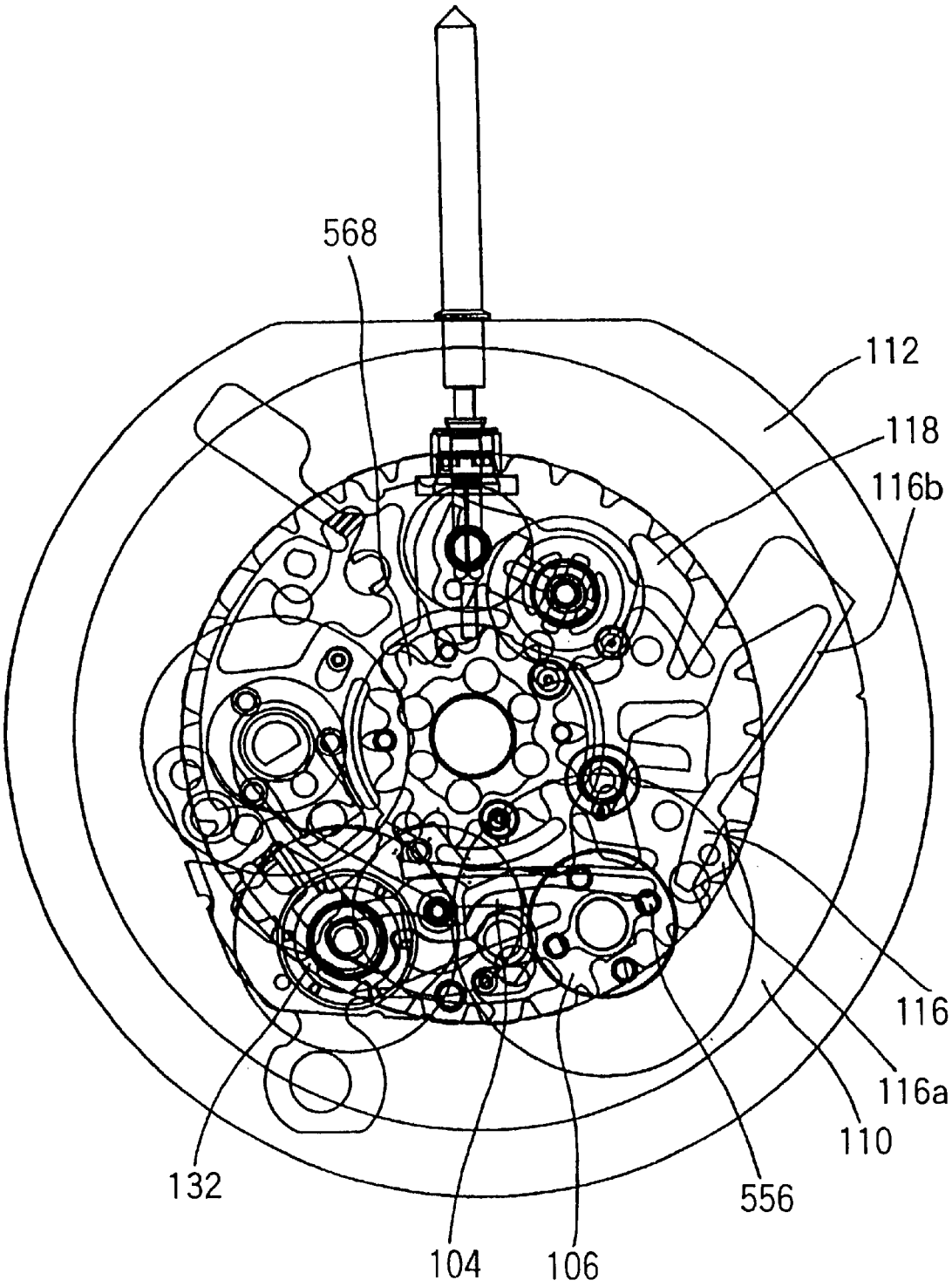
FIG. 15 is an outline plane view (perspective view) showing a reverse side portion of the electronic timepiece according to the sixth embodiment of the invention.
Figure 16:
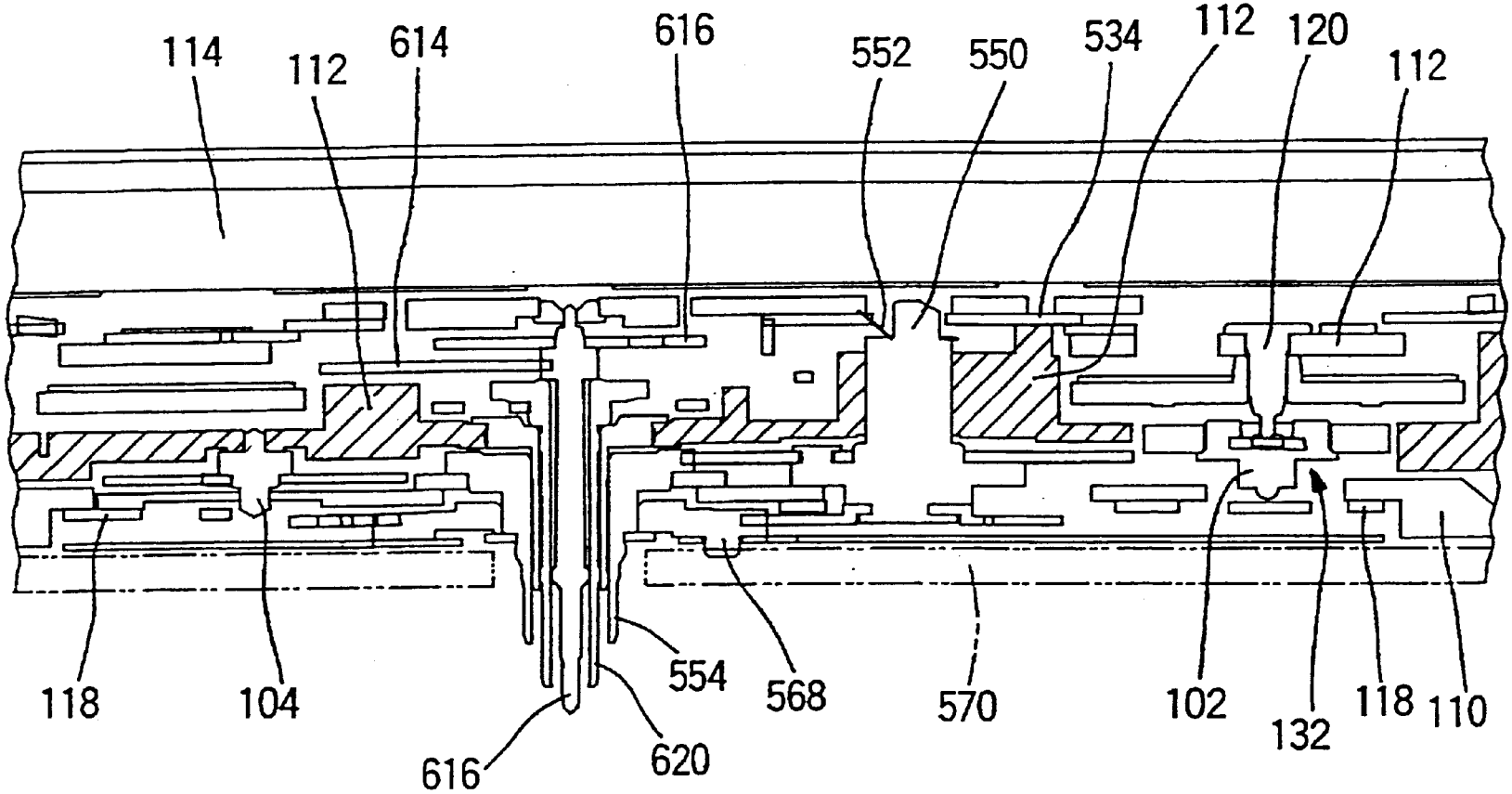
FIG. 16 is an outline partial sectional view showing the sixth embodiment of the electronic timepiece according to the invention.
Figure 17:
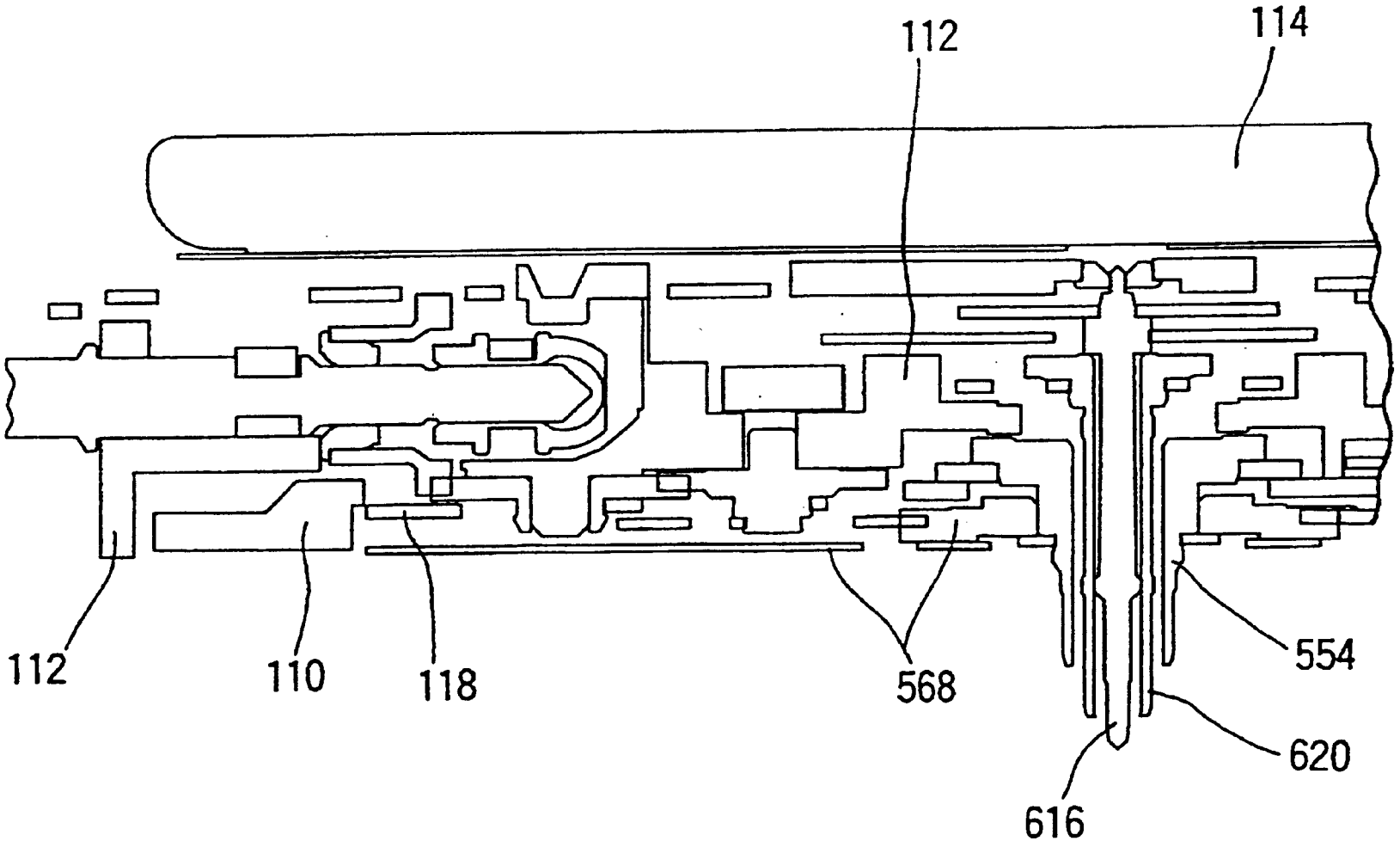
FIG. 17 is an outline partial sectional view showing the sixth embodiment of the electronic timepiece according to the invention.
Figure 18:
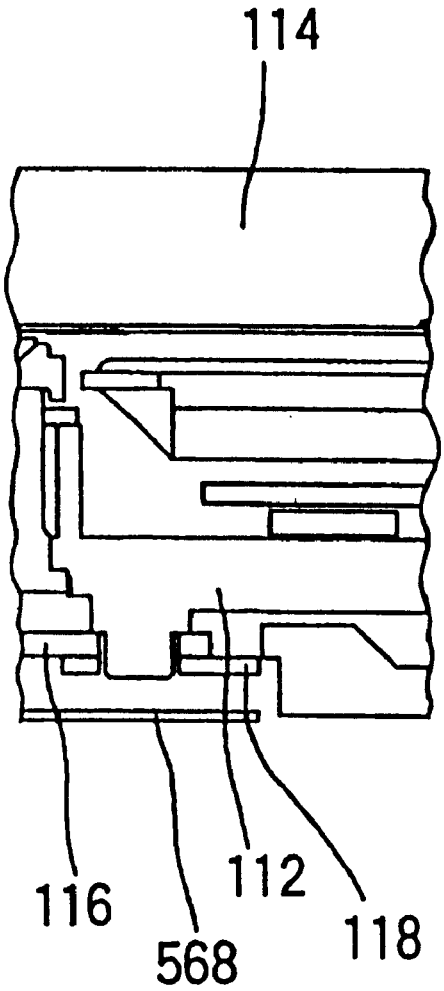
FIG. 18 is an outline partial sectional view showing the sixth embodiment of the electronic timepiece according to the invention.
Figure 19:
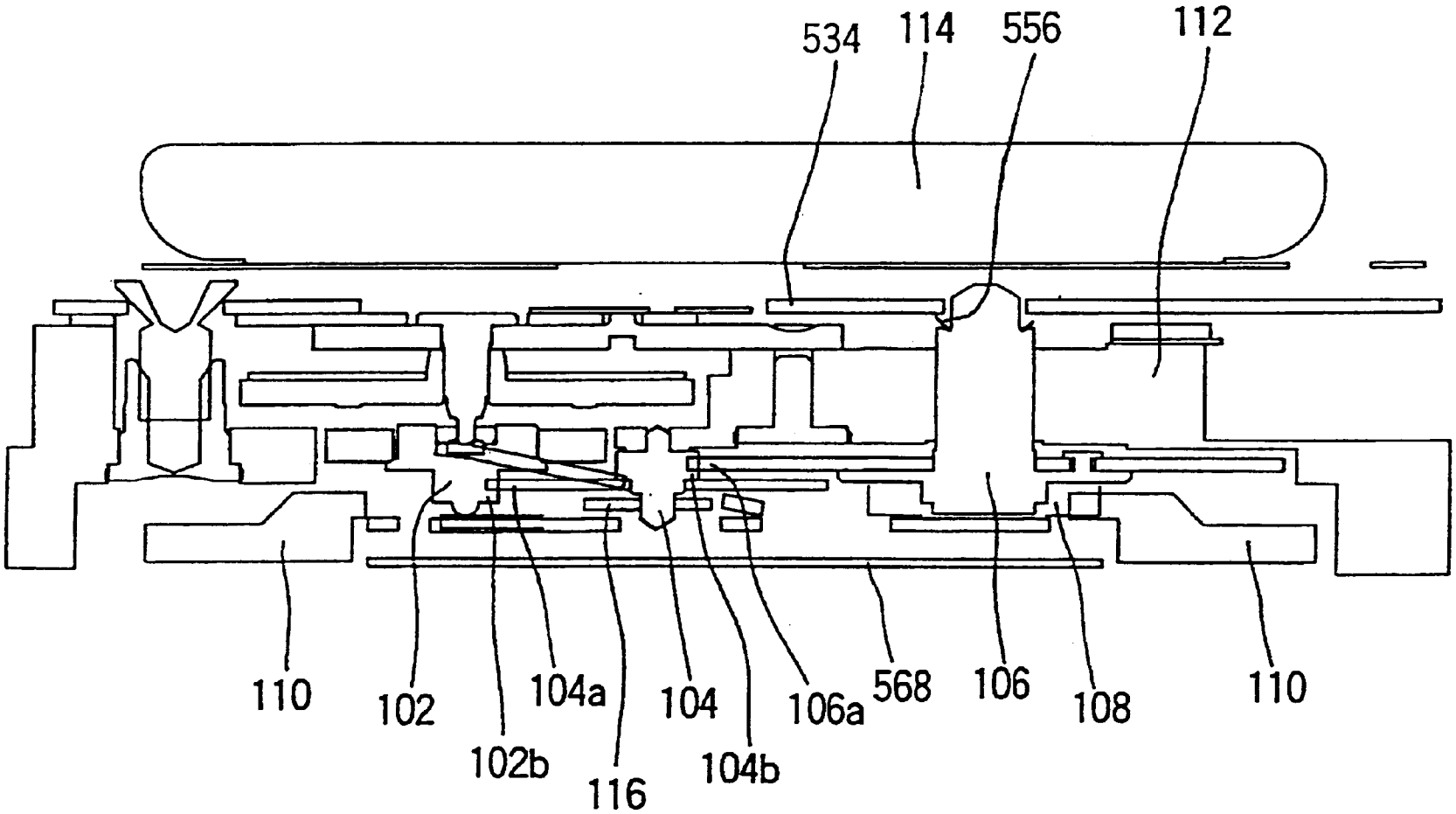
FIG. 19 is an outline partial sectional view showing the sixth embodiment of the electronic timepiece according to the invention.
Figure 20:
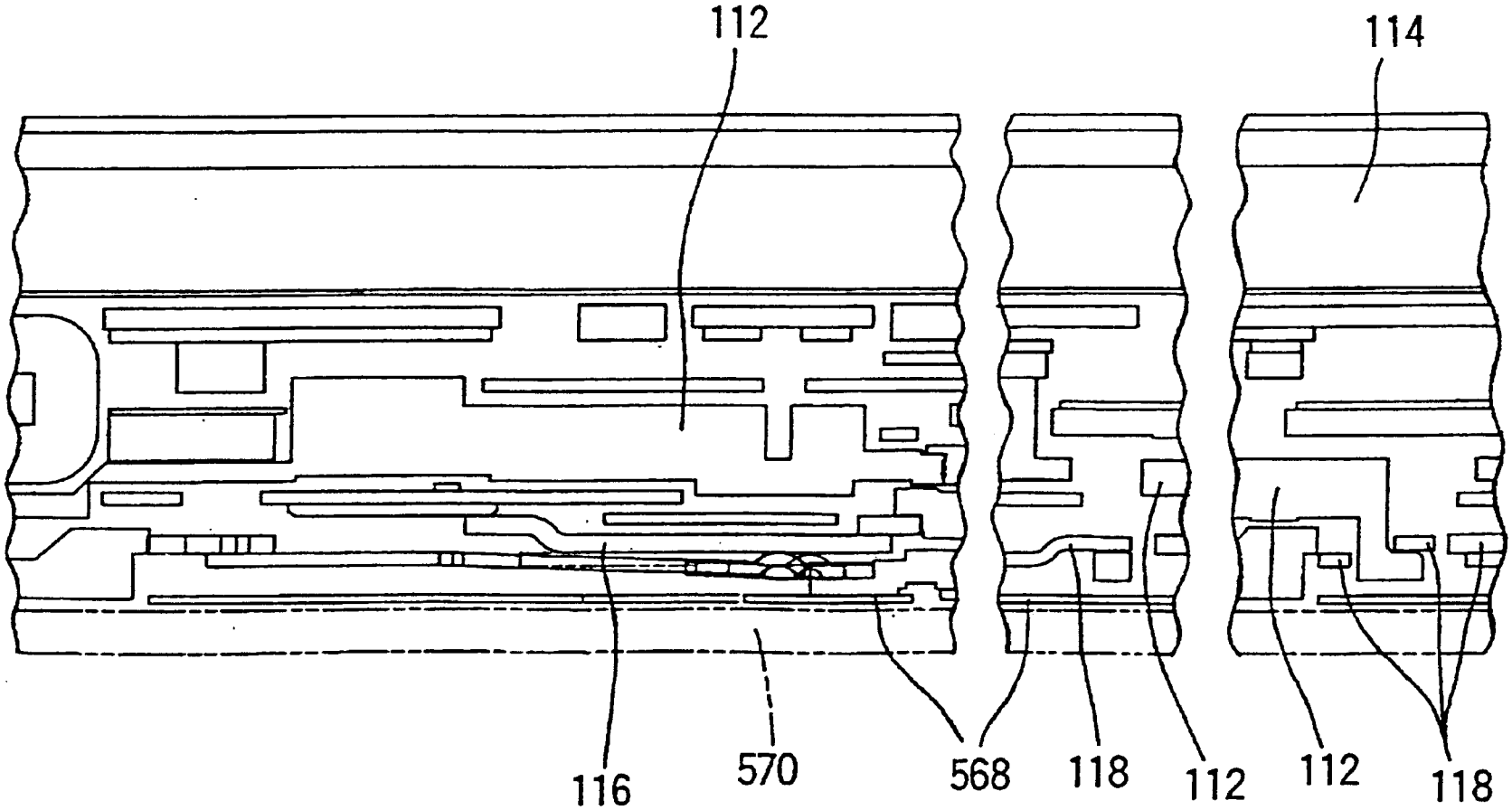
FIG. 20 is an outline partial sectional view showing the sixth embodiment of the electronic timepiece according to the invention.

FIG. 15 shows a reverse side portion of the movement (machine body) of the electronic timepiece according to the sixth embodiment of the invention. Here, "reverse side portion" designates a portion thereof on the side of the main plate provided with the dial 570. That is, the date indicator is integrated to the "rear side portion".

The movement (machine body) of the electronic timepiece according to the sixth embodiment of the invention shown by FIG. 14 through FIG. 20 is provided also with the contact point spring.

In reference to FIG. 14 through FIG. 20, according to the sixth embodiment of the invention, the electronic timepiece is provided with the main plate 112. A rotor 612 of a step motor 610 is in mesh with a fifth wheel & pinion 614 and the fifth wheel pinion is in mesh with a fourth wheel & pinion 616. By rotating the fourth wheel & pinion 616, a center wheel & pinion 620 is rotated via a third wheel & pinion 618, further, an hour wheel 554 is rotated via a minute wheel 622.

The 24-hour wheel 550 is provided with the 24-hour contact point spring 552. The 24-hour contact point spring 552 is arranged to be able to be brought into contact with the first pattern (not illustrated) of the circuit block 534. The 24-hour wheel 550 is in mesh with the hour wheel 554 and is rotated once per day. The hour wheel 554 is rotated once per 12 hours and indicates "hour" by an hour hand (not illustrated) attached to the hour wheel 554.

The ultrasonic rotor axle 120 of the ultrasonic motor 132 is fixed to the main plate 112 and the ultrasonic rotor 102 is rotatably integrated to the ultrasonic rotor axle 120.

The ultrasonic rotor pinion 102*b* of the ultrasonic rotor 102 is in mesh with the intermediate driving gear wheel 104*a* of the intermediate date driving wheel 104. The intermediate date driving pinion 104*b* of the intermediate date driving wheel 104 is in mesh with the date driving gear wheel 106*a* of the date driving wheel 106.

The date finger 108 is provided on the date driving wheel 106 and the date indicator 110 simultaneously rotated by rotation of the date driving wheel 106 is rotatably integrated to the main plate 112. The battery 114 is integrated to the side of the main plate 112 opposed to the side attached with the date indicator 110.

The date jumper 116 is integrally formed with the date indicator holder 118. The regulating portion 116*a* of the date jumper 116 regulates the date indicator teeth 110*a*. The date jumper 116 is provided with the date jumper spring portion 116*b*.

That is, the date driving wheel 106 is provided with the date driving wheel contact point spring 556. The date driving wheel contact point spring 556 is arranged to be able to be brought into contact with the second pattern (not illustrated) of the circuit block 534.

According to the embodiment of the electronic timepiece of the invention shown by FIG. 14 through FIG. 20, the day of the week indicator 568 is provided and indicates a day of the week.

Further, indication of a day of the week may be constituted to carry out by the day of the week indicator rotated by rotation of the ultrasonic motor.

Figure 39:
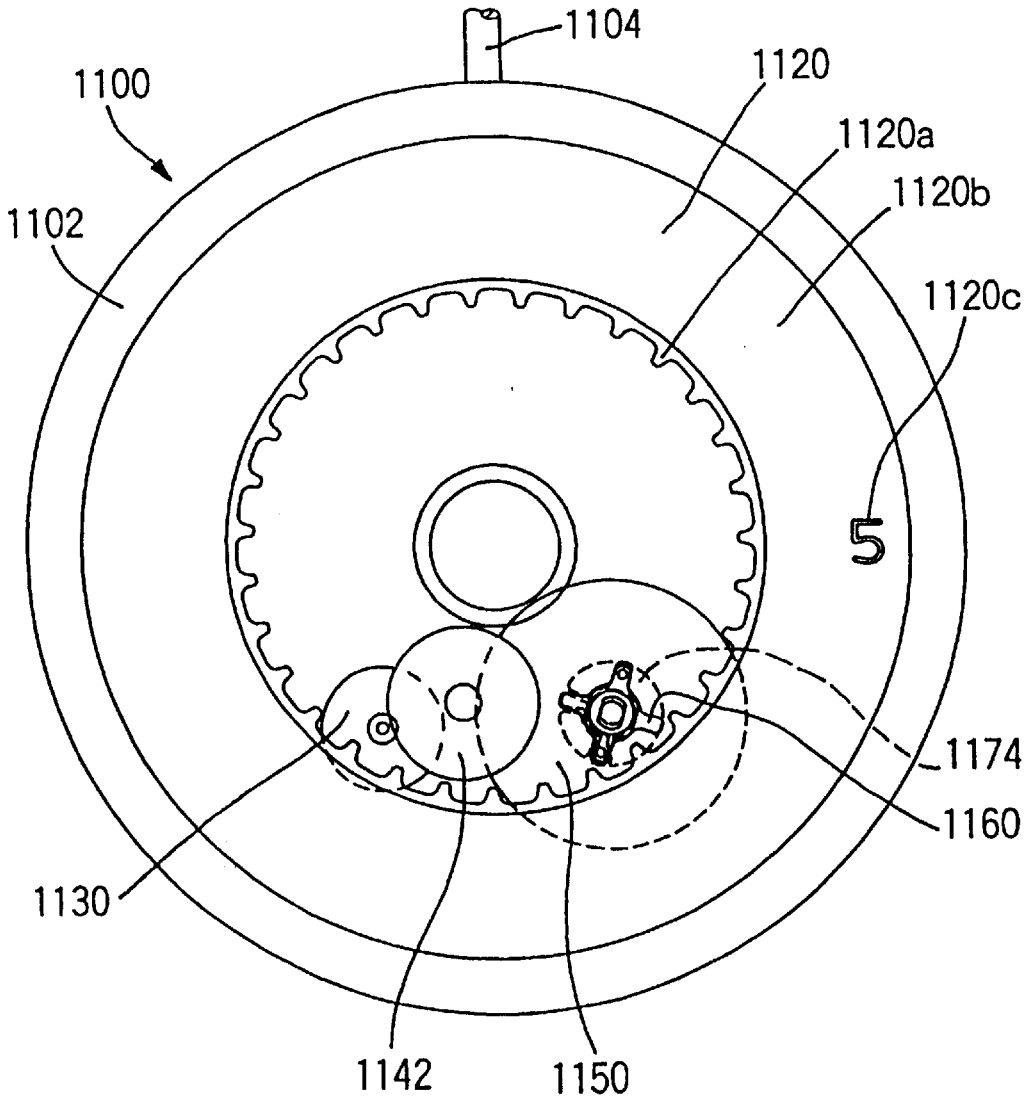
FIG. 39 is an outline plane view showing a structure of a reverse side of the electronic timepiece according to a seventh embodiment of the invention.
Figure 40:
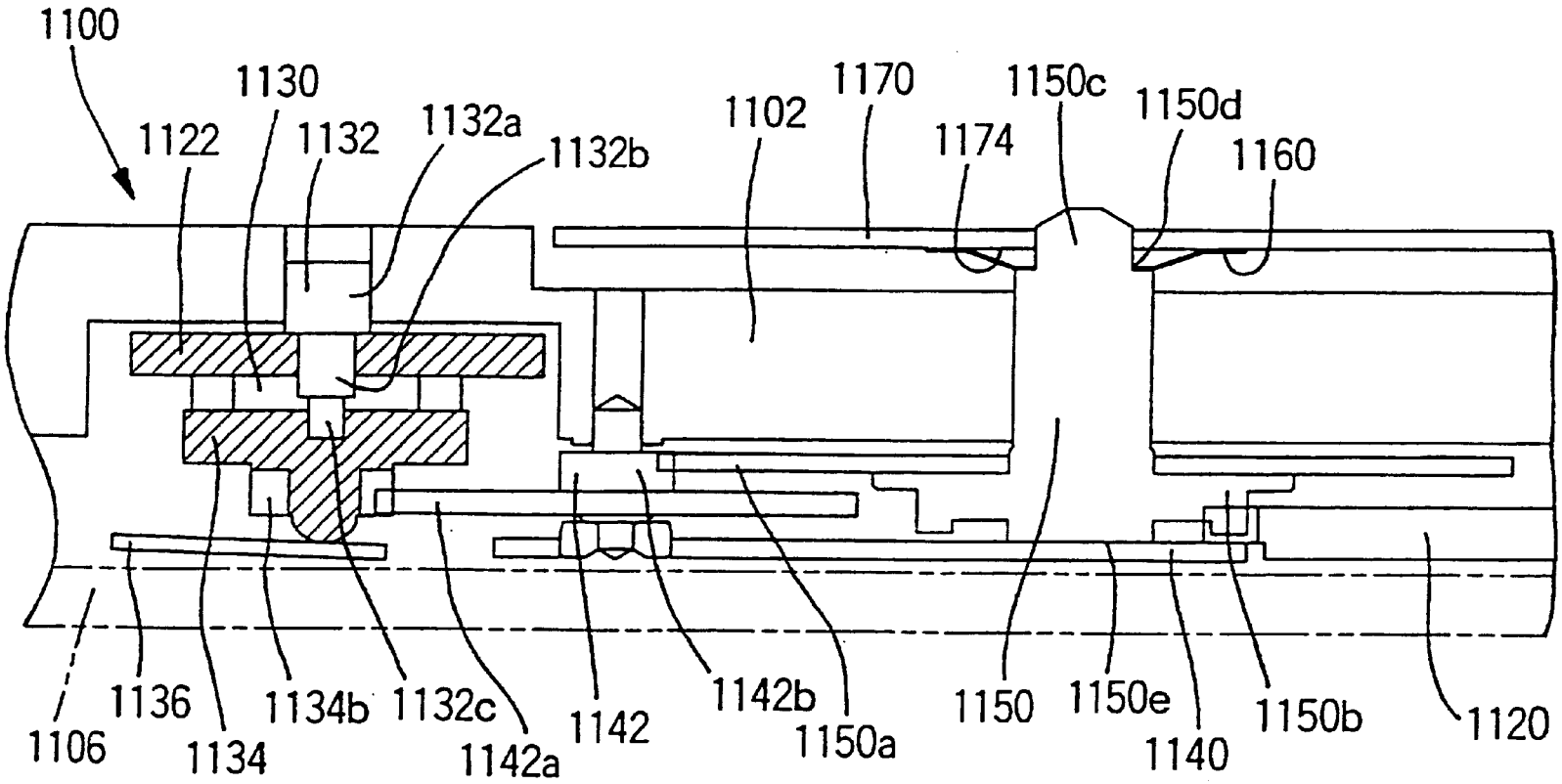
FIG. 40 is a partial sectional view showing structures of an indication wheel driving mechanism and an indication wheel driving detecting mechanism of the electronic timepiece according to the seventh embodiment of the invention.

(8) Structure and operation of indication wheel drive detecting mechanism of the electronic timepiece according to seventh embodiment of the invention In reference to FIG. 39 and FIG. 40, according to a seventh embodiment of the electronic timepiece of the invention, a movement (machine body) 1100 is constituted by an analog electronic timepiece and is provided with a main plate 1102 constituting a base plate of the movement. A hand setting stem 1104 is rotatably integrated to a hand setting stem guide hole of the main plate 1102. A dial 1106 is attached to the movement 1100. A switch device (not illustrated) operated by operating the hand setting stem 1104 is provided in the main plate 1102.

A side in both sides of the main plate 1102 having the dial 1106 is referred to as "rear side" of the movement 1100 and a side thereof opposed to the side having the dial 1106 is referred to as "obverse side" of the movement 1100. A wheel train integrated to the "obverse side" of the movement 1100 is referred to as an "obverse wheel train" and a wheel train integrated to the "rear side" of the movement 1100 is referred to as a "reverse wheel train".

The switch device may be integrated to the "obverse side" of the movement 1100 or may be integrated to the "rear side" of the movement 1100. An indication wheel such as a date indicator, a day of the week indicator or the like is integrated to the "rear side" of the movement 1100.

A date indicator 1120 is rotatably arranged to the main plate 1102. The date indicator 1120 includes a date indicator wheel gear portion 1120*a* and a date character print portion 1120*b*. Date characters 1120*c* of from "1" to "31" are printed at the date character print portion 1120*b*. Only "5" in the date characters 1120*c* is illustrated in FIG. 39 to simplify the drawings. The date indicator wheel gear portion 1120*a* includes 31 of date indicator teeth.

An ultrasonic motor 1130 for rotating the date indicator 1120 is arranged at the main plate 1102. The motor for rotating the date indicator 1120 may be an electromagnetic motor or a step motor. By using the ultrasonic motor 1130, the date indicator 1120 can firmly be rotated by a small number of reduction wheel trains.

An indication wheel rotated by the ultrasonic motor 1130 may be a date indicator, may be a day of the week indicator, or other kind of wheel indicating information in respect of time or calendar, for example, hour indicator, month indicator, year indicator, moon age indication wheel or the like.

The ultrasonic motor 1130 is provided with a motor axle 1132, an ultrasonic stator 1122 and an ultrasonic rotor 1134. According to the motor axle 1132, a first axle portion 1132*a* is fixed to the main plate 1102, the ultrasonic stator 1122 is fixed to a second axle portion 1132*b* and the ultrasonic rotor 1134 is rotatably guided by a third axle portion 1132*c*. There is provided a pressurizing spring 1136 for pressing the ultrasonic rotor 1134 to the ultrasonic stator 1122 by an elastic force.

A date indicator holder 1140 supports the date indicator 1120 rotatably relative to the main plate 1102. An intermediate date driving wheel 1142 is rotatably supported by the main plate 1102 and the date indicator holder 1140. The intermediate date driving wheel 142 is provided with an intermediate date driving gear wheel 1142*a* and an intermediate date driving pinion 1142*b*. An ultrasonic rotor pinion 1134*b* is in mesh with the intermediate date driving gear wheel 1142*a*.

A date driving wheel 1150 is rotatably supported by the main plate 1102. The date driving wheel 1150 is provided with a date driving gear 1150*a*, a date driving gear portion 1150*b*, a front end axle portion 1150*c*, a spring guiding portion 1150*d* and a support portion 1150*e*. The date driving gear 1150*a* is in mesh with the intermediate date driving pinion 1142*b*. The date driving gear portion 1150*b* is in mesh with the date indicator gear portion 1120*a*. The date driving gear portion 1150*b* includes 4 of date driving teeth. An end face of the support portion 1150*e* is brought into contact with the date indicator holder 1140.

A contact point spring 1160 is arranged at the spring guiding portion 1150*d*. The contact point spring 1160 is constituted to rotate integrally with the date driving wheel 1150 by rotation of the date driving wheel 1150. For example, the contact point spring 1160 is fitted unrotatably to the spring guiding portion 1150*d*.

Figure 41:
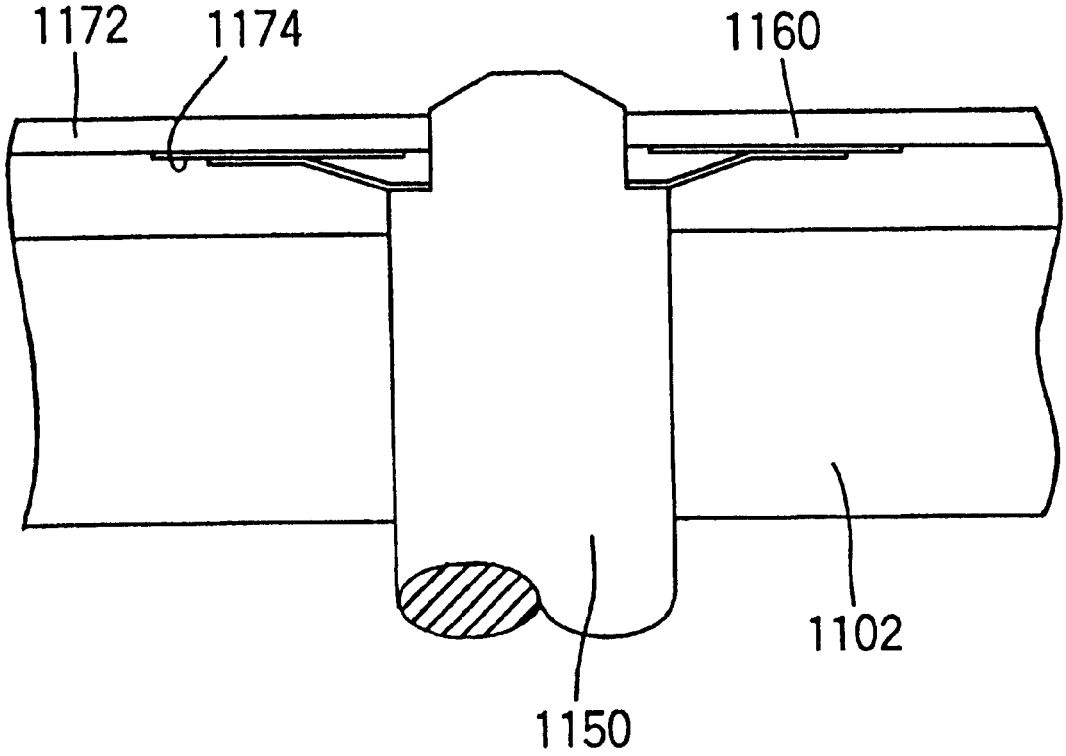
FIG. 41 is a partial sectional view showing a structure of a date driving wheel and a contact point spring of the electronic timepiece according to the seventh embodiment of the invention.

In reference to FIG. 40 and FIG. 41, a circuit block 1172 is provided to the movement 1100. The circuit block 1172 includes a printed circuit board 1170, an integrated circuit and a quartz oscillator (not illustrated). A contact point pattern 1174 is formed on the printed circuit board 1170. The contact point spring 1160 is rotatably provided to be brought into contact with the contact point pattern 1174 and to be detached from the contact point pattern 1174. The contact point pattern 1174 is conducted to the integrated circuit.

A state of rotating the date driving wheel 1150 can be detected by bringing the contact point spring 1160 into contact with the contact point pattern 1174.

When the contact point spring 1160 is brought into contact with the contact point pattern 1174, a rotational signal in respect of the state of rotating the date driving wheel 1150 outputted from the contact point pattern 1174 is inputted to an ultrasonic motor driving circuit.

Figure 42:
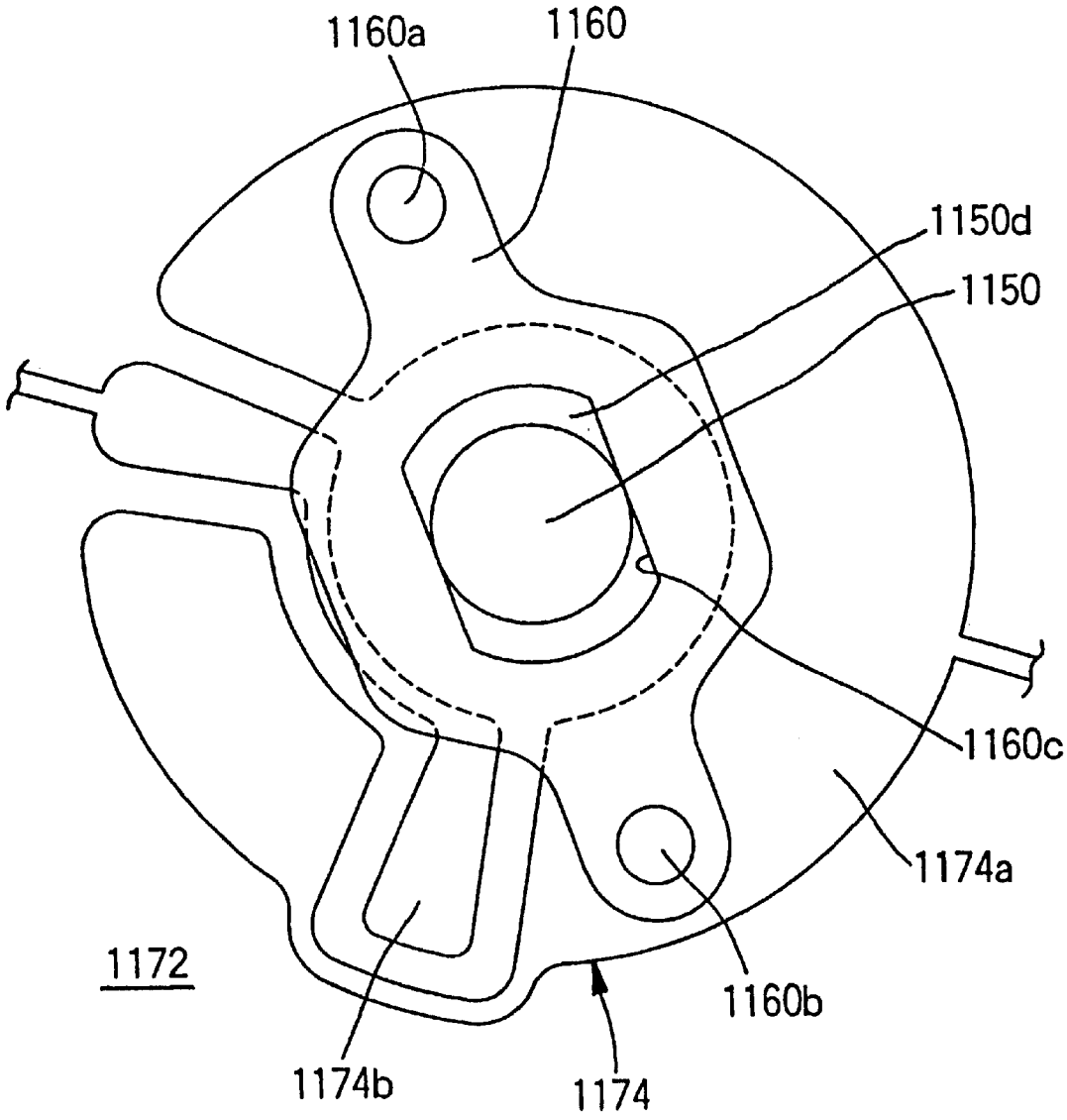
FIG. 42 is a partial sectional view showing a relationship between the contact point spring and a contact point pattern in a state in which contact points are made ON of the electronic timepiece according to the seventh embodiment of the invention.

In reference to FIG. 42, the contact point pattern 1174 includes a reference potential pattern 1174*a* and a contact point switch pattern 1174*b*. The reference potential pattern 1174*a* is conducted to one potential of a battery (not illustrated), for example, plus potential. The contact point switch pattern 1174*b* is conducted to a contact point switch terminal of the integrated circuit.

The contact point spring 1160 includes a first contact point portion 1160*a*, a second contact point portion 1160*b* and a long hole 1160*c*. The long hole 1160*c* is arranged at the spring guiding portion 1150*d* of the date driving wheel 1150 and the contact point spring 1160 is constituted to rotate integrally with the date driving wheel 1150.

The first contact point portion 1160*a* is extended in a first direction from the long hole 1160*c* and the second contact point portion 1160*b* is extended in a second direction from the long hole 1160*c*. The first direction and the second direction are constructed to constitute an angle of 180 degree with the long hole 1160*c* as a reference. The first contact point portion 1160*a* and the second contact point portion 1160*b* are provided to be brought into contact with the contact point pattern 1174 by an elastic force. The contact point spring 1160 is constituted by an elastic material having a conductivity of, for example, stainless steel or the like.

By rotating the date driving wheel 1150, the first contact point portion 1160*a* and the second contact point portion 1160*b* can be brought into contact with the respective patterns in the order of the reference potential pattern 1174*a* and the contact point switch pattern 1174*b*.

As shown by FIG. 42, in a state in which both of the contact point portion 1160*a* and the second contact point portion 1160*b* are brought into contact with the reference potential pattern 1174*a*, the rotational signal is not outputted.

Figure 43:
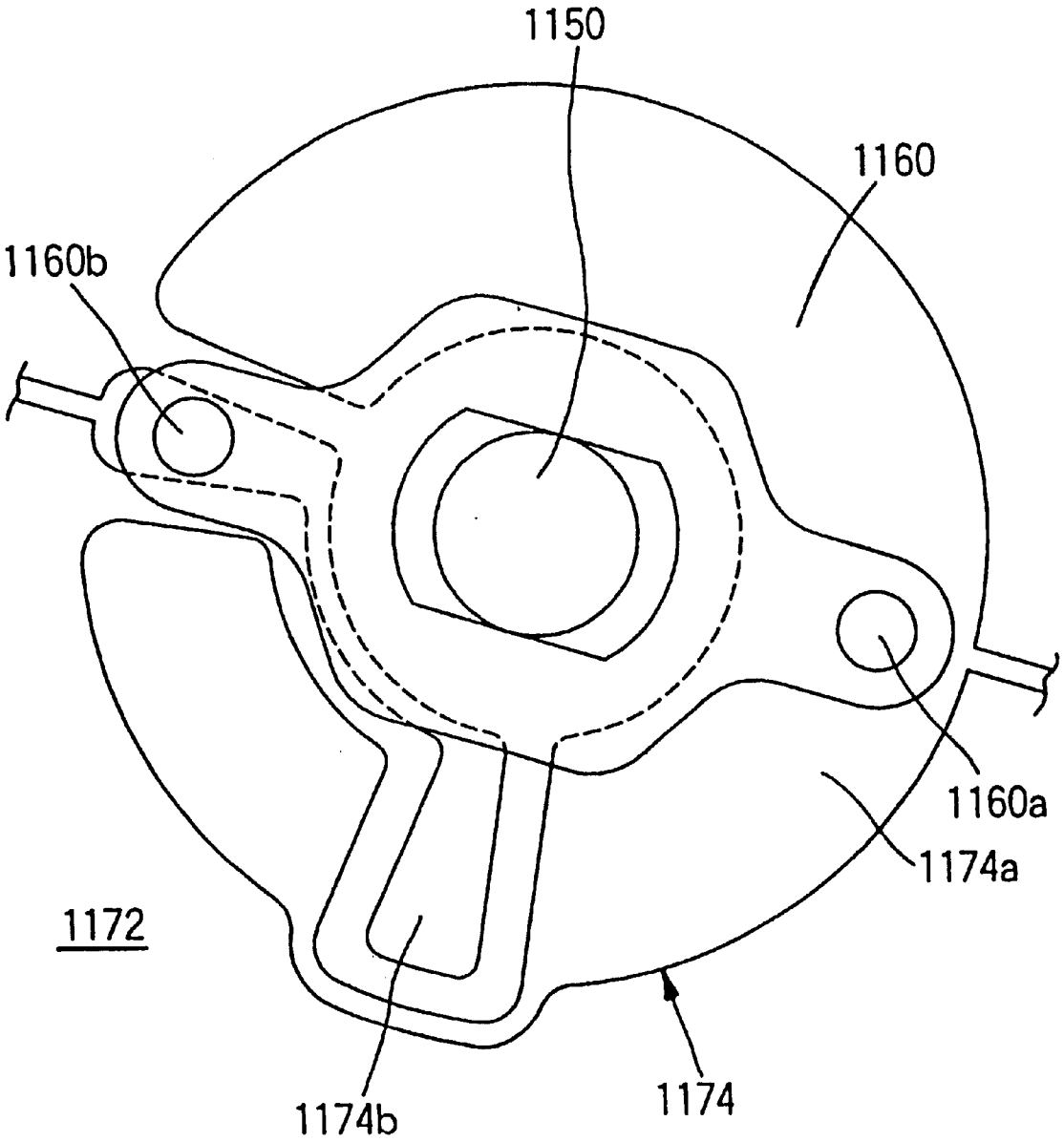
FIG. 43 is a partial sectional view showing the relationship between the contact point spring and the contact point pattern in a state in which the contact points are made OFF of the electronic timepiece according to the seventh embodiment of the invention.

In contrast thereto, as shown by FIG. 43, in a state in which the first contact point portion 1160*a* is brought into contact with the reference potential pattern 1174*a* and the second contact point portion 1160*b* is brought into contact with the contact point switch pattern 1174*b*, the rotation signal is outputted. Similarly, also in a state in which the first contact point portion 1160*a* is brought into contact with the contact point switch pattern 1174*b* and the second contact point portion 1160*b* is brought into contact with the reference potential pattern 1174*a*, the rotation signal is outputted.

The rotation signal is not outputted in the state in which neither of the first contact point portion 1160*a* and the second contact point portion 1160*b* is brought into contact with the contact point switch pattern 1174*b*.

(9) Structure and operation of obverse side of electronic timepiece according to seventh embodiment of the invention Next, an explanation will be given of a structure of an obverse side of the electronic timepiece according to a seventh embodiment of the invention is as follows.

Figure 44:
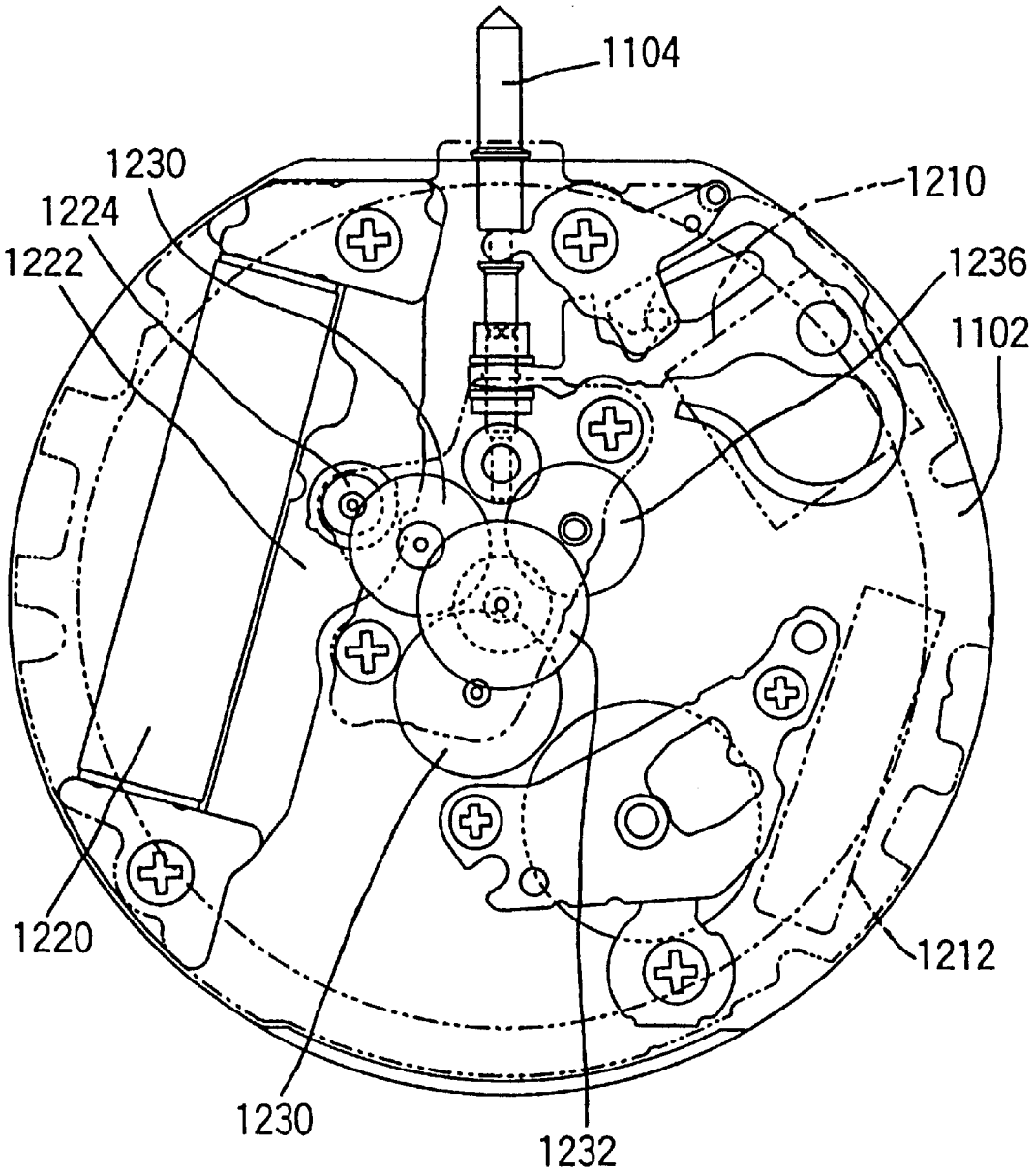
FIG. 44 is an outline plane view showing a structure of an obverse side of the electronic timepiece according to the seventh embodiment of the invention.
Figure 45:
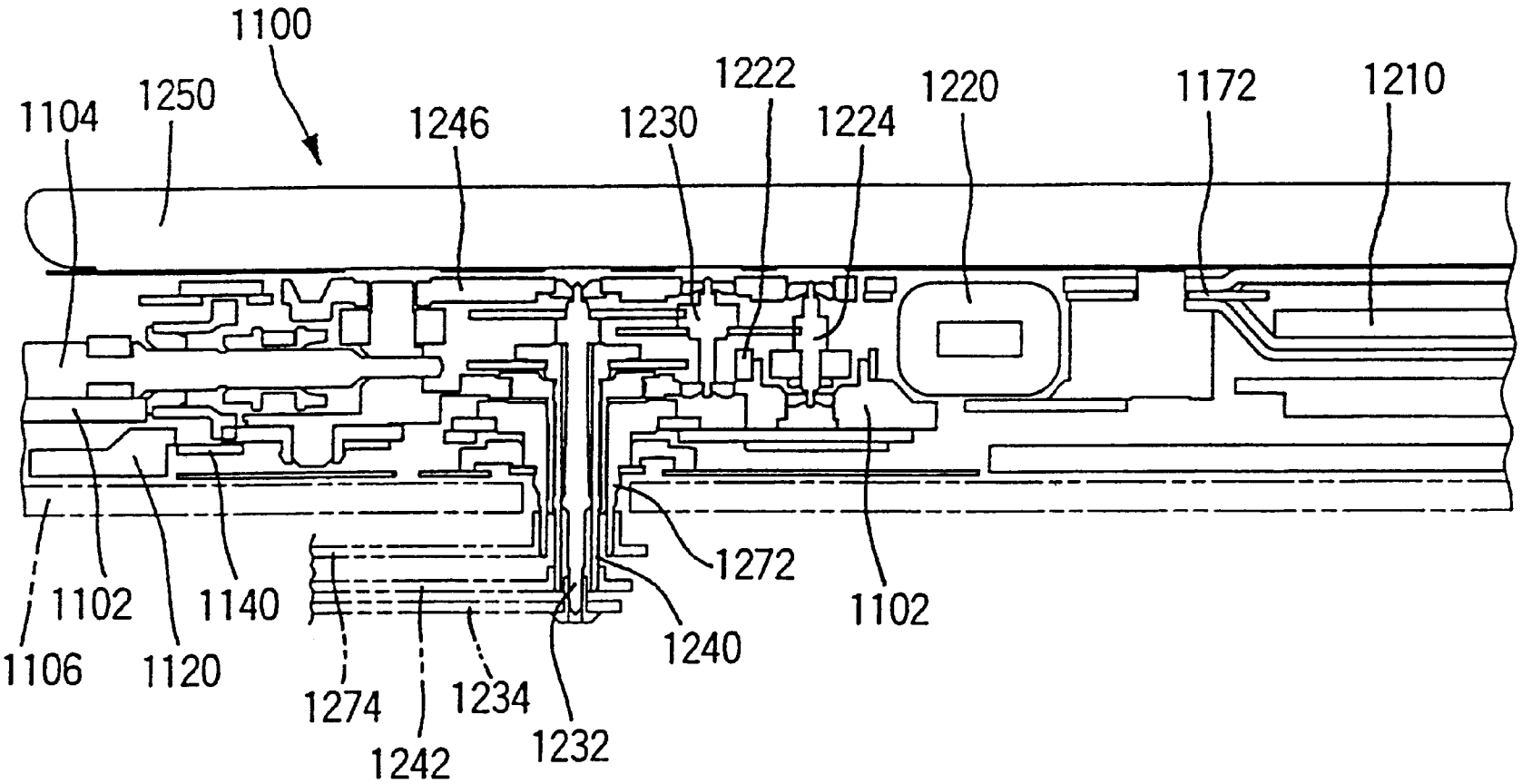
FIG. 45 is a partial sectional view showing a structure of an obverse wheel train of the electronic timepiece according to the seventh embodiment of the invention.

In reference to FIG. 44 and FIG. 45, the circuit block 1172 is arranged on the obverse side of the movement 1100 and the circuit block 1172 is provided with the printed circuit board 1170, an integrated circuit 210 and a quartz oscillator 1212.

The movement 1100 is provided with a coil block 1220. a stator 1222 and a rotor 1224. A fifth wheel & pinion 1230 is arranged to rotate based on rotation of the rotor 1224. A fourth wheel & pinion 1232 is arranged to rotate based on rotation of the fifth wheel & pinion 1230. A second hand 1234 for indicating "second" is attached to the fifth wheel & pinion 1232. A third wheel & pinion 1236 is arranged to rotate based on rotation of the fourth wheel & pinion 1232. A minute indicator 1240 is arranged to rotate based on rotation of the third wheel & pinion 1236. A minute hand 1242 for indicating "minute" is attached to the minute indicator 1240. A battery 1250 is arranged on the circuit block 1172 and a wheel train bridge 1246.

Next, an explanation will be given of operation of a timepiece with indication wheel according to the invention.

Figure 46:
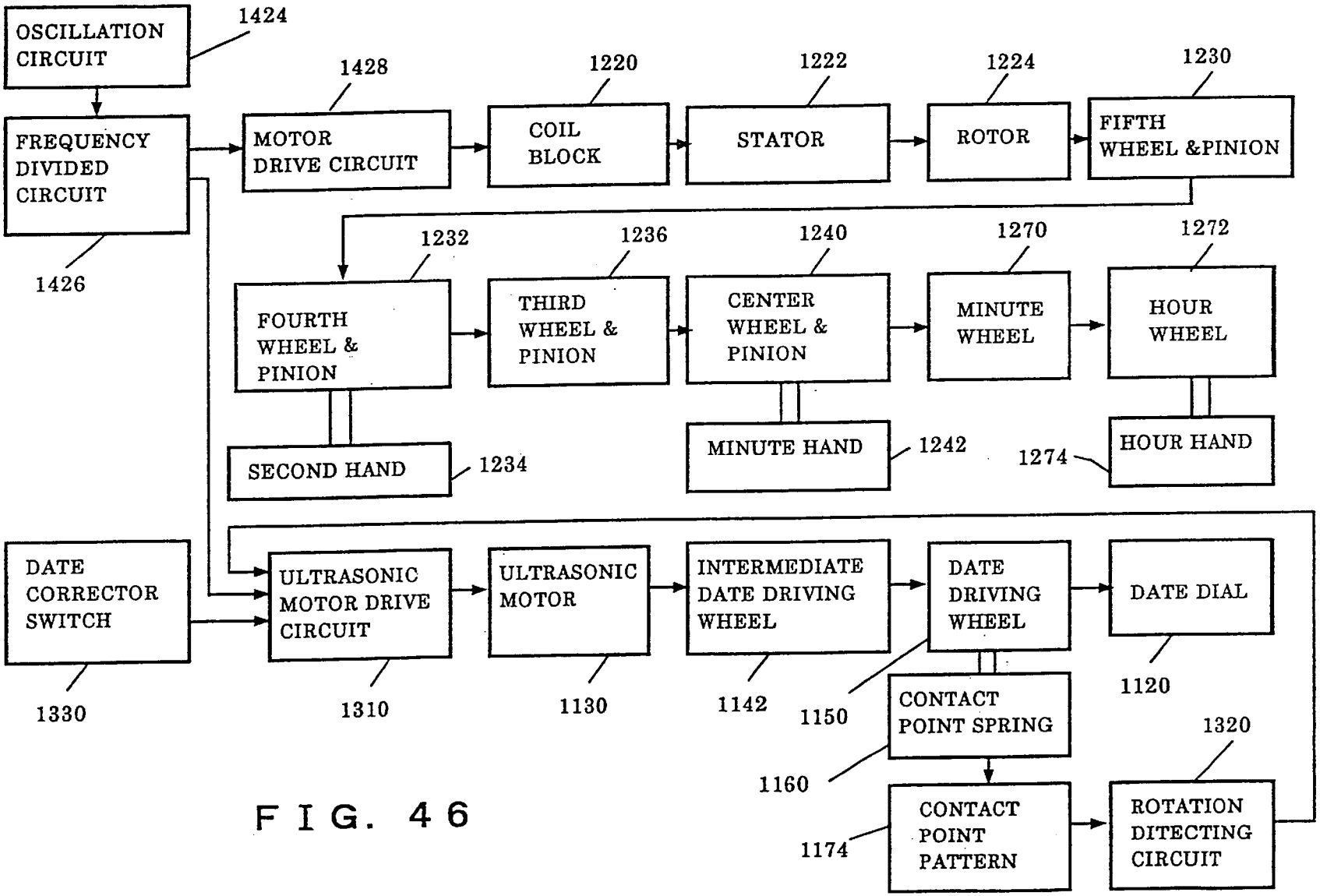
FIG. 46 is a block diagram showing the electronic timepiece according to the seventh embodiment of the invention.

In reference to FIG. 46, an oscillating circuit 1424 outputs a reference signal. The oscillating circuit 1424 includes the quartz oscillator 1212 constituting a source of oscillation. The quartz oscillator 1212 is oscillated at, for example, 32,768 Hz. Based on oscillation of the quartz oscillator 1212, a frequency dividing circuit 1426 divides an output signal from the oscillating circuit 1424. A motor driving circuit 1428 outputs a motor drive signal for driving the step motor based on an output signal from the frequency dividing circuit 1246. The oscillating circuit 1424, the frequency dividing circuit 1426 and the motor driving circuit 1428 are incorporated in the integrated circuit 1210.

When the coil block 1220 inputs the motor drive signal, the stator 1222 is magnetized and rotates the rotor 1224. The rotor 1224 is rotated by, for example, 180 degree per second.

Based on rotation of the rotor 1224, the fourth wheel & pinion 1232 is rotated via rotation of the fifth wheel & pinion 1230. The fourth wheel & pinion 1232 is constituted to rotate once per minute. The second hand 1234 is rotated integrally with the fourth wheel & pinion 1232.

The minute indicator 1240 is rotated based on rotation of the third wheel & pinion 1236. The minute hand 1242 is rotated integrally with the minute indicator 1240. A slip mechanism (not illustrated) is provided to the minute indicator 1240. When the hand is set by the slip mechanism, in a state in which the second hand 1234 is stopped, the hand setting stem 1104 is rotated by which the minute hand 1242 and the hour hand can be rotated. The minute indicator 1240 is rotated by once per hour.

The minute wheel 1270 is rotated based on rotation of the minute indicator 1240. The hour wheel 1272 is rotated based on rotation of the minute wheel 1270. The hour wheel 1272 is rotated once per 12 hours. An hour hand 1274 is attached to the hour wheel 1272. The hour hand 1274 is rotated integrally with the hour wheel 1272.

An ultrasonic motor driving circuit 1310 outputs an ultrasonic motor drive signal for driving the ultrasonic motor 1130 based on an output signal from the frequency dividing circuit 1426. The ultrasonic motor driving circuit 1310 is incorporated in the integrated circuit 1210.

The intermediate date driving wheel 1142 is rotated based on rotation of the ultrasonic motor 1130. The date driving wheel 1150 is rotated based on rotation of the intermediate date driving wheel 1142. By rotating the date driving wheel 1150, the date driving gear portion **1150*b* rotates the date indicator 1120. A signal outputted from the ultrasonic motor driving circuit 1310 is outputted to rotate the date indicator 1120** by one tooth per day.

By rotating the date driving wheel 1150, the contact point spring 1160 is rotated. By rotating the contact point spring 1160, there is brought about a state in which the first contact point portion **1160*a* is brought into contact with the reference potential pattern 1174*a* and the second contact point portion 160*b* is brought into contact with the contact point switch pattern 1174*b*. In the state, the rotation signal is outputted to a rotation detecting circuit 1320. The rotation detecting circuit 1320 is incorporated in the integrated circuit 1210**.

When the rotation detecting circuit 1320 inputs the rotation signal, the rotation detecting circuit 1320 outputs an ultrasonic motor control signal to the ultrasonic motor driving circuit 1310. When the ultrasonic motor driving circuit 1310 inputs the ultrasonic motor control signal, the ultrasonic motor driving circuit 1310 stops outputting the ultrasonic motor drive signal. By constructing such a constitution, rotation of the date indicator 1120 can be controlled.

Further, by rotating the date driving wheel 1150, there is brought about a state in which the first contact point portion **1160*a* is detached from the reference potential pattern 1174*a* and is brought into contact with the contact point switch pattern 1174*b* and the second contact point portion 1160*b* is detached from the contact point switch pattern 1174*b* and is brought into contact with the reference potential pattern 1174*a*. Also in this state, the rotation signal is outputted to the rotation detecting circuit 1320**.

When the rotation detecting circuit 1320 inputs the rotation signal, the rotation detecting circuit 1320 outputs the ultrasonic motor control signal to the ultrasonic motor driving circuit 1310 to control operation of the ultrasonic motor 1130. When the ultrasonic motor driving circuit 1310 inputs the ultrasonic motor control signal, the ultrasonic motor driving circuit 1310 stops outputting the ultrasonic motor drive signal.

By constructing such a constitution, the date indicator 1120 can be rotated by one tooth per day.

The date indicator 1120 is constituted to be able to rotate by operating a date correction switch 1330. When the date correction switch 1330 is operated, the ultrasonic motor driving circuit 1310 outputs the ultrasonic motor drive signal for driving the ultrasonic motor 1130. By the constitution, indication of the date indicator 1120 can be changed. The date correction switch 1330 may be constituted to operate by operating the hand setting stem 1104 or may be provided with a button or the like for operating the date correction switch 1330.

(10) Structure and operation of the electronic timepiece according to an eighth embodiment of the invention Next, an explanation will be given of a structure of a calendar mechanism of the electronic timepiece according to an eighth embodiment of the invention.

Figure 47:
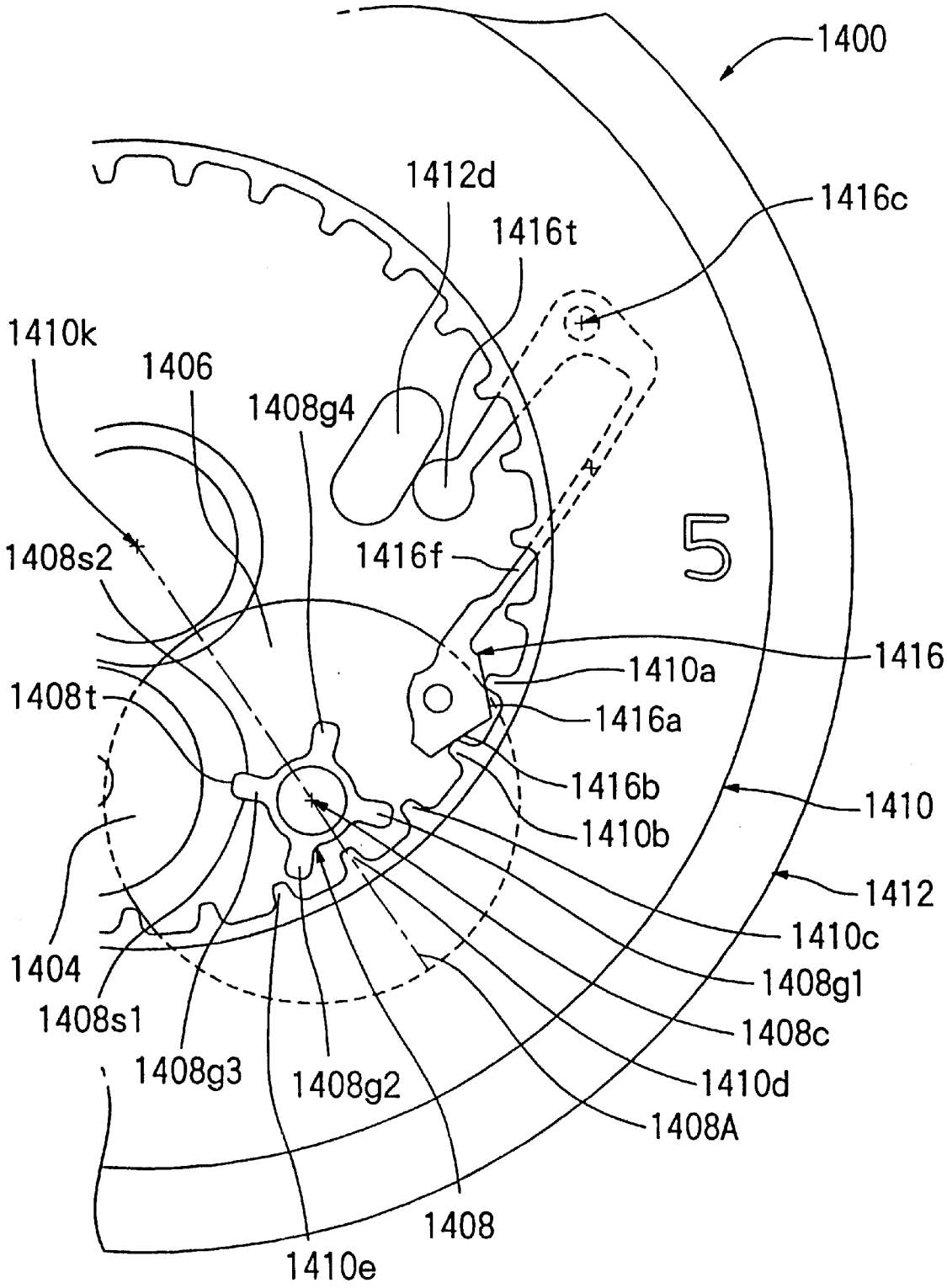
FIG. 47 is an outline plane view showing a calendar mechanism portion of the electronic timepiece having a date finger in a first shape of the electronic timepiece according to an eighth embodiment of the invention.

In reference to FIG. 47, according to the eighth embodiment of the invention, in an electronic timepiece with calendar 1400, there is used an ultrasonic motor (not illustrated) as a motor for rotating a date indicator 1410. The ultrasonic motor includes an ultrasonic rotor. An ultrasonic rotor pinion of the ultrasonic rotor is in mesh with an intermediate date driving gear of an intermediate date driving wheel 1404. An intermediate date driving pinion of the intermediate date driving wheel 1404 is in mesh with a date driving wheel 1406.

A date finger 1408 is provided at the date driving wheel 1406 and is simultaneously rotated by rotation of the date driving wheel 1406. The date driving finger 1408 includes 4 of date driving finger portions 1408g1, 1408g2, 1408g3 and 1408g4.

The date indicator 1410 is rotatably integrated to a main plate 1412. The date indicator 1410 is provided with 31 of date indicator teeth. Date characters comprising numerals of from "1" to "31" are provided on an indication surface of the date indicator 1410. Here, only one date character "5" is illustrated in FIG. 47 to simplify the drawing.

A date jumper 1416 is rotatably integrated to the main plate 1412 to rotate centering on a date jumper rotational center 1416*c*. The date jumper 1416 is provided with a date jumper spring portion 1416*f*. A tail portion 1416*t* of the date jumper 1416 is positioned by a positioning portion 1412*d*. A regulating portion 1416*a* of the date jumper 1416 regulates a date indicator tooth 1410*a* by spring force of the date jumper spring portion 1416 and a regulating portion 1416*b* of the date jumper 1416 regulates a date indicator tooth 1410*b*.

The date jumper 1416 may be constituted as a separate part as illustrated or may be formed integrally with other part such as a date indicator holder or a back part holder or the like.

The respective date driving finger portions 1408g1, 1408g2, 1408g3 and 1408g4 are formed in the same shape and each of them is provided with an outer peripheral portion 1408*t* having a shape of a circular arc or nearly equal to a circular arc centering on a center 1408*c* and two side portions 1408s1 and 1408s2 respectively extended from both ends of the outer peripheral portion 1408*t* toward a side proximate to the center 1408*c*. Although in FIG. 47, the outer peripheral portion 1408*t* and the side portions 1408s1 and 1408s2 are illustrated only in respect of the date finger portion 1408g3, the shapes of the outer peripheral portion 1401*t* and the side portions 1408s1 and 1408s2 remain the same also in respect of the other date finger portions 1408g1, 1408g2 and 1408g4.

Intersecting portions of the outer peripheral portion 1408*t* and the side portions 1408s1 and 1408s2 are respectively provided with corner roundness (comparatively small circular arc). Each of the side portions 1408s1 and 1408s2 may be constituted by a single straight line, or may be constituted by one or more of circular arcs or may be constituted by a combination of circular arc and straight line. The side portions 1408s1 and 1408s2 are formed to be in a shape capable of firmly rotating the date indicator 1410 by rotating the date driving finger 1408.

In contrast thereto, the outer peripheral portion 1408*t* is formed in a shape for stopping rotation of the date indicator 1410 when the date indicator 1410 is rotated and is brought into contact with the outer peripheral portion 1408*t*.

That is, according to the embodiment shown by FIG. 47 of the electronic timepiece of the invention, the date finger 1408 is constituted to provide a lock tooth configuration at front end portions of the respective date finger portions 1408g1, 1408g2, 1408g3 and 1408g4.

Similar to the above-described fifth embodiment of the invention, there is constructed a constitution in which the contact point spring is provided to the date driving wheel 1404 and by bringing the contact point pattern of the printed circuit board into contact with the contact point spring, the state of rotating the date driving wheel 1406 is detected. Further, the motor driving circuit is constituted to control rotation of the ultrasonic motor by inputting the rotation signal outputted from the contact point pattern.

There is constructed a constitution in which a position of the date jumper 1416 along the rotational direction of the date indicator 1410 is regulated such that one date indicator tooth 1410*d* of the date indicator 1410 is positioned on a straight line 1408A passing through a rotational center 1410*k* of the date indicator 1410 and the rotational center 1408*c* of the date finger 1408.

In a state in which the ultrasonic motor is stopped, two of the date finger portions 1408g1 and 1408g2 in the four date finger portions, are positioned to dispose at symmetrical positions with the straight line 1408A as a symmetrical axis line.

Next, an explanation will be given of operation of the calendar mechanism of the electronic timepiece according to the eighth embodiment of the invention.

According to the electronic timepiece 1400 of the invention, similar to the seventh embodiment of the invention explained in reference to FIG. 42 and FIG. 43, by rotating the date driving wheel 1406, the first contact point portion 1160*a* and the second contact point portion 1160*b* can be brought into contact with the respective patterns in the order of the reference potential pattern 1174*a* and the contact point switch pattern 1174*b*. Further, as shown by FIG. 42, in the state in which both of the first contact point portion 1160*a* and the second contact point portion 1160*b* are brought into contact with the reference potential pattern 1174*a*, the rotation signal is not outputted.

In contrast thereto, as shown by FIG. 43, in the state in which the first contact point portion 1160*a* is brought into contact with the reference potential pattern 1174*a* and the second contact point portion 1160*b* is brought into contact with the contact point switch pattern 1174*b*, the rotation signal is outputted. Similarly, also in the state in which the first contact point portion 1160*a* is brought into contact with the contact point switch pattern 1174*b* and the second contact point portion 1160*b* is brought into contact with the reference potential pattern 1174*a*, the rotational signal is outputted.

In the state in which neither of the first contact point portion 1160*a* and the second contact point portion 1160*b* is brought into contact with the contact point switch pattern 1174*b*, the rotation signal is not outputted.

Therefore, in reference to FIG. 47, by rotating the ultrasonic motor and rotating the date driving wheel 1406 in the clockwise direction by 90 degree, the date finger portion 1408g1 can also be rotated in the clockwise direction by 90 degree and the date indicator tooth 1410*d* of the date indicator 1410 can be rotated in the clockwise direction. Further, by operating the date jumper 1416, the date indicator 1410 is stopped in a state in which the date indicator 1410 is rotated in the clockwise direction by (360/31) degree.

In the state, the motor driving circuit inputs the rotation signal outputted from the contact point pattern and controls rotation of the ultrasonic motor. Accordingly, the date driving wheel 1406 is stopped in the state in which the date driving wheel 1406 is rotated in the clockwise direction by 90 degree.

Further, by operating the ultrasonic motor and rotating the date driving wheel 1406 in the counterclockwise direction by 90 degree, the date finger portion 1408g1 can also be rotated in the counterclockwise direction by 90 degree and the date indicator tooth 1410*d* of the date indicator 1410 can be rotated in the counterclockwise direction. Further, by operating the date jumper 1416, the date indicator 1410 is stopped in a state in which the date indicator 1410 is rotated in the counterclockwise direction by (360/31) degree.

Also in this state, the motor driving circuit inputs the rotation signal outputted from the contact point pattern and controls rotation of the ultrasonic motor. Therefore, the date driving wheel 1406 is stopped in the state in which the date driving wheel 1406 is rotated in the counterclockwise direction by 90 degree.

By constructing such a constitution, according to the electronic timepiece of the invention, by rotating the date finger 1408 in the clockwise direction, the date indicator 1410 can be rotated in the clockwise direction and by rotating the date finger 1408 in the counterclockwise direction, the date indicator 1410 can be rotated in the counter clockwise direction. Further, by operating the date jumper 1416, the position of the date indicator 1410 along the rotational direction is positioned always accurately.

Next, an explanation will be given of operation of the case in which the date indicator 1410 is rotated when the electronic timepiece undergoes impact or the like.

Figure 48:
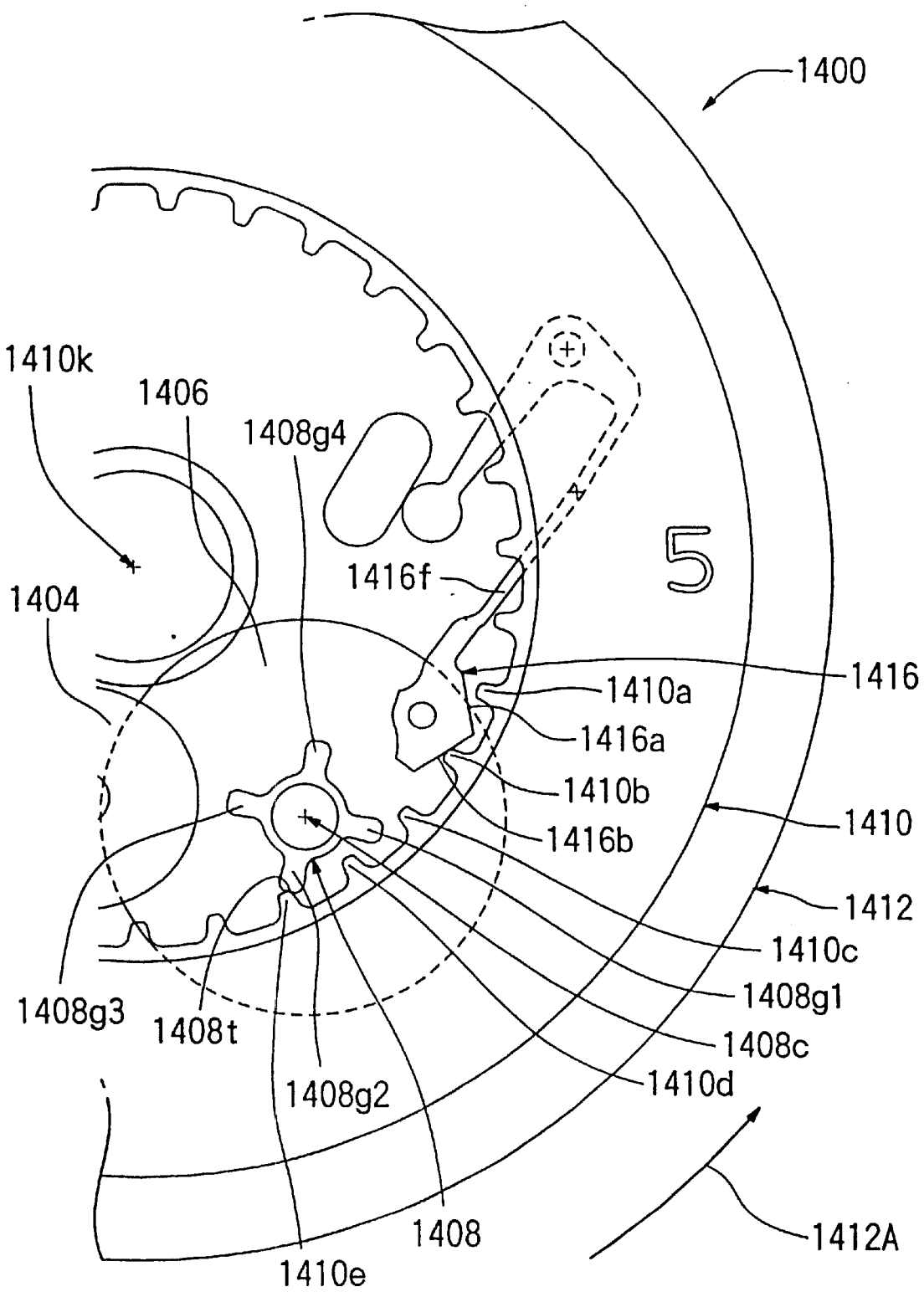
FIG. 48 is an outline plane view showing the calendar mechanism portion of the electronic timepiece having the date finger in the first shape according to the eighth embodiment of the invention in a state in which a date indicator is rotated by external force in the counterclockwise direction.

In reference to FIG. 48, when the date indicator 1410 is rotated in the counterclockwise direction designated by an arrow mark 1412A, a date indicator tooth 1410*e* of the date indicator 1410 is brought into contact with the outer peripheral portion 1408*t* of the date finger portion 1408g2. The shape of the outer peripheral portion 1408*t* is in a shape of a circular arc centering on the center 1408*c* or a shape near to the circular arc. Further, the index torque of the ultrasonic motor is transmitted to the date finger 1408. Therefore, by the contact with the date indicator tooth 1410*e*, the date finger 1408 cannot be rotated.

Further, in the state shown by FIG. 48, the regulating portion 1416*b* of the date jumper 1416 is brought into contact with the date indicator tooth 1410*b* and accordingly, by the spring force of the date jumper spring portion 1416*f*, the date indicator 1410 can be rotated in the clockwise direction and can be returned to the state shown by FIG. 47.

Figure 49:
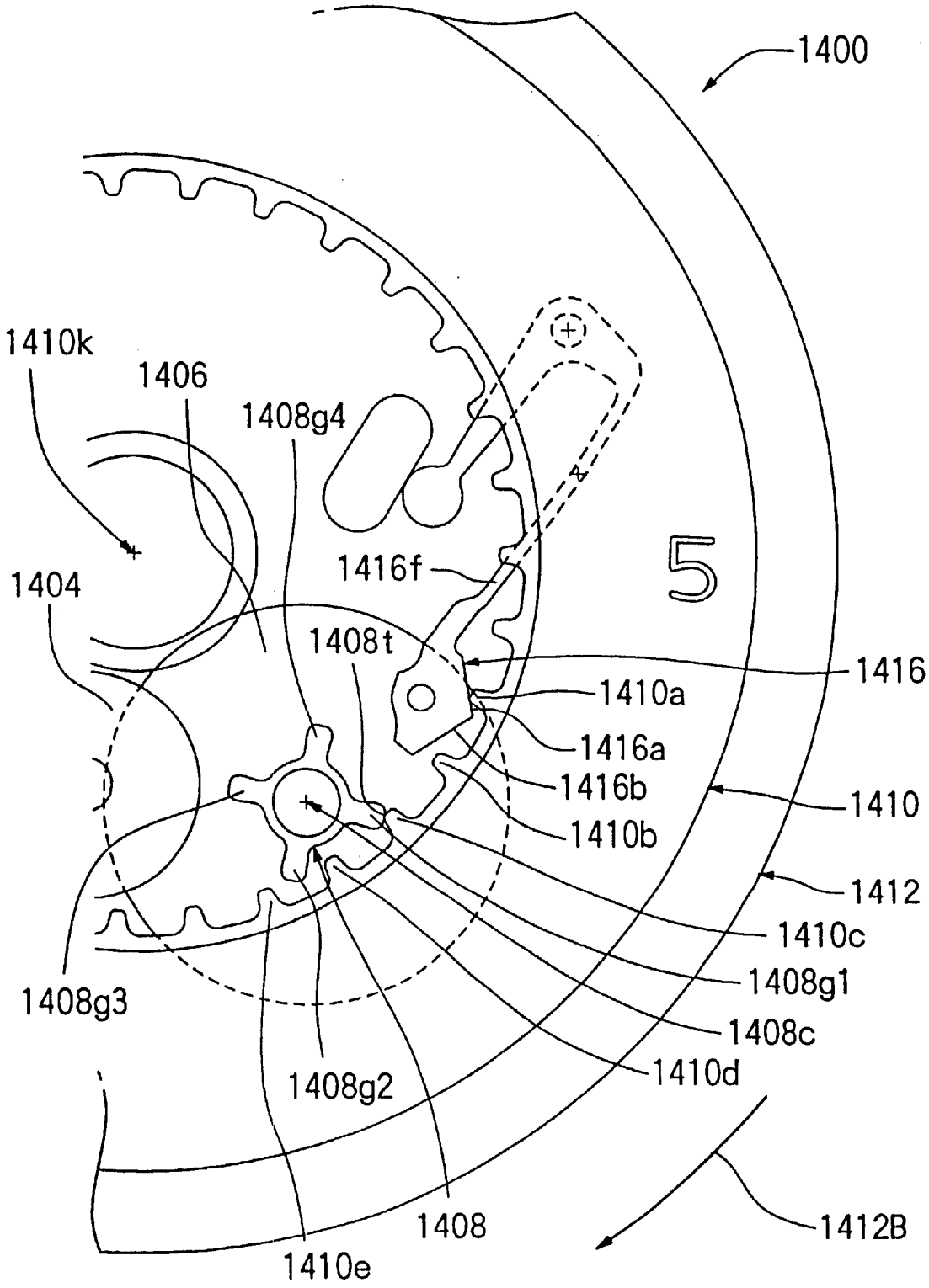
FIG. 49 is an outline plane view showing the calendar mechanism portion of the electronic timepiece having the date finger in the first shape according to the eighth embodiment of the invention in a state in which the date indicator is rotated by external force in the clockwise direction.

Next, in reference to FIG. 49, when the date indicator 1410 is rotated in the clockwise direction designated by an arrow mark 1412B, the date indicator tooth 1410*c* of the date indicator 1410 is brought into contact with the outer peripheral portion 1408*t* of the date finger portion 1408g1. Accordingly, by the contact with the date indicator tooth 1410*c*, the date finger 1408 cannot be rotated.

Further, in the state shown by FIG. 49, the regulating portion 1416*a* of the date jumper 1416 is brought into contact with the date indicator tooth 1410*a* and accordingly, by the spring force of the date jumper spring portion 1416*f*, the date indicator 1410 can be rotated in the counterclockwise direction and can be returned to the state shown by FIG. 47.

That is, the electronic timepiece of the invention is constituted such that the date finger 1408 cannot be rotated even when the date indicator 1410 is rotated in either direction of the clockwise direction and the counterclockwise direction by the mesh between the date indicator tooth 1410*e* or 1410*c* of the date wheel 1410 and the index torque of the ultrasonic motor.

For example, assume that rotational force from the date indicator 1410 caused by external force of impact or the like is designated by notation F1, the index torque of the ultrasonic motor is designated by notation F2, rotation resistance force produced by the mesh between the date indicator tooth 1410*e* or 1410*c* and the date finger 1408 is designated by notation F3 and a reduction ratio of the wheel train from the ultrasonic motor to the date finger 1408 is designated by notation n.

Compare the force F1 for rotating the date indicator 1410 by external force of impact or the like with force (F2+F3)/n hampering the rotation. At this occasion, F3 can be made larger than F1 by the shape of the outer peripheral portion 1408*t* of the date finger portion 1408g1.

Therefore, by the constitution of the electronic timepiece of the invention, it is established that (F2+F3)/n>>F1 and rotation of the date indicator 1410 produced by external force can effectively be hampered.

Figure 50:
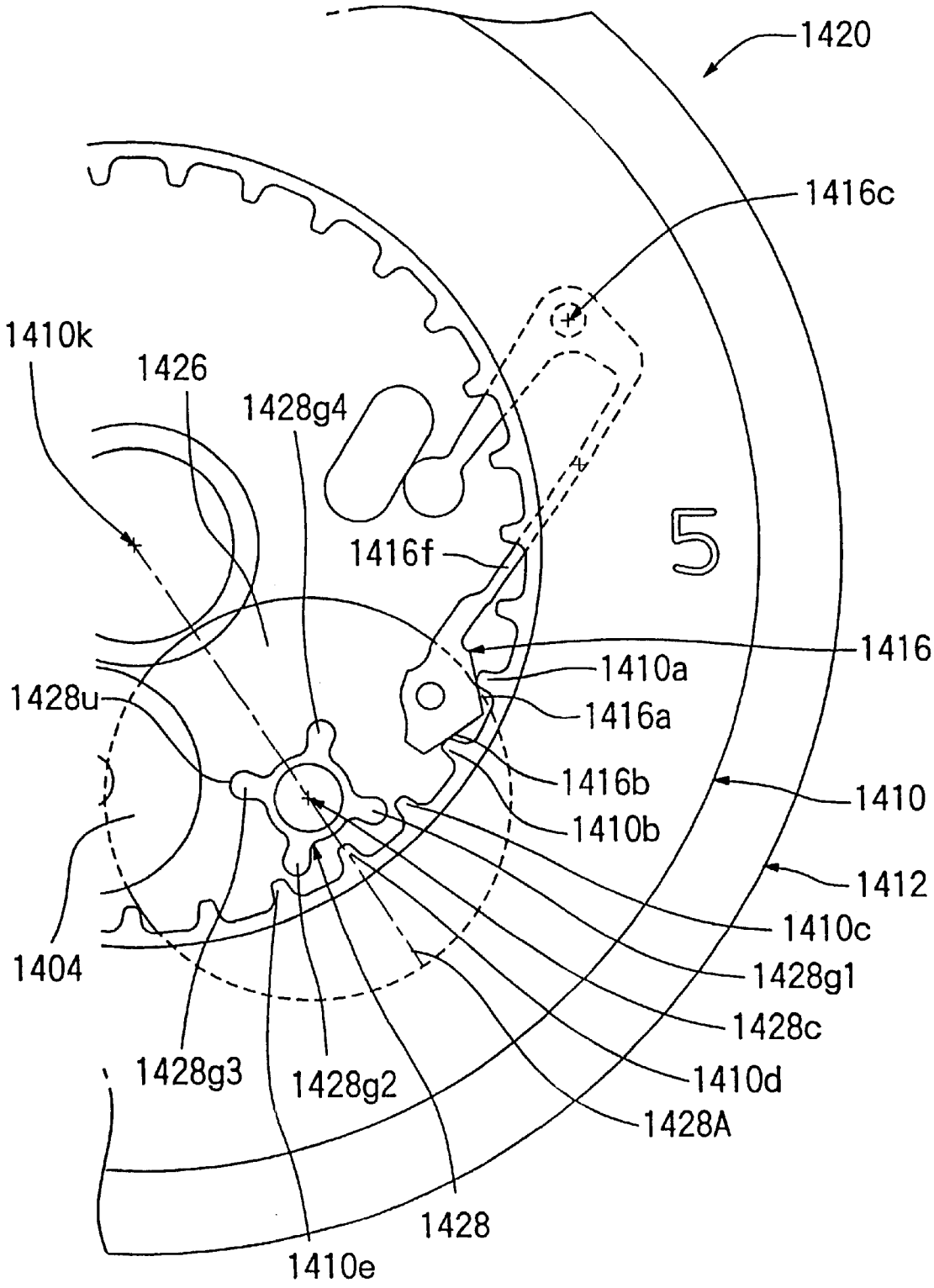
FIG. 50 is an outline plane view showing a calendar mechanism portion of the electronic timepiece having a date finger in a second shape according to the eighth embodiment of the invention.

Next, in reference to FIG. 50, the date finger portions 1428g1, 1428g2, 1428g3 and 1428g4 of the date finger 1428 are formed in the same shape and each of them is provided with an outer peripheral portion 1428*u* having a circular arc shape centering on a position separated from the center 1428*c*. Although in FIG. 50, the outer peripheral portion 1428*u* is illustrated only in respect of the date finger portion 1428g3, the shape of the outer peripheral portion 1428*u* remains the same also in respect of the other date finger portions 1428g1, 1428g2 and 1428g4.

The outer peripheral portion 1428*u* is formed in a shape by which the date indicator 1410 can firmly be rotated by rotating the date finger 1428 and rotation of the date indicator 1410 is stopped when the date indicator 1410 is rotated and is brought into contact with the outer peripheral portion 1428*u*.

That is, according to the embodiment of the electronic timepiece of the invention shown by FIG. 50, the date finger 1428 is constituted such that each of front end portions of the date finger portions 1428g1, 1428g2, 1428g3 and 1428g4 is provided with a lock tooth configuration.

Figure 51:
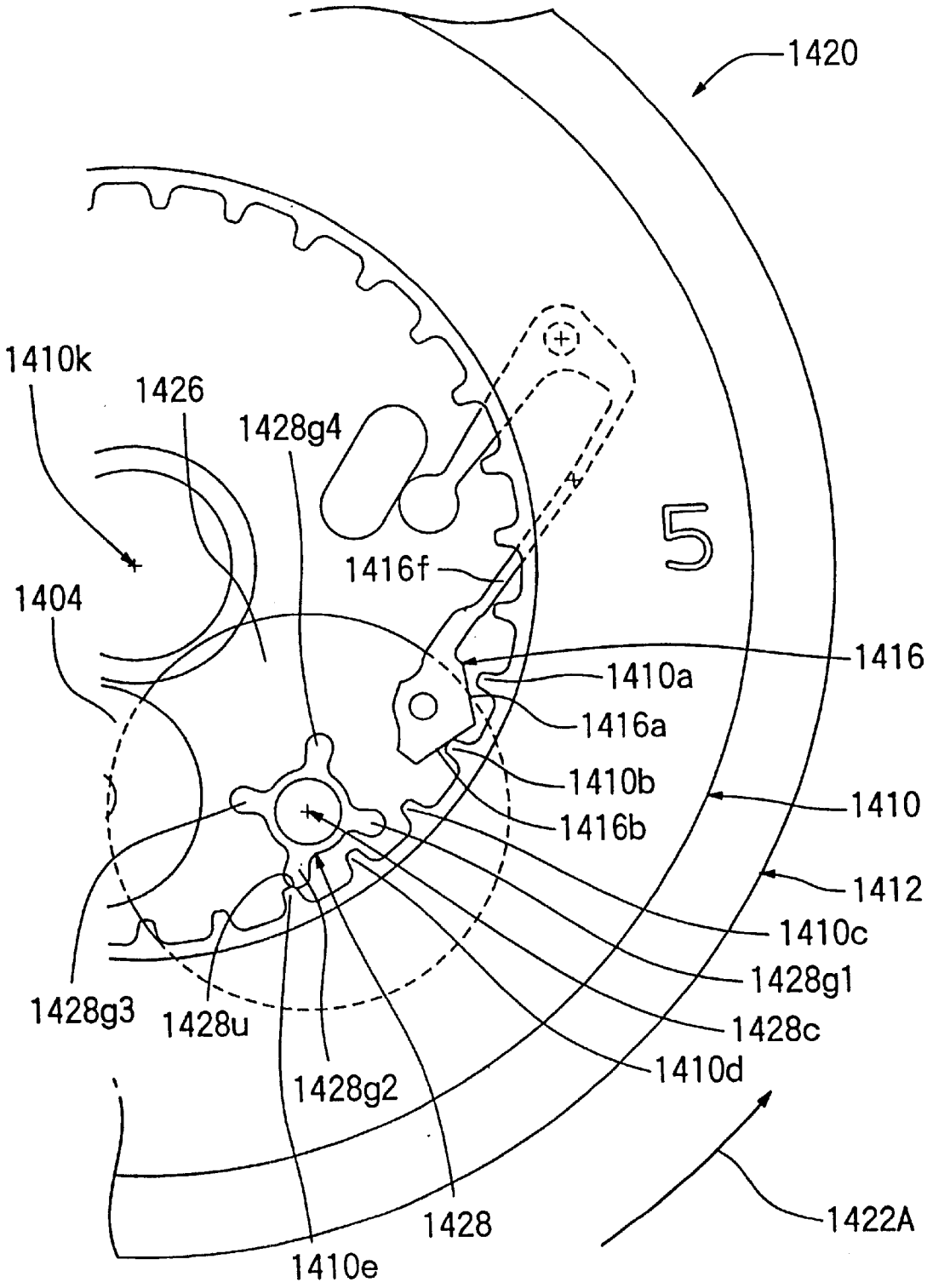
FIG. 51 is an outline plane view showing the calendar mechanism portion of the electronic timepiece having the date finger in the second shape according to the eighth embodiment of the invention in a state in which the date indicator is rotated by external force in the counterclockwise direction.

In reference to FIG. 51, when the date indicator 1410 is rotated in the counterclockwise direction designated by an arrow mark 1422A, the date indicator tooth 1410*e* of the date indicator 1410 is brought into contact with the outer peripheral portion 1428*u* of the date finger portion 1428g2. The shape of the outer peripheral portion 1428*u* is the circular arc shape centering on the position separated from the center 1428*c*. Further, the index torque of the ultrasonic motor is transmitted to the date finger 1428. Therefore, by the contact with the date indicator tooth 1410*e*, the date finger 1428 cannot be rotated.

Further, in a state shown by FIG. 51, the regulating portion 1416*b* of the date jumper 1416 is brought into contact with the date indicator tooth 1410*b* and accordingly, by the spring force of the date jumper spring portion 1416*f*, the date indicator 1410 can be rotated in the clockwise direction and can be returned to the state shown by FIG. 50.

Figure 52:
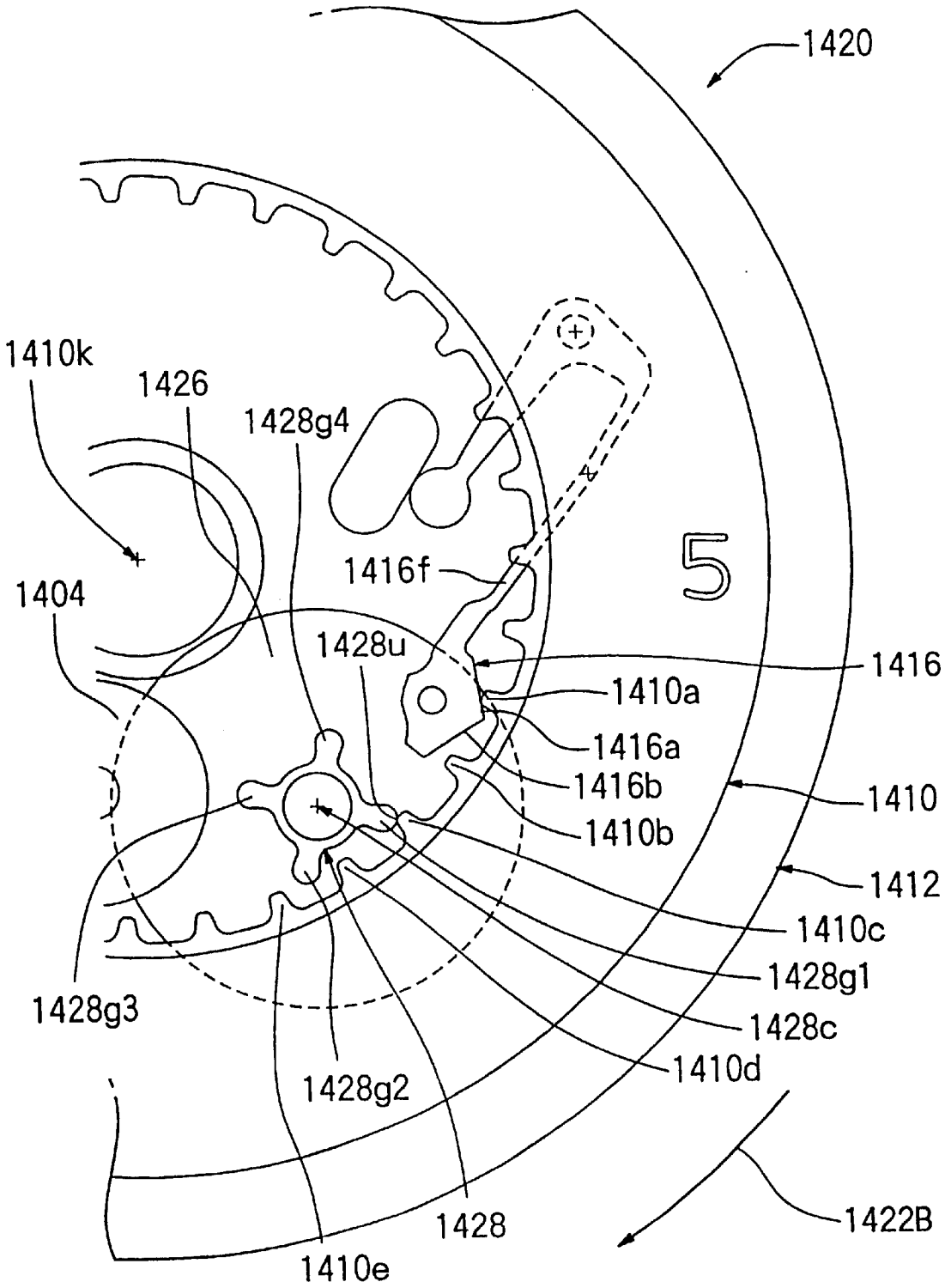
FIG. 52 is an outline plane view showing the calendar mechanism portion of the electronic timepiece having the day finger in the second shape according to the eighth embodiment of the invention in a state in which the date indicator is rotated by external force in the clockwise direction.

Next, in reference to FIG. 52, when the date indicator 1410 is rotated in the clockwise direction designated by an arrow mark 1422B, the date indicator tooth 1410*c* of the date indicator 1410 is brought into contact with the outer peripheral portion 1428*u* of the date finger portion 1428g1. Accordingly, by the contact with the date indicator tooth 1410*c*, the date finger 1428 cannot be rotated.

Further, in a state shown by FIG. 52, the regulating portion 1416*a* of the date jumper 1416 is brought into contact with the date indicator tooth 1410*a* and therefore, by the spring force of the date jumper spring portion 1416*f*, the date indicator 1410 can be rotated in the counterclockwise direction and can be returned to the state shown by FIG. 50.

Figure 53:
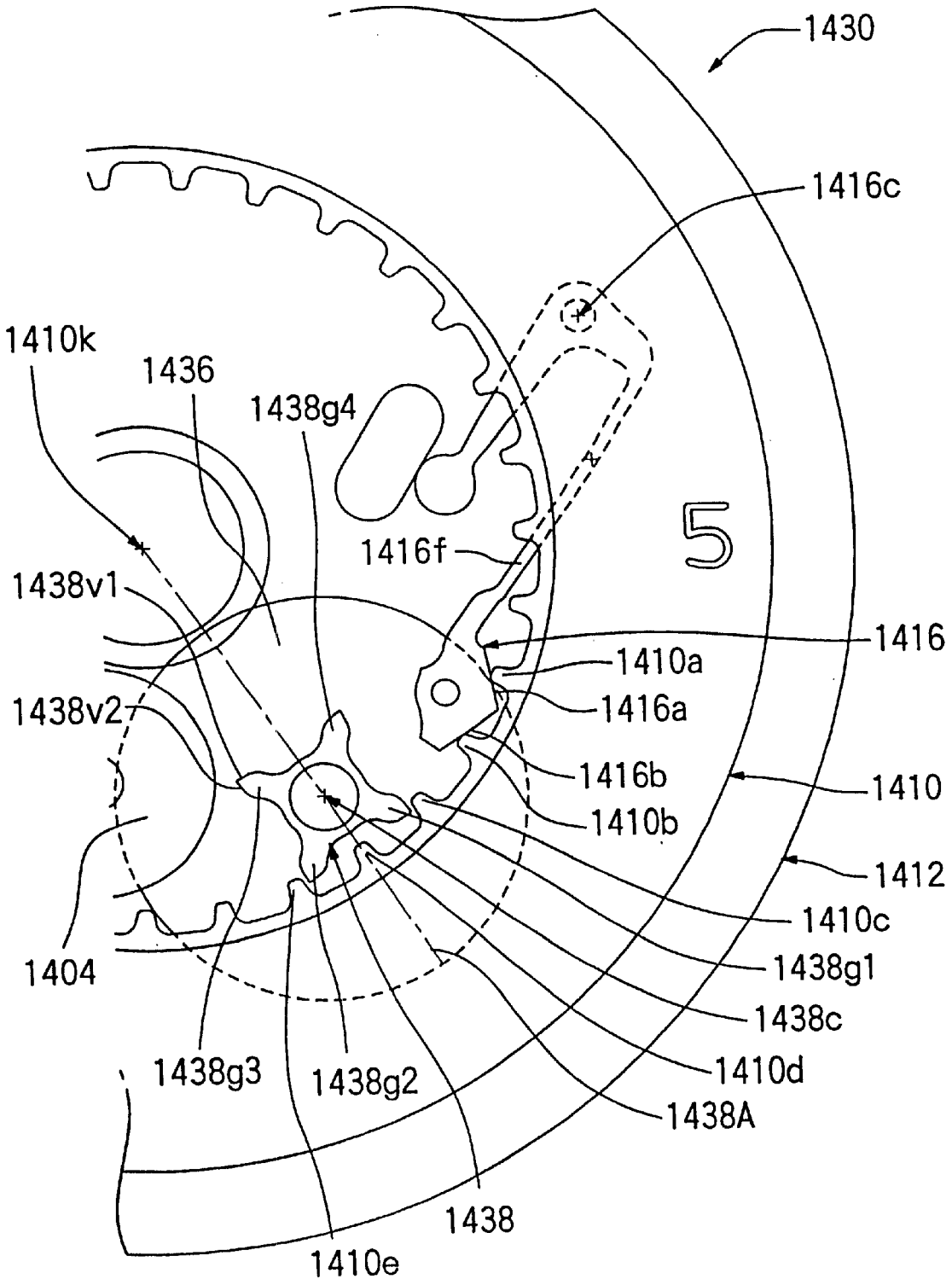
FIG. 53 is an outline plane view showing a calendar mechanism portion of the electronic timepiece having a date finger in a third shape according to the eighth embodiment of the invention.

Next, in reference to FIG. 53, date finger portions 1438g1, 1438g2, 1438g3 and 1438g4 of a date finger 1438 are formed in the same shape and each of them is provided with side face portions 1438v1 and 1438v2 having a front end of an acute angle. Although in FIG. 53, the side face portions 1438v1 and 1438v2 are illustrated only in respect of the date jumper portion 1438g3, shapes of the side face portions

1438v1 and 1438v2 remain the same also in respect of the other date finger portions 1438g1, 1438g2 and 1438g4.

The side face portions 1438v1 and 1438v2 and side face portions in a circular arc shape continuous thereto are constituted such that the date indicator 1410 can firmly be rotated by rotating the date finger 1438. The side face portions 1438v1 and 1438v2 are formed in a shape by which when the date indicator 1410 is brought into contact with the side face portions 1438v1 and 1438v2, rotation of the date indicator 1410 is stopped.

That is, according to the embodiment of the electronic timepiece of the invention shown by FIG. 50, the date finger 1438 is constituted such that the front end portion of each of the date finger portions 1438g1, 1438g2, 1438g3 and 1438g4 is provided with a lock tooth configuration.

Figure 54:
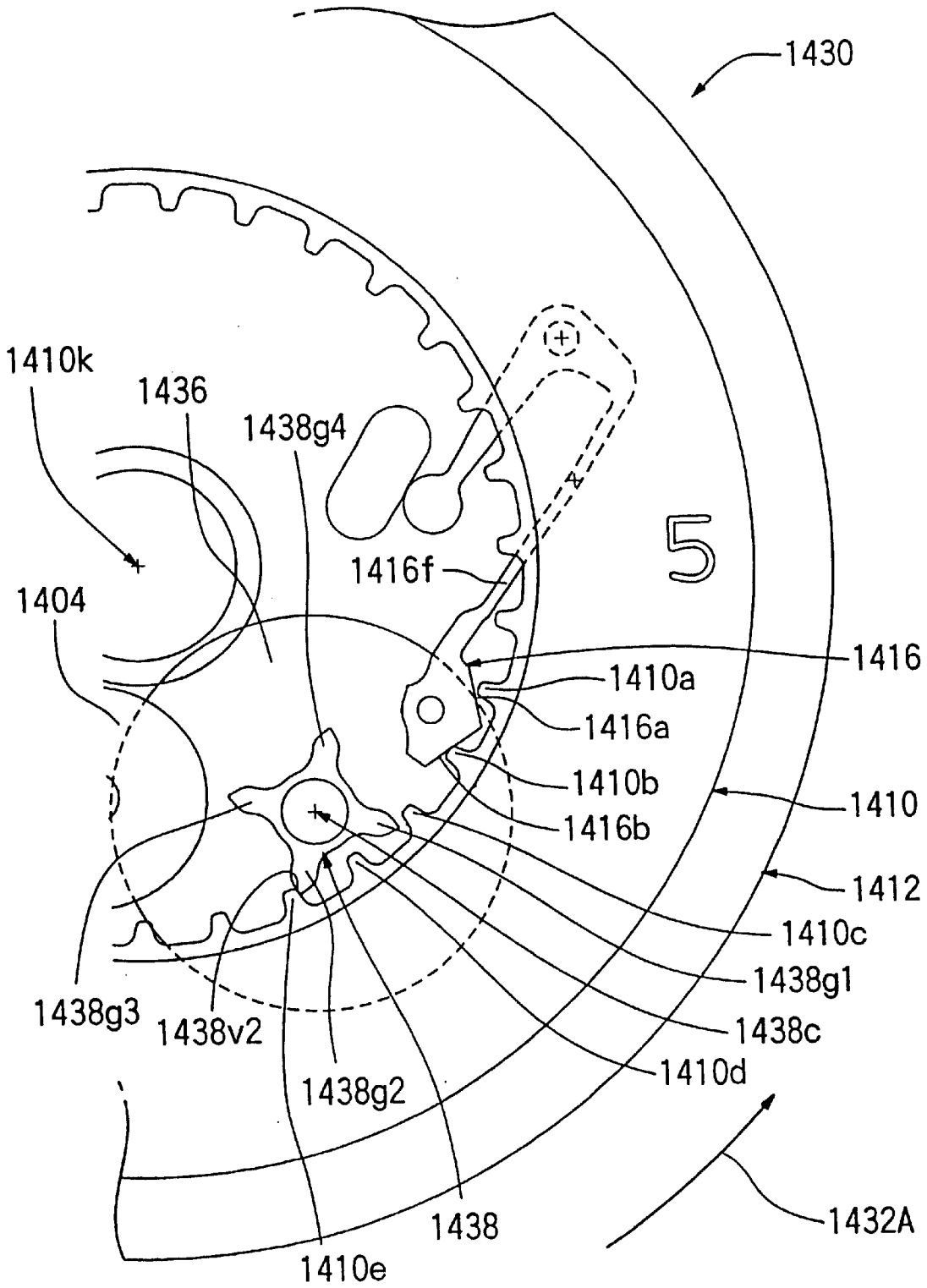
FIG. 54 is an outline plane view showing the calendar mechanism portion of the electronic timepiece having the date finger in the third shape according to the eighth embodiment of the invention in a state in which the date indicator is rotated by external force in the counterclockwise direction.

In reference to FIG. 54, when the date indicator 1410 is rotated in the counterclockwise direction designated by an arrow mark 1432A, the date indicator tooth 1410*e* of the date indicator 1410 is brought into contact with the side face portion 1438v2 of the date finger portion 1438g2. At this occasion, the index torque of the ultrasonic motor is transmitted to the date finger 1438. Therefore, by the contact with the date indicator tooth 1410*e*, the date finger 1438 cannot be rotated.

Further, in the state shown by FIG. 54, the regulating portion 1416*b* of the date jumper 1416 is brought into contact with the date indicator tooth 1410*b* and accordingly, by the spring force of the date jumper spring portion 1416*f*, the date indicator 1410 can be rotated in the clockwise direction and can be returned to the state shown by FIG. 53.

Figure 55:
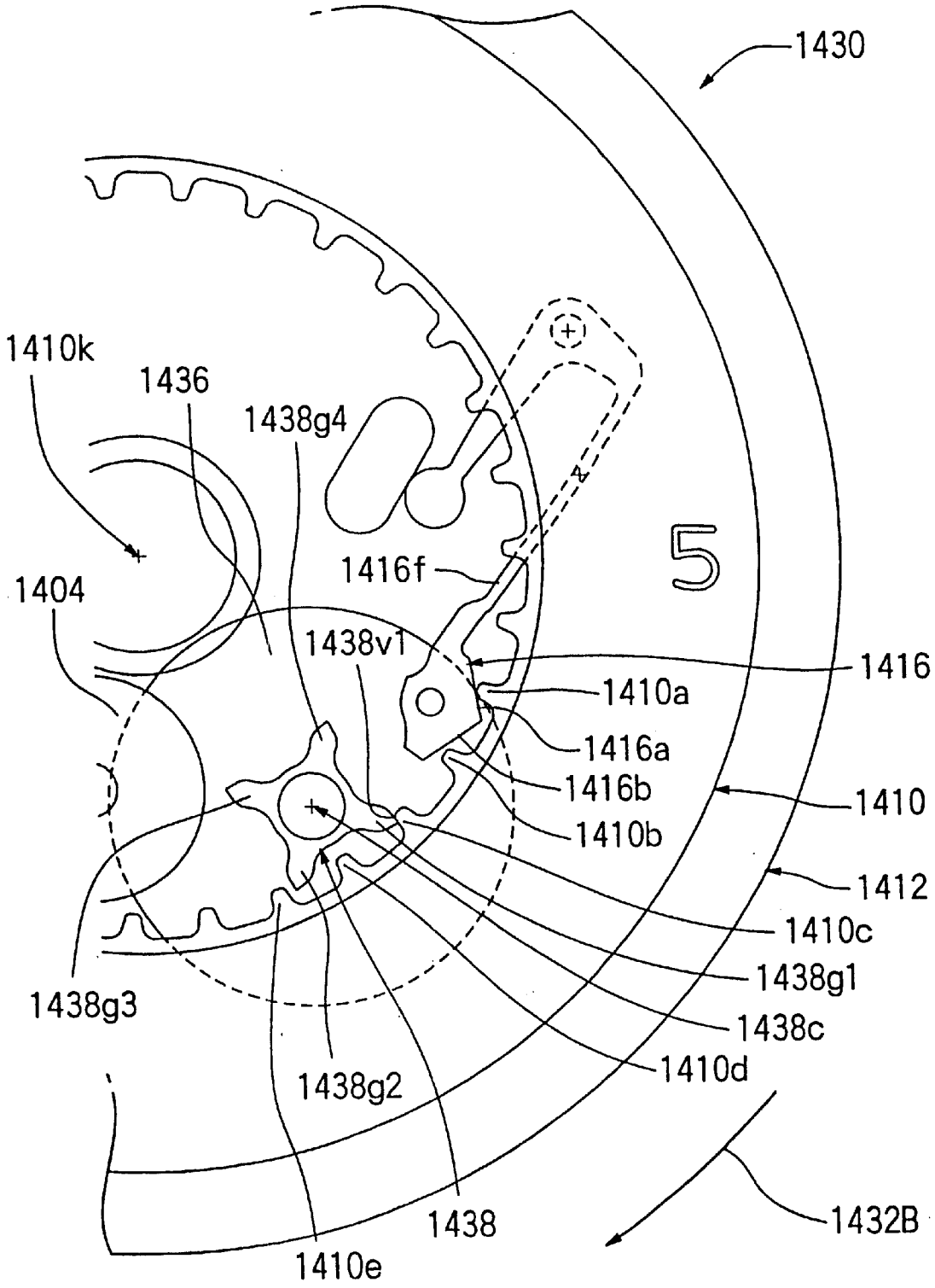
FIG. 55 is an outline plane view showing the calendar mechanism portion of the electronic timepiece having the date finger in the third shape according to the eighth embodiment of the invention in a state in which the date indicator is rotated by external force in the clockwise direction.

Next, in reference to FIG. 55, when the date indicator 1410 is rotated in the clockwise direction designated by an arrow mark 1432B, the date indicator tooth 1410*c* of the date indicator 1410 is brought into contact with the side face portion 1438v1 of the date finger portion 1438g1. Also in this case, the index torque of the ultrasonic motor is transmitted to the date finger 1438. Accordingly, by the contact with the date indicator tooth 1410*c*, the date finger 1438 cannot be rotated.

Further, in the state shown by FIG. 55, the regulating portion 1416*a* of the date jumper 1416 is brought into contact with the date indicator tooth 1410*a* and accordingly, by the spring force of the date jumper spring portion 1416*f*, the date indicator 1410 can be rotated in the counterclockwise direction and can be returned to the state shown by FIG. 53.

By such a constitution, according to the electronic timepiece of the invention, when external force by impact or the like is exerted on the electronic timepiece, there is almost no concern of rotating the date indicator.

(11) Further, the electronic timepiece of the invention may be constructed by the following constitution.

[1] An electronic timepiece having a function of indicating data in respect of a calendar, the electronic timepiece is characterized by comprising:

a control circuit (130) having a calendar signal generating circuit for generating a calendar signal by counting data in respect of a calendar such as year, month, day and the like and data in respect of time and having an ultrasonic motor driving circuit for outputting an ultrasonic motor drive signal for rotating an ultrasonic motor (132) based on the calendar signal outputted from the calendar signal generating circuit;

the ultrasonic motor (132) having an ultrasonic stator (122) bonded with a piezoelectric element and an ultrasonic rotor (102) frictionally driven by oscillatory waves generated at the ultrasonic stator by elongation and contraction of the piezoelectric element by inputting the ultrasonic motor drive signal;

a calendar indication wheel operated based on rotation of the ultrasonic rotor (102) for displaying data in respect of the calendar;

a date driving termination detecting contact point member for detecting a termination time point of date driving based on rotation of the ultrasonic rotor (102); and a date driving control circuit for inputting a signal in respect of start of the date driving outputted from a date driving start detecting contact point member and inputting a signal in respect of termination of the date driving outputted from the date driving termination detecting contact point member to thereby control operation of a date indication driving circuit for outputting a date indication motor driving signal.

[2] The electronic timepiece according to the above-described [1], characterized in that:

the calendar indication wheel is a date indicator (100) for indicating data in respect of day;

the calendar signal generating circuit counts data in respect of a leap year and days from January to December; and the ultrasonic motor driving circuit is constituted such that indication of day becomes 1 on the first day of each month based on a counted result of the calendar signal generating circuit such that when an end of a month with thirty or less days is changed to a next month, there is outputted the ultrasonic motor drive signal which differs from the ultrasonic motor drive signal outputted when an end of a 31-day month is changed to a next month.

[3] The electronic timepiece according to the above-described [2] or [2] characterized in further comprising a calendar wheel train operated based on rotation of the ultrasonic rotor (102);

wherein the calendar indication wheel is operated by the calendar wheel train.

[4] The electronic timepiece according to any one of the above-described [1] through [3], further comprising a date finger operated based on rotation of the ultrasonic rotor (102);

wherein the calendar indication wheel is operated by the date finger.

[5] The electronic timepiece according to any one of the above-described [1] through [4] characterized by comprising a regulating member for regulating a position of the calendar indication wheel along a rotational direction.

As has been explained above, the electronic timepiece is constituted as mentioned above and accordingly, the invention achieves effects described below.

(1) There can be realized the electronic timepiece having the transmission wheel rotational position detecting apparatus for accurately detecting the position of the transmission wheel along the rotational direction.

(2) There can be realized the small-sized electronic timepiece having the rotational position detecting apparatus of the transmission wheel.

(3) There can be realized the electronic timepiece having the transmission wheel rotational position detecting apparatus whose contact point achieves high durability performance.

[0144]

(4) In the electronic timepiece having the date indicator, the date driving can be started accurately at the same time every day.

(5) In the electronic timepiece having the date indicator, the position of the date indicator can accurately be maintained. Therefore, there is almost no concern of deviating the position of the date character of the date indicator.

(6) When external force by impact or the like is exerted on the electronic timepiece, there is no concern of rotating the indication wheel or the date wheel.

(7) Stationary torque of the motor for rotating the date indicator can be reduced and accordingly, power consumption of the motor can be reduced. That is, by the invention, there can be realized the electronic timepiece having long battery life.

What is claimed is:

1. An electronic timepiece comprising:

a wheel train mounted for undergoing rotation;

a transmission wheel for undergoing rotation in accordance with rotation of the wheel train;

a contact point spring having a conductivity and connected to the transmission wheel for rotation therewith, the contact point spring extending substantially linearly through a rotational center of the transmission wheel;

first and second detection patterns for contacting the contact point spring during rotation of the transmission wheel to generate a rotational position detecting signal corresponding to a rotational position of the transmission wheel, the first and second detection patterns being disposed at an angle of substantially 180 degree relative to the rotational center of the transmission wheel; and first and second dummy patterns for contacting the contact point spring during rotation thereof.

2. An electronic timepiece comprising:

a wheel train mounted for undergoing rotation;

a transmission wheel for undergoing forward and reverse rotation in accordance with rotation of the wheel train;

a contact point spring having electric conductivity and connected to the transmission wheel for rotation therewith, the contact point spring having first, second and third contact point spring terminals extending outwardly from a rotational center of the transmission wheel;

a plurality of detection patterns comprised of a first detection pattern, a second detection pattern and a VDD pattern disposed to contact the contact point spring during rotation of the transmission wheel to electrically connect the first detection pattern, the second detection pattern and the VDD pattern to one another to generate a rotational position detecting signal corresponding to a rotational position of the transmission wheel, the VDD pattern having a first pattern portion and a second pattern portion, the first pattern portion having a first end portion adjacent to and spaced-apart from the first detection pattern and a second end portion opposite the first end portion and adjacent to and spaced-apart from the second detection pattern, and the second pattern portion having a first peripheral end portion adjacent to and spaced-apart from the first detection pattern and a second peripheral end portion opposite the first peripheral end portion and adjacent to and spaced-apart from the second detection pattern; and a detecting circuit for detecting forward rotation of the transmission wheel when the first detection pattern and the VDD pattern are electrically connected together before the first detection pattern, the second detection pattern and the VDD pattern are electrically connected together, and for detecting reverse rotation of the transmission wheel when the second detection pattern and the VDD pattern are electrically connected together before the first detection pattern, the second detection pattern and the VDD pattern are electrically connected together.

3. An electronic timepiece according to claim 2;

wherein the first detection pattern, the first pattern portion of the VDD pattern, the second detection pattern and the second pattern portion of the VDD pattern are disposed sequentially in a circumferential direction about the rotational center of the transmission wheel.

4. An electronic timepiece according to claim 3;

wherein the first contact point spring terminal and the second contact point spring terminal are disposed at an angle of substantially 75 degrees relative to each another.

5. An electronic timepiece according to claim 4;

wherein the first contact point spring terminal and the third contact point spring terminal are disposed at an angle of substantially 142.5 degrees relative to each another.

6. An electronic timepiece according to claim 5;

wherein the second contact point spring terminal and the third contact point spring terminal are disposed at an angle of substantially 142.5 degrees relative to each another.

7. An electronic timepiece according to claim 6;

wherein the first detection pattern is disposed within an angle of substantially 30 degrees relative to the rotational center of the transmission wheel.

8. An electronic timepiece according to claim 7;

wherein the second detection pattern is disposed within an angle of substantially 30 degrees relative to the rotational center of the transmission wheel.

9. An electronic timepiece according to claim 8;

wherein the first pattern portion of the VDD is disposed within an angle of substantially 60 degrees relative to the rotational center of the transmission wheel.

10. An electronic timepiece according to claim 9;

wherein the second pattern portion of the VDD is disposed within an angle of substantially 240 degrees relative to the rotational center of the transmission wheel.

11. An electronic timepiece comprising:

a transmission wheel mounted for undergoing rotation;

a contact point spring for undergoing rotation in accordance with rotation of the transmission wheel, the contact point spring having a first contact point portion and second contact point portion; and a contact point pattern having a reference potential pattern and a contact point switch pattern disposed to contact the first and second contact point patterns;

wherein when the transmission wheel rotates, a rotational signal corresponding to rotation of the transmission wheel is not outputted in a state in which both of the first contact point portion and the second contact point portion contact the reference potential pattern, the rotational signal is outputted in a state in which the first contact point portion contacts the reference potential pattern and the second contact point portion contacts the contact point switch pattern, the rotational signal is outputted in a state in which the first contact point portion contacts the contact point switch pattern and the second contact point portion contacts the reference potential pattern, and the rotational signal is not outputted in a state in which neither of the first contact point portion and the second contact point portion is not brought into contact with the contact point switch pattern.

12. An electronic timepiece according to claim 11;

wherein the first contact point portion extends in a first direction and the second contact point portion extends in a second direction different from the first direction.

13. An electronic timepiece comprising:

a transmission wheel mounted for undergoing forward and reverse rotation about a rotational center;

a contact point spring connected to the transmission wheel for rotation therewith;

a plurality of detection patterns comprised of a first detection pattern, a second detection pattern and a VDD pattern disposed to contact the contact point spring during rotation of the transmission wheel to connect the first detection pattern, the second detection pattern and the VDD pattern with one another to generate a rotational position detecting signal corresponding to a rotational position of the transmission wheel, the VDD pattern having a first pattern portion and a second pattern portion, the first pattern portion having a first end portion adjacent to and spaced-apart from the first detection pattern and a second end portion opposite the first end portion and adjacent to and spaced-apart from the second detection pattern, and the second pattern portion having a first peripheral end portion adjacent to and spaced-apart from the first detection pattern and a second peripheral end portion opposite the first peripheral end portion and adjacent to and spaced-apart from the second detection pattern; and a detecting circuit for detecting forward rotation of the transmission wheel when the first detection pattern is connected to the VDD pattern before the first detection pattern, the second detection pattern and the VDD pattern are connected to one another, and for detecting reverse rotation of the transmission wheel when the second detection pattern is connected with the VDD pattern before the first detection pattern, the second detection pattern and the VDD pattern are connected with one another.

* * * * *